US007006067B2

(12) United States Patent
Tobita et al.

(10) Patent No.: US 7,006,067 B2
(45) Date of Patent: Feb. 28, 2006

(54) DISPLAY DEVICE

(75) Inventors: Youichi Tobita, Hyogo (JP); Nobuyuki Hirano, Hyogo (JP); Masafumi Agari, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 198 days.

(21) Appl. No.: 10/119,722

(22) Filed: Apr. 11, 2002

(65) Prior Publication Data

US 2002/0180675 A1 Dec. 5, 2002

(30) Foreign Application Priority Data

May 30, 2001 (JP) ..... 2001-161998

(51) Int. Cl.
*G09G 3/36* (2006.01)

(52) U.S. Cl. ..... 345/92; 345/98; 345/99; 315/169.1

(58) Field of Classification Search ..... 345/87, 345/88, 89, 92, 96, 100, 90, 99, 212, 98, 345/211; 257/E27.095; 365/222; 315/169.1, 315/169.2, 169.3; 313/500
See application file for complete search history.

(56) References Cited

U.S. PATENT DOCUMENTS 5,428,370 A * 6/1995 Knapp et al. ..... 345/205
5,442,588 A * 8/1995 Runas ..... 365/222
5,627,557 A * 5/1997 Yamaguchi et al. ..... 345/90
5,945,972 A * 8/1999 Okumura et al. ..... 345/98
6,373,459 B1 4/2002 Jeong
6,456,267 B1 * 9/2002 Sato et al. ..... 345/92
6,486,470 B1 * 11/2002 Huang ..... 250/307
6,563,480 B1 * 5/2003 Nakamura ..... 345/82
6,597,329 B1 * 7/2003 Moss ..... 345/55
6,636,194 B1 * 10/2003 Ishii ..... 345/98
6,662,291 B1 * 12/2003 Hashimoto et al. ..... 711/217

FOREIGN PATENT DOCUMENTS

| | | |
|---|---|---|
| JP | 8-221039 | 8/1996 |
| JP | 9-258168 | 10/1997 |
| JP | 10-228012 | 8/1998 |
| JP | 2000-10075 | 1/2000 |
| JP | 2000-267628 | 9/2000 |

OTHER PUBLICATIONS

U.S. Appl. No. 09/832,958, filed Apr. 12, 2001.
U.S. Appl. No. 09/932,958, filed Apr. 12, 2001.

* cited by examiner

*Primary Examiner*—Amr A. Awad
*Assistant Examiner*—Abbas Abdulselam
(74) *Attorney, Agent, or Firm*—Leydig, Voit & Mayer, Ltd.

(57) ABSTRACT

In a liquid crystal display, complementary signal lines for data lines are provided, corresponding to columns of pixels arranged in a display pixel matrix. In a refresh mode, data of these pixels are read out on the complementary signal lines, and differentially amplified by a sense amplifier. The data differentially amplified is written in the original pixel. A refresh operation is carried out internally and there is no need for externally providing a refresh memory for storing data used in refreshing the pixel data. Thus, it is possible to reduce the current consumption for holding data of pixels.

19 Claims, 23 Drawing Sheets

DISPLAY DEVICE

BACKGROUND OF THE INVENTION

1. Field of the Invention

The present invention relates to a display device for displaying images, and, more particularly, to a display device for driving pixel elements provided in correspondence to pixels by using a holding voltage of a capacitor.

2. Description of the Background Art

Conventionally, liquid crystal displays (LCD) have been known as one type of display devices. In LCDs, liquid crystal displays with a thin-film transistor driving system (TFT-LCD) utilizing thin film transistors (TFTs) have been known, in which a transistor (TFT) on an amorphous silicon (a-Si) semiconductor thin film or a polycrystalline silicon (p-Si) semiconductor thin film is used as a base material (an active layer), and a channel and a source/drain are formed on the active layer. In particular, an active matrix type liquid crystal panel, in which a TFT serving as a switch of video signals corresponding to a display element, has superior picture quality such as contrast and response speed characteristics, since the driving voltage for the display pixel element is held by the switching operation of the TFT. Thus, such active matrix type LCD has been widely used as a monitor of a mobile-type personal computer and a desk top personal computer or a projection-type monitor a for displaying still images and motion picture images.

FIG. 44 is a diagram schematically showing a construction of a conventional color liquid crystal display. In FIG. 44, the conventional color liquid crystal display includes: a liquid crystal display section 1002 in which unit display elements 1001, each containing pixels of three colors of red (R), green (G) and blue (B), are arranged in a matrix of rows and columns; a vertical scanning circuit 1003 for successively selecting scanning lines 1010 of this liquid crystal display section 1002; and a horizontal scanning circuit 1006 for transmitting video signals to the respective columns of the liquid crystal display section 1002.

In liquid crystal display section 1002, scanning lines 1010 are provided corresponding to the respective rows of unit display elements of liquid crystal display section 1002, and by selecting one scanning line, unit display elements 1001 of one row are simultaneously selected.

In this liquid crystal display section 1002, data lines 1011 are provided corresponding to the respective rows of unit display elements 1001. These data lines 1011 are arranged corresponding to the respective rows of pixels of three colors of R, G and B.

Vertical scanning circuit 1003 includes a shift register circuit 1004 for generating a signal for successively selecting scanning lines 1010 of liquid crystal display section 1002, and a buffer circuit 1005 for buffering an output signal from shift register circuit 1004 and driving scanning lines 1010 to a selected state. A vertical synchronizing signal and a horizontal synchronizing signal are applied to a shift register circuit 1004 from a display control circuit, and scanning lines 1010 are successively scanned in the vertical direction in accordance with this horizontal synchronizing signal. Upon receipt of a vertical synchronizing signal, the driving sequence returns to the leading scanning line and the scanning lines are again successively driven. With respect to the sequence in which vertical scanning circuit 1003 drives scanning lines 1010, there are an interlace system for successively driving alternate scanning lines to a selected state and a non-interlace system for successively driving scanning lines 1010 to the selected state.

Horizontal scanning circuit 1006 includes: shift register circuit 1007 for frequency-dividing the horizontal synchronizing signal to generate signals for successively selecting the data lines of liquid crystal display section 1002 through a shifting operation; a buffer circuit 1008 for buffering the output signal of shift register circuit 1007; and a switching circuit 1009, rendered conductive in accordance with a selection signal from buffer circuit 1008, for transmitting a video signal (data signal) received from an image processing unit through common image data lines 1013 to corresponding data lines 1011. Data signals corresponding to respective pixels R, G and B are applied to this common image data lines 1013 in parallel with each other.

A switching circuit 1009 also includes switching elements SW provided corresponding to respective pixels of three colors R, G and B, and transmits data signals to data lines 1011 provided corresponding to the pixels of three colors R, G and B on the corresponding columns in parallel with each other, in accordance with a selection signal outputted from buffer circuit 1008. Thus, in unit display element 1001, data corresponding to pixels of three colors of R, G and B are simultaneously written, and the liquid crystal in the corresponding position is driven in accordance with these written data.

This display element 1001 includes a capacitor for maintaining a voltage for driving the liquid crystal display and this capacitor is coupled to common electrode line 1012. This common electrode line 1012 is arranged in common to unit display elements 1001 contained in liquid crystal display section 1002.

FIG. 45 is a diagram schematically showing a construction of a pixel element corresponding to a unit color pixel of one color in unit display element 1001 shown in FIG. 44. In FIG. 45, a unit color pixel element contained in unit display element 1001 includes: a liquid crystal element 1102; a sampling TFT 1001, rendered conductive in response to a signal on scanning line 1010, for coupling liquid crystal element 1102 to data line 1011; and a voltage holding capacitance element 1103 for holding a voltage supplied to a voltage holding node 1106 through sampling TFT 1001. This voltage holding capacitance element 1103 is connected between common electrode line 1012 and voltage holding node 1106.

Liquid crystal element 1102 is connected between voltage holding node 1106 and a counter electrode 1105, and has its transmittance varied in accordance with the voltage between counter electrode 1105 and voltage holding node 1106. Thus, the luminance of a color filter arranged to this liquid crystal element 1102 is adjusted. A parasitic capacitance 1104 exists to this liquid crystal element 1102. Now, a description will be briefly given of the operation of unit color pixel elements shown in FIG. 45.

When sampling TFT 1101 is set to an on-state by a signal on scanning line 1010, a data signal, applied to signal line 1011 through common image data line 1013 shown in FIG. 44, is transmitted to voltage holding node 1106 through this sampling TFT 1101. In accordance with a voltage transmitted to this voltage holding node 1106, charges are accumulated in voltage holding capacitance element 1103 and parasitic capacitance 1104.

In the case of the so-called line sequential driving system, unit pixels 1001 of one row, connected to this scanning line 1010, are successively selected in accordance with an output signal of horizontal scanning circuit 1006 shown in FIG. 44, so that data signals are written into the respective selected unit pixels. Upon completion of writing of data signals to unit pixels in one scanning line 1010, vertical scanning circuit 1003, shown in FIG. 44, drives scanning line 1010 on the next row to the selected state, and a data signal writing is carried out on unit pixels on the next row.

The voltage of scanning line 1010 in the non-selected state is set to the ground voltage level or a negative voltage level so that sampling TFT 1101 connected to scanning line 1010 in the non-selected state is maintained in the off-state. Therefore, a voltage written in this voltage holding node 1106 is maintained by voltage holding capacitance element 1103 and parasitic capacitance 1104 until the next scanning by vertical scanning circuit 1003.

After vertical scanning circuit 1003 scans all rows (referred to as 1 frame) in this liquid crystal display section 1002, a positive voltage is again applied to this scanning line 1010, and sampling TFT 1101 turns conductive, so that a voltage is written in liquid crystal element 1102 and voltage holding capacitance element 1103 from the corresponding data signal line 1011 through sampling TFT 1101. Therefore, each unit display element has a holding voltage written successively at every frame.

Since liquid crystal element 1102 degrades in characteristics when a dc (direct current) voltage is applied thereto, an ac (altering current) driving is carried out on liquid crystal element 1102. In other words, writing and voltage holding of each unit color pixel are carried out by writing a voltage of a positive polarity and a voltage of a negative polarity relative to a voltage in counter electrode 1105 in data signal line 1011 at every frame alternately.

Generally, this frame frequency is set to 60 Hertz, and a voltage of an inverted polarity of a positive and a negative polarity is applied to voltage holding node 1106 alternately, so that the liquid crystal driving frequency is set to ½ times the frame frequency, and normally set to 30 Hertz.

The voltage difference between the voltage written and held in voltage holding node 1106 and the voltage of the counter electrode 1105 is averaged over time, and a voltage Vrms effectively applied to liquid crystal element 1102 is determined. In accordance with the effective voltage Vrms, the orienting state of liquid crystal element 1102 is determined so that the light transmittance of the liquid crystal element is controlled and the display state is determined.

In the case of a liquid crystal driving frequency of 30 Hertz, noise referred to as flicker appears on the display screen, resulting in degradation in displayed image quality. In order to reduce such flicker, conventionally, a system for suppressing flicker by alternately inverting the polarity of a liquid crystal driving voltage for pixels adjacent to each other longitudinally as well as laterally has been used.

In this liquid crystal display device, when a data signal is written in one unit display element, this written voltage needs to be maintained by liquid crystal display element 1102 and holding capacitance element 1103 until the next writing is again carried out, that is, for one frame period. The voltage of this voltage holding node 1106 tends to lower due to the finite resistivity of liquid display element 1102 and leakage current in sampling TFT 1101 and elsewhere.

As illustrated in FIG. 46, in the case of an operation with a normal frame period of 60 Hertz (Hz), since each unit pixel element has the holing voltage rewritten every frame period PF (=1/60 second), there is only a slight drop in voltage of the pixel node (voltage holding node), resulting in a small variation in the reflectance (luminance) in the pixel liquid crystal element. Therefore, it is possible to sufficiently suppress degradation in the display quality such as flicker and reduction in contrast. Here, in FIG. 46, the axis abscissa represents time and the ordinate represents reflectance (luminance) of the unit color pixel element.

In the liquid crystal display device, most of currents are consumed for charging and discharging a capacitance at a crossing of the scanning line and data signal line and the capacitance of a liquid crystal element between the interconnection line (scanning lines and data signal lines) and the counter electrode formed on the entire surface of the opposing substrate, every time of selecting sampling TFT 1101. Vertical scanning circuit 1003 is operated with frequency of the frame frequency multiplied by the number of scanning signal lines, and horizontal scanning circuit 1006 is operated with the frequency of the frame frequency times the number of scanning signal line times the number of data signal lines. Therefore, the capacitance between the interconnection lines and the capacitance between the interconnection lines and the counter electrodes are charged and discharged at the operation frequencies of these vertical scanning circuit 1003 and horizontal scanning circuit 1006, with the result that the power consumption becomes greater.

In order to reduce this power consumption, it is considered to be advantageously effective to reduce the operation frequencies of these vertical scanning circuit 1003 and the horizontal scanning circuit 1006 or to intermittently operate these scanning circuits 1003 and 1006.

As illustrated in FIG. 47, when the operation frequencies of horizontal and vertical scanning circuits 1003 and 1006 are so decreased as to carry out a writing on each unit color pixel at a frequency Pfr, pixel node (voltage holding node) 1106 causes an extremely great voltage drop, causing a great variation in reflectance (luminance). Here, in FIG. 47 also, the abscissa represents time and the ordinate represents reflectance (luminance) of the unit color pixel element. The reflectance is in proportion to the stored voltage in the pixel node. When a display is made based upon the writing at such a low speed (low frequency), the voltage in pixel node 1106 varies greatly to greatly vary the reflectance (luminance), and such voltage drop is observed as flicker on the display screen, causing degradation in display image quality. Moreover, the average voltage to be applied to this liquid crystal element is lowered, failing to provide good contrast as well as causing a decrease in display response speed due to the low speed rewriting. Thus, problems relating to display quality arise.

Japanese Patent Laying-Open No. 9-258168(1997) proposed a method for reducing the problem of degradation in display quality due to a reduction in the operation frequency.

FIG. 48 is a diagram schematically showing a construction of one pixel in a conventional liquid crystal display unit. In FIG. 48, a display pixel includes: a sampling TFT 1131 selectively rendered conductive in accordance with a signal Gm on scanning line 1010 and transmitting a data signal Di on data signal line 1011 to an internal node 1133 when made conductive; a voltage holding capacitance element 1132 connected between internal node 1133 and common electrode line 1121; a pixel driving TFT 1134 selectively made conductive in response to the voltage of internal node 1133 to electrically connect a common electrode line 1121 and a transparent electrode 1135 when made conductive; and a counter electrode 1136 for receiving a driving voltage Vcnt from counter electrode driving circuit 1122.

Display elements, shown in FIG. 48, are arranged in row and column directions in a matrix of rows and columns. Common electrode line 1121, which is commonly connected to all the display pixels contained in this display section, receives a common electrode voltage Vcom from a common electrode driving circuit 1120.

A counter electrode 1136 is formed on the entire face on an opposing substrate commonly to display pixels formed in a display element panel section. Polarizing plates are provided on the outsides of both transparent electrode 1135 and the counter substrate, and a back light is provided on one of these sides. The display pixels shown in FIG. 48 are a single color display pixels, and the display pixels shown in FIG. 48 are arranged corresponding to the respective three colors of R, G and B.

Referring to a signal waveform diagram shown in FIG. 49, a description will be given of the operation sequence of display pixels shown in FIG. 48. With respect to a scanning line selected by the scanning line selection circuit, when a voltage that is not less than a threshold voltage of sampling TFT 1131 is transmitted on scanning line 1010, this scanning line 1010 is selected and a row of pixels connected to this scanning line 1010 are simultaneously selected. In the point sequential system, a data signal Di is successively transmitted onto data signal line 1011 from a data writing circuit, while in the line sequential system, respective data signals are transmitted to display pixels connected to this scanning line 1010 simultaneously.

When a data signal Di on data signal line 1011 charges voltage holding capacitance element 1132 through sampling TFT 1131, voltage Vmem of internal node 1133 changes in response to written data signal Di. FIG. 49 shows a case in which a writing data voltage of a logical high (H) level is first transmitted at the time of sampling. When the voltage level of internal node 1133 goes to the logical H level, the corresponding pixel driving TFT 1134 turns conductive to connect transparent electrode 1135 to common electrode line 1121, and accordingly, the voltage Vdp of this transparent electrode 1135 is made equal to the voltage Vcom on common electrode line 1121.

The counter electrode voltage Vcnt supplied from counter electrode driving circuit 1122 to counter electrode line 1136 changes in polarity every sampling period (polarities of signal voltages are inverted in adjacent rows so as to suppress the generation of flicker). In accordance with this counter electrode voltage Vcnt, the voltage Vlcd between transparent electrode 1135 and counter electrode 1136 is changed in accordance with this counter electrode voltage Vcnt so that the orienting state of liquid crystal is changed to turn on-state.

When the sampling voltage Vmem is at a logical low (L) level, pixel driving TFT 1134 is in a non-conductive state so that transparent electrode 1135 serving as a display electrode and common electrode line 1121 are disconnected from each other. Thus, since the voltage (Liquid crystal driving voltage Vcnt) on this counter electrode 1136 is not applied to the liquid crystal, so that the voltage between electrodes in liquid crystal is at L level, and the liquid crystal maintains the non-conductive state.

Therefore, in the construction of the display pixels shown in FIG. 48, data signal Di applied to the voltage holding capacitance element is utilized as a signal voltage for controlling the display state. The charges, once accumulated in the voltage holding capacitance element 1132, gradually decrease in amount due to leak currents of sampling TFT 1131 and sampling capacitor (voltage holding capacitance element) 1132 during a period (one frame period) until the corresponding scanning line 1010 will be next selected. However, until the voltage of internal node 1133 has dropped below a threshold voltage of pixel driving TFT 1134, pixel driving TFT 1134 maintains the conductive state so that transparent electrode 1135 and common electrode 1121 are electrically connected, resulting in no change in the display state.

In accordance with the construction shown in FIG. 48, scanning line 1010 and data signal line 1011 need to be driven only when the display contents are rewritten. When the display state is not required to change, the display state is maintained by only applying the liquid crystal driving voltage (Vcnt) between common electrode line 1121 and counter electrode 1136. Thus, it is possible to eliminate the necessity of driving scanning lines and data signal lines in maintaining the display contents, and consequently to possibly reduce the power consumption.

In the construction of the display pixels shown in FIG. 48, the data signal (sampling voltage) Vmem gradually decreases due to insulator leak currents in pixel driving TFT 1134 and voltage holding capacitance element 1132, and an off-leak current of sampling TFT 1131. When this voltage level of internal node 1133 lowers to cause pixel driving TFT 1134 to turn off-state, the display state is changed. Therefore, when no change is made in the display state, it is necessary to restore (refresh) the sampling voltage periodically.

FIG. 50 shows an example of a construction of a conventional display system. In FIG. 50, this display system includes: a processor (CPU) 1200 for controlling the display of images, an external memory 1202 for storing image data from an image signal processing unit, not shown, and for successively outputting image data therefrom under control of processor 1200; and a display device 1204 for displaying images in accordance with the image data from external memory 1202.

Display device 1204 has a display panel constituted by display pixels shown in FIG. 48. External memory 1202 is constituted by, for example, a static random access memory (SRAM) or a video memory, and stores image data for this display device 1204. When the display state of display device 1204 is not changed, image data used for refreshing is stored in this external memory 1202. Therefore, when the sampling voltage (holding voltage) Vmem of each display pixel is refreshed in display device 1204, it is necessary to read image data stored in external memory 1202 and to supply the read out refreshing data to display device 1204. When external memory 1202 is constituted by an SRAM, the cost of the external memory is comparatively high. Since a pixel data signal is transmitted between external memory 1202 and display device 1204 upon refreshing, power is consumed in the wiring between external memory 1202 and display device 1204 and in external memory 1202, resulting in a problem of increased power consumption for refreshing.

SUMMARY OF THE INVENTION

It is an object of the present invention to provide a display device that can architect a display system with sufficiently reduced power consumption without causing any degradation in display quality.

Another object of the present invention is to provide a display device that can reduce the cost and size of a display system.

Still another object of the present invention is to provide a display device with low current consumption that can maintain display images stably over a long time.

A display device in accordance with the present invention includes: a plurality of pixel elements arranged in rows and columns; a plurality of scanning lines, arranged corresponding to respective rows, each transmitting a selection signal to pixel elements on a corresponding row; a plurality of data lines, arranged corresponding to respective columns of pixel elements, each transmitting a data signal to pixel elements on a corresponding column; a plurality of selection transistors, arranged corresponding to the respective pixel elements, for transmitting data signal on a corresponding data line to a corresponding pixel element in response to a signal on a corresponding scanning line; holding capacitance elements, arranged corresponding to the respective selection transistors, each for holding a voltage to be applied to the corresponding pixel element; and refresh circuitry for reading out a holding voltage of the holding capacitance element in response to a refresh instruction and for refreshing the holding voltage of the holding capacitance element in accordance with the read out holding voltage signal.

In this arrangement, a voltage held by the voltage holding capacitance element (sampling capacitor) is read out inside the display device, and the holding voltage of the voltage holding capacitance element is restored (recovered) in accordance with the voltage read out. Thus, it becomes possible to refresh the holding voltage accurately inside the display device, and consequently to reduce the power consumption and the system size without the necessity of externally arranging a refreshing memory.

Moreover, when the same construction as a refresh control circuit used in a normal DRAM (Dynamic•Random•Access•Memory) is utilized, it becomes possible to achieve a refresh circuit with high reliability without the necessity of newly providing a complex circuit construction.

Furthermore, with respect to the display elements, any of liquid crystal elements, electro-luminescence elements and pixel elements can be employed to be subject to a precise refreshing of the holding voltage.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
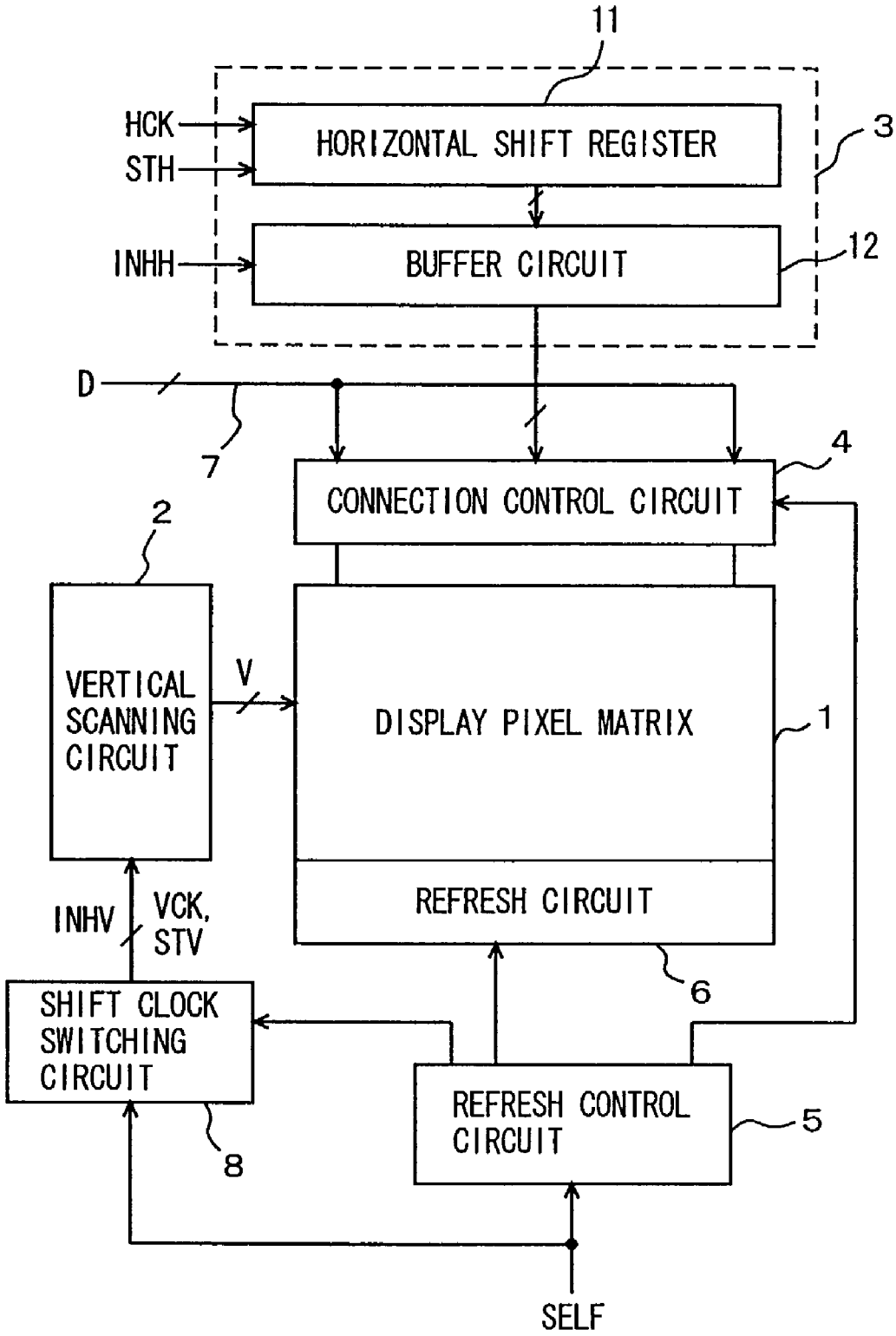
FIG. 1 is a diagram schematically showing the entire construction of a display device in accordance with the present invention.

FIG. 1 is a diagram that schematically shows the entire construction of a display device in accordance with a first embodiment of the present invention. In FIG. 1, this display device includes: a display pixel matrix 1 including a plurality of pixel elements arranged in rows and columns; a vertical scanning circuit 2 for sequentially selecting a row of display pixel matrix 1; a horizontal scanning circuit 3 for generating a signal for sequentially selecting a column of display pixel matrix 1; a connection control circuit 4 for sequentially connecting a signal line of image data bus (common image data lines) 7 for transmitting image data D to a column of display pixel matrix 1 in accordance with an output signal of horizontal scanning circuit 3; a refresh circuit 6 for refreshing a holding voltage of each display pixel of display pixel matrix 1 when activated; and a refresh control circuit 5 for controlling the operations of refresh circuit 6, connection control circuit 4 and vertical scanning circuit 2 in accordance with a refresh instruction signal SELF.

Horizontal scanning circuit 3 includes a horizontal shift register 11 for carrying out a shifting operation in accordance with horizontal clock signal HCK, in response to a horizontal scanning start instruction signal STH, and a buffer circuit 12 receiving each output signal of this horizontal shift register 11 and driving, after the selected column enters a non-selected state, the next selected column to a selected state, in accordance with a multi-selection inhibiting signal INHH.

Horizontal shift register 11 carries out the shifting operation in accordance with a horizontal shift clock signal HCK. Therefore, there is a period in which adjacent output nodes simultaneously attain a selected state of The ligical H level. Buffer circuit 12 inhibits the adjacent output nodes from simultaneously attaining the logical H level when the selected column is changed in the shifting operation, so as to inhibit multi-selection of columns in display pixel matrix 1. Horizontal scanning start instruction signal STH is generated every horizontal scanning period, and this horizontal scanning start instruction signal STH is shifted though horizontal scanning shift register 11 so that a column selection signal is generated and scanning is carried out from the leading column in each selected row.

In a normal operation mode, connection control circuit 4 sequentially selects image data D on image data bus (common image data line) 7 in accordance with a column selection signal of buffer circuit 12 for transmission onto the corresponding selected column of display pixel matrix 1. In contrast, in a refresh mode, this connection control circuit 4 is set to the non-conductive state so as to isolate image data but 7 from display pixel matrix 1.

Refresh control circuit 5 activates refresh circuit 6 upon activation of refresh instruction signal SELF, and executes a refreshing of the holding voltage of each display pixel element of display pixel matrix 1. In a refresh mode, refresh control circuit 5 generates various dock signals required for the shifting operation for vertical scanning circuit 2. These signals used for causing vertical scanning circuit 2 to carry out a vertical scanning operation in refreshing may be externally applied in the refreshing mode as well.

In accordance with refresh instruction signal SELF in an activated state, the shift clock switching circuit 8 applies a shift clock signal from refresh control circuit 5 to vertical scanning circuit 2 in place of the shift clock signal externally applied.

In the display device shown in FIG. 1, a holding voltage of each pixel element in display pixel matrix 1 is refreshed by refresh circuit 6 so that it is not necessary to newly read out refreshing data stored in an externally provided memory for the refreshing and to write the refreshing data to display pixel matrix 1. Thus, it is possible to reduce the power consumption, since an internal operation is simply carried out. Moreover, since the holding voltage is refreshed inside the display device, the holding voltage is maintained therein for a long time when no display image is changed, thereby making it possible to prevent degradation in display image quality.

Figure 2:
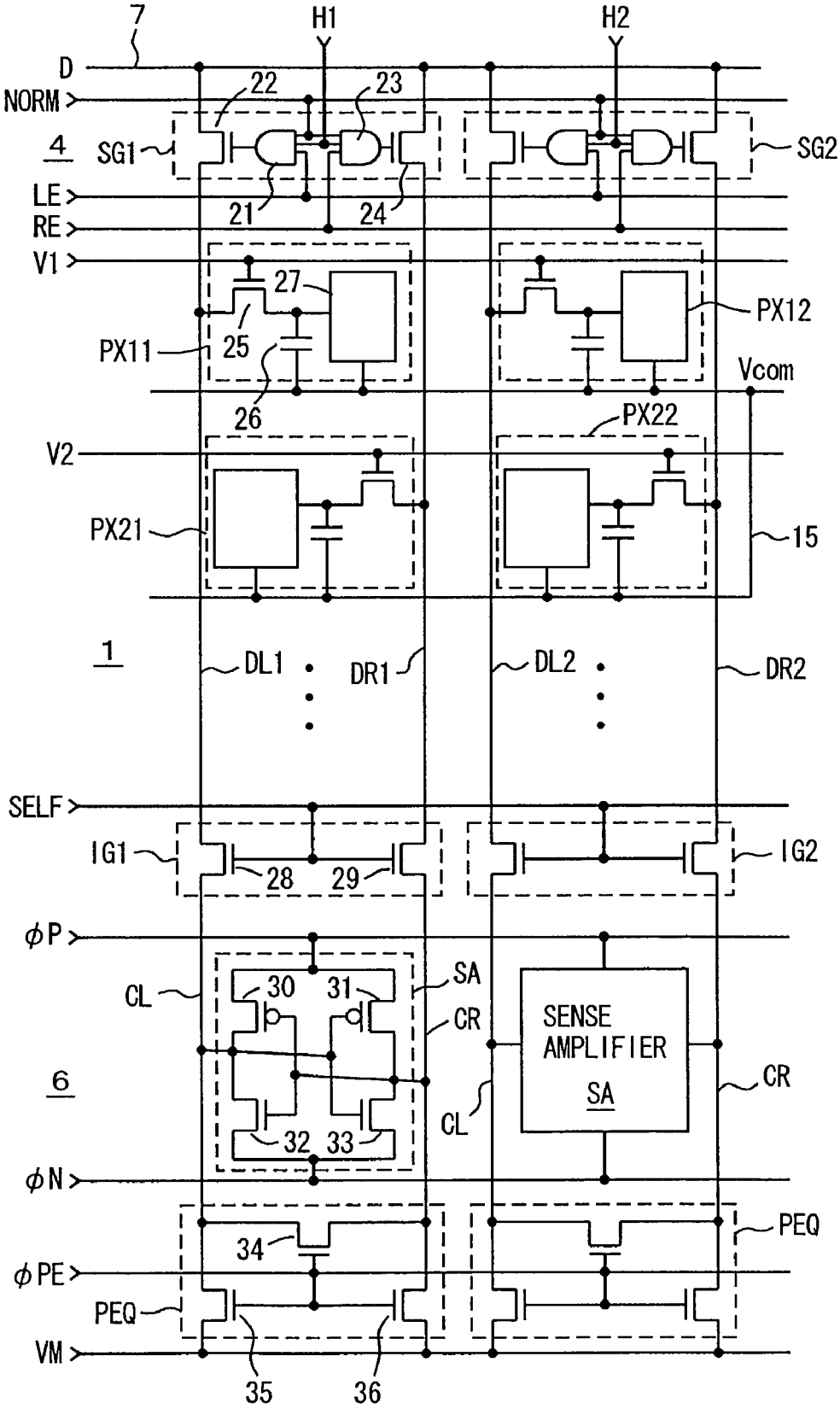
FIG. 2 is a diagram schematically showing a main part of a display device in accordance with a first embodiment of the present invention.

FIG. 2 is a diagram that shows the constructions of display pixel matrix 1 and refresh circuit 6 in FIG. 1 more specifically. In FIG. 2, in display pixel matrix 1, pixels PX are arranged in rows and columns. FIG. 2 representatively shows pixels PX11, PX12, PX21 and PX22 that are aligned in two rows and two columns. Complementary data signals DL and DR are provided corresponding to pixels PX (generically representing pixels PX 11, . . . ) that are aligned in a column direction. In other words, with respect to pixels PX 11 and PX 21, data signal lines DL1 and DR1 are provided, and with respect to pixels PX 12 and PX 22, data signal lines DL2 and DR2 are provided.

These pixels PX are alternately connected to the corresponding data lines of the paired complimentary data lines in each column for every row. Specifically, pixel PX 11 and PX 12 that are aligned on an odd row are respectively coupled to data signal lines DL1 and DL2, and pixels PX 21 and PX 22 that are aligned on an even row are respectively coupled to data signal lines DR1 and DR2. A common electrode voltage Vxom is commonly applied to these pixels PX through a common electrode line 15.

Since pixels PX have the same construction, only pixel PX 11 has its components indicated by reference numerals in FIG. 2. In FIG. 2, pixel PX (PX 11) includes: a sampling TFT 25 made conductive, in accordance with a scanning signal V1 on a scanning signal, to connect the corresponding data signal line DL1 to an internal node; a voltage holding capacitance element 26 for holding a voltage signal received through this sampling TFT 25; and a liquid crystal driving unit 27 for driving a liquid crystal element contained therein by a voltage held by voltage holding capacitance element 26.

Common electrode voltage Vcom is applied to the main electrode of voltage holding capacitance element 26 through a common electrode line.

In pixels PX 11 and PX 12 aligned on an odd row, sampling TFTs 25 take in data signals applied to data signal lines DLs (DL1, DL2) for transmission to the internal nodes. In each of pixels PX 21, PX22 aligned on an even row, sampling TFT 25 transmits the data signal transmitted to data signal line DR (DR1, DR2) to the internal node.

By placing the complementary paired data lines corresponding to the respective columns of the pixels, a written voltage (holding voltage), stored in each pixel PX, is read out to be differentially amplified for restoring the original holding voltage, so that the holding voltage of each pixel PX is refreshed.

Connection control circuit 4 includes switching circuits SG (SG1, SG2) that are provided corresponding to pairs of complementary data signal lines DL and DR. Switching circuits SG1 and SG2 are respectively supplied with column selection signals (horizontal scanning signals) H1 and H2 from buffer circuit 12 shown in FIG. 1. These switching circuits SG1 and SG2 switch connections between common image data line 7 and complementary data signal lines DL, DR in response to left enable signal LE and right enable signal RE activated in accordance with a selected scanning line. Here, in image data bus 7, image data is transferred corresponding to the respective three colors. However, since FIG. 2 shows a construction for a single color image data, image data bus 7 is hereinafter referred to as common image data line 7.

Since switching circuits SG1 and SG2 have the same construction, only switching circuit SG1 has its components indicated by reference numerals in FIG. 2, representatively.

Switching circuit SG1 includes: an AND circuit 21 for receiving a normal operation mode instruction signal NORM, left enable signal LE and column selection signal H1; a transfer gate 22 made conductive, when the output signal of AND circuit 21 is at the logical H level, to connect common image data line 7 to internal data signal line DL1; an AND circuit 23 for receiving normal operation mode instruction signal NORM, right enable signal RE and horizontal scanning signal H1; and a transfer gate 24 made conductive, when the output signal of AND circuit 23 is at the logical H level, to connect common image data line 7 to internal data signal line DR1.

Normal operation mode instruction signal NORM is activated in the normal operation mode for writing pixel data in these pixels PX, and is set in the low level (L level) in the refresh mode for carrying out refreshing. Left enable signal LE is activated when pixels on an odd row are selected (set to the high (H) level), while right enable signal RE is set to the high level when pixels on an even row are selected. Therefore, these right enable signal RE and left enable signal LE are activated in accordance with column selection signals (vertical scanning signals) V1, V2 on the scanning lines. Specifically, left enable signal LE is activated when a column selection signal V1 (V0) transmitted onto a scanning line on an even row is in an activated state. Right enable signal RE is activated when a row selection signal V2 (VE) on an odd row is in an activated state.

With this arrangement, even when the paired complementary internal data signal lines are provided corresponding to the respective pixel columns, pixel data can be written in the respective pixels in the normal operation mode accurately in accordance with vertical scanning signal (row selection signal) V and horizontal scanning signal (column selection signal) H.

Refresh circuit 6 includes: complementary signal lines CL and CR provided corresponding to complementary data signal lines DL and DR; an isolation gate IGs (IG1, IG2) made conductive, when refresh instruction signal SELF is activated, to connect complementary data signal lines DL and DR to complementary signal lines CL and CR; a sense amplifier SA, provided corresponding to each pair of complementary signal lines CL and CR, for differentially amplifying and latching signals of complementary signal lines CL and CR when activated; and a precharge/equalizing circuit PEQ, provided corresponding to each pair of complementary signal lines CL and CR, for precharging and equalizing complementary signal lines CL and CR to a predetermined pre-charge voltage VM when activated.

Isolation gates IGs (IG1, IG2) include transfer gates 28 and 29 that are rendered conductive, upon activation of refresh instruction signal SELF, to respectively connect data signal lines DL and DR to complementary signal lines CL and CR. This refresh instruction signal SELF is a signal complementary to normal operation mode instruction signal NORM. In normal operation, refresh instruction signal SELF is set in an inactive state of the logical L level to turn isolation gates IGs (IG1, IG2) into the non-conductive state so that complementary signal lines CL and CR are isolated from the corresponding complementary data signal lines DL and DR.

Sense amplifier SA includes: P channel TFTs (thin-film transistors) 30 and 31 having gates and drains cross-coupled, and receiving a sense amplifier driving signal $\phi$P through their common source; and N channel TFTs having gates and drains cross-coupled, and receiving a sense amplifier driving signal $\phi$N through their common source. TFTs 30 and 32 constitute an inverter circuit, and TFTs 31 and 33 constitute another inverter circuit, and this sense amplifier SA differentially amplifies and latches the potentials of complementary signal lines CL and CR when activated.

Precharge/equalizing circuit PEQ includes an N channel MOS transistor 34 that is rendered conductive, upon activation of precharge/equalizing signal $\phi$PE, to electrically short-circuit complementary signal lines CL and CR, and N channel TFTs 35 and 36 that are rendered conductive, upon activation of precharge/equalizing instruction signal $\phi$PE, to transmit a precharge voltage VM to complementary signal lines CL and CR. This precharge voltage VM is set to a voltage level in the middle of the logical H (high) level voltage and logical L (low) level voltage to be written in pixel PX.

Substantially the same number of pixels are connected to internal data signal lines DL and DR. Normally, the scanning lines are arranged by an even number such as 512, and the same number of pixels PX are connected to these internal data signal lines DL and DR so that the capacitances of parasitic capacitance of these internal data signal lines DL and DR are set to the same value.

Figure 3:
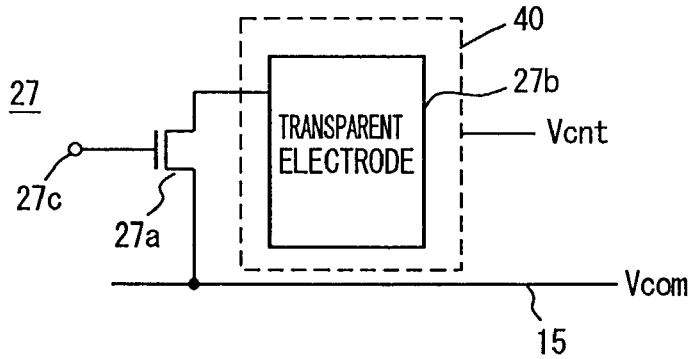
FIG. 3 is a diagram that schematically shows a construction of display pixel shown in FIG. 2.

FIG. 3 is a diagram that schematically shows the construction of a liquid crystal driving unit 27 included in pixel PX shown in FIG. 2. In FIG. 3, liquid crystal driving unit 27 includes a pixel driving transistor (TFT) 27*a* that is selectively rendered conductive in response to a voltage level of an internal pixel node 27*c* and electrically connects common electrode line 15 to a transparent electrode (pixel electrode) 27*b* when made conductive.

A counter electrode 40 is provided facing this transparent electrode 27*b*, and a liquid crystal driving voltage Vcnt is supplied to this counter electrode 40. Counter electrode 40 is provided, over the entire face of the opposing substrate of display pixel matrix 1, facing the respective pixels. In FIG. 3, the portion of counter electrode 40 provided facing transparent electrode 27*b* of one pixel is indicated by a broken line. Internal pixel node 27*c* is connected to a voltage holding electrode of voltage holding capacitance element 26.

Figure 4:
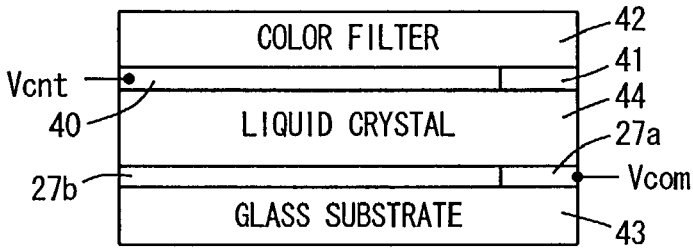
FIG. 4 is a diagram schematically showing a cross-sectional structure of the display pixel shown in FIG. 3.

FIG. 4 is a diagram that schematically shows an example of a cross-sectional structure of liquid crystal driving section 27. The construction of the liquid crystal driving section shown in FIG. 4 is a transmission type liquid crystal construction. However, another reflection type liquid crystal construction may be used. In FIG. 4, liquid crystal driving unit 27 includes a transparent electrode (ITO) 27*b* formed on a glass substrate 43, a pixel driving TFT 27*a* formed on glass substrate 43 in the same manner as transparent electrode 27*b*, liquid crystal 44 formed on transparent electrode 27*b*, a counter electrode 40 formed over the entire face of the substrate commonly to pixels on liquid crystal 44, and a color filter 42 formed on counter electrode 40. A metal layer 41 forming a black matrix for isolating adjacent pixels is formed on counter electrode 40. Color filter 42 includes respective color filters of R, G and B.

Polarizing plates are provided on an upper portion and a lower portion of liquid crystal, and in FIG. 4, these are not shown for convenience of simplification. Moreover, in the case of the transmission type liquid crystal construction, a back light is provided on the lower portion of the glass substrate.

Pixel driving voltage Vcnt is supplied to counter electrode 40, and common electrode voltage Vcom is supplied to transparent electrode 27*b* through pixel driving TFT 27*a*.

Therefore, binary pixel data signals of logical H level and logical L level are maintained in internal node 27*c*. By using sense amplifier SA shown in FIG. 2, pixel data (holding voltage) of binary levels are recovered, and the voltage thus recovered is re-written into the original pixel. Here, in the following description, "refresh" refers to the operation in which a holding voltage of pixel PX is read out to recover the original voltage level and the voltage thus recovered is re-written in the original pixel PX to restore the original pixel data.

Figure 5:
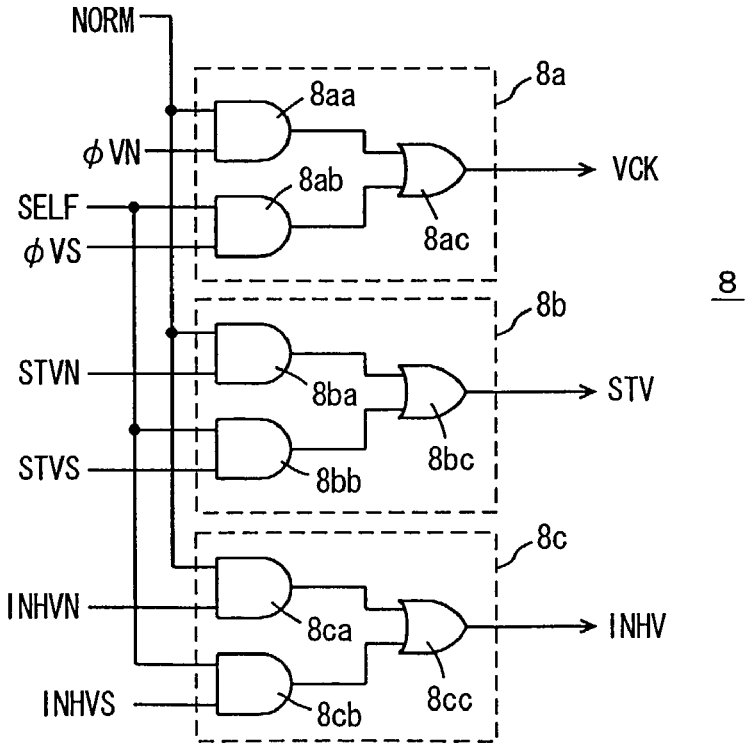
FIG. 5 is a diagram showing an example of a construction of a shift clock switching circuit shown in FIG. 1.

FIG. 5 is a diagram that shows an example of a construction of shift clock switching circuit 8 shown in FIG. 1. In FIG. 5, shift clock switching circuit 8 includes: a selection circuit 8*a* for selecting either of a normal vertical scanning signal ϕVN and a refresh vertical scanning signal ϕVS, in accordance with normal operation mode instruction signal NORM and refresh instruction signal SELF, to generate a vertical scanning clock signal VCK; a selection circuit 8*b* for selecting either of a normal vertical scanning start signal STVN and a refresh vertical scanning start signal STVS, in accordance with normal operation mode instruction signal NORM and refresh instruction signal SELF, to generate a vertical scanning start signal STV; and a selection circuit 8*c* for selecting either of a normal inhibition signal INHVN and a refresh inhibition signal INHVS, in accordance with normal operation mode instruction signal NORM and refresh instruction signal SELF, to generate an inhibition signal INIV.

Selection circuit 8*a* includes an AND circuit 8*aa* receiving normal operation mode instruction signal NORM and normal vertical scanning signal ϕVN, an AND circuit 8*ab* receiving refresh instruction signal SELF and refresh vertical scanning signal ϕVS, and an OR circuit 8*ac* receiving output signals from AND circuits 8*aa* and 8*ab* and generating vertical scanning signal VCK.

Selection circuit 8*b* includes an AND circuit 8*ba* receiving normal operation mode instruction signal NORM and normal vertical scanning start signal STVN, an AND circuit 8*bb* receiving refresh instruction signal SELF and refresh vertical scanning start signal STVS, and an OR circuit 8*bc* receiving output signals from AND circuits 8*ba* and 8*bb* to generate vertical scanning start signal STV.

Selection circuit 8*c* includes an AND circuit 8*ca* for receiving normal operation mode instruction signal NORM and normal inhibition signal INHVN, an AND circuit 8*cb* for receiving refresh instruction signal SELF and refresh inhibition signal INHVS and an OR circuit 8*cc* which receives output signals from AND circuits 8*ca* and 8*cb* to generate inhibition signal INHV.

With the construction of shift clock switching circuit 8 shown in FIG. 5, in the normal operation mode, normal operation mode instruction signal NORM is set to the logical H level, and refresh instruction signal SELF is set to the logical L level. Therefore, in accordance with normal vertical scanning signal ϕVN and normal vertical scanning start signal STVN and normal inhibition signal INHVN, vertical scanning signal VCK, vertical scanning start signal STV and inhibition signal INHV are generated.

In the refresh mode, normal operation mode instruction signal NORM is set to the logical L level, and refresh instruction signal SELF is set to the logical H level. Therefore, in accordance with refresh vertical scanning signal ϕVS and refresh vertical scanning start signal STVS and refresh inhibition signal INHVS, vertical scanning signal VCK, vertical scanning start signal STV and inhibition signal INHV are generated.

In the construction shown in FIG. 5, refresh control circuit 5 generates, in the refresh mode, refresh vertical scanning signal ϕVS, refresh vertical scanning start signal STVS and vertical refresh inhibition signal INHVS. This construction will be described later in detail.

Figure 6:
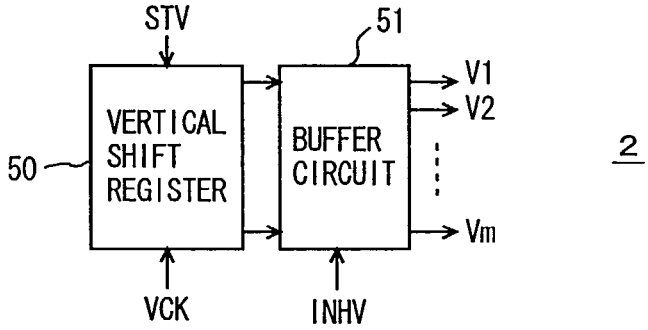
FIG. 6 is a diagram schematically showing a construction of a vertical scanning circuit shown in FIG. 1.

FIG. 6 is a diagram that schematically shows a construction of a vertical scanning circuit 2 shown in FIG. 1. In FIG. 6, vertical scanning circuit 2 includes: a vertical shift register 50 that has its selection output initialized in accordance with vertical scanning start signal STV, carries out a shifting operation in accordance with vertical scanning signal VCK to drive its outputs sequentially to the selected state; and a buffer circuit 51 including a buffer arranged corresponding to each output of vertical shift register 50, and sequentially driving vertical scanning signals (row selection signal) V1, V2, . . . , Vm to the selected state in accordance with inhibition signal INHV.

This buffer circuit 51 inhibits vertical scanning signals from being simultaneously driven to the selected state in accordance with inhibition signal INHV. Specifically, when inhibition signal INHV is at the logical H level and in the active state, all vertical scanning signals (row selection signals) are driven to the non-selected state independent of the output signal of vertical shift register 50. When this inhibition signal INHV is set to the logical L level, the vertical scanning signals (row selection signals) are driven to the selected state in accordance with the output signal of vertical shift register 50. Now, a description will be given of the operation of the display device shown in these FIGS. 1 to 6.

Figure 7:
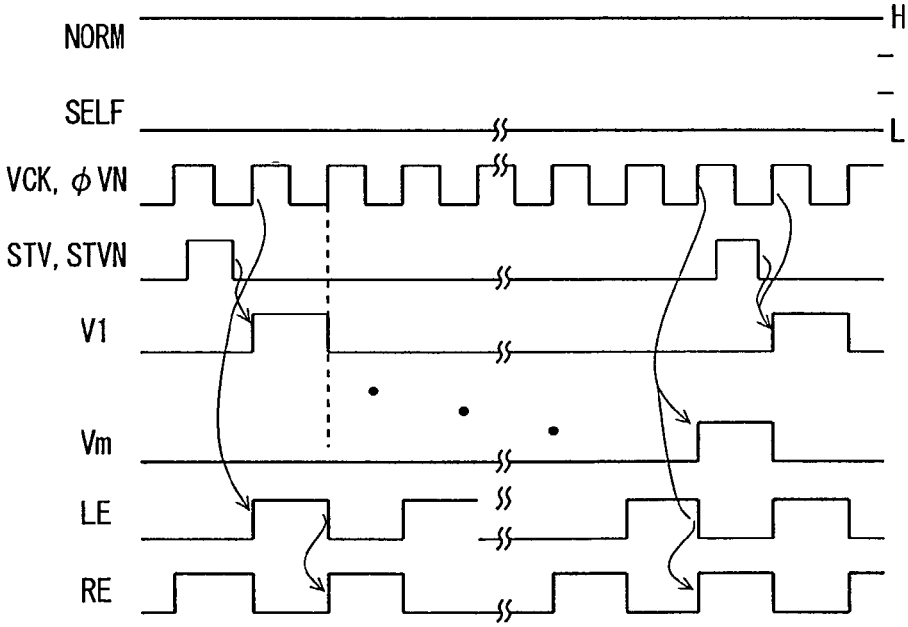
FIG. 7 is a timing chart representing the operation in a normal operation mode of the display device in accordance with the first embodiment of the present invention.

First, referring to FIG. 7, a description will be given of a writing operation of image data in the normal operation mode. In the normal operation mode, normal operation mode instruction signal NORM is set to the logical H level, while refresh instruction signal SELF is set to the logical L level. In this state, shift clock switching circuit 8, shown in FIG. 5, generates vertical scanning signal VCK, vertical scanning start signal STV and inhibition signal INHV, in accordance with externally applied vertical scanning signal ϕVN, vertical scanning start signal STVN and normal inhibition signal INHVN. In accordance with these vertical scanning start signals STV and STVN, vertical scanning start signal STV is taken in vertical shift register 50 shown in FIG. 6, and in accordance with the next vertical scanning signal VCK, the selection signal of the leading row is driven to the selected state through the shifting operation. Therefore, when this vertical scanning start signal STV rises, vertical scanning signal V1 is driven to the selected state in the next cycle. Thereafter, vertical shift register 50 carries out a shifting operation in accordance with vertical scanning signal VCK so that vertical scanning signals V1 . . . Vm are sequentially driven to the selected state. Here, FIG. 7 exemplifies a sequence in which scanning lines are successively selected in accordance with a non-interlace system. However, vertical scanning lines may be scanned in accordance with an interlace system.

When vertical scanning signal V1 is driven to the selected state, left enable signal LE is driven to the active state also. Responsively, in switching circuits SG1 and SG2 shown in FIG. 2, output signals of AND circuit 21 are sequentially driven to the logical H level in accordance with horizontal scanning signals H1, H2 . . . , so that transfer gates 22 are set to the on-state, and common image data line 7 is sequentially connected to internal data signal lines DL1, DL2, . . . on the left side, in accordance with horizontal scanning signals H1, H2, . . . . In pixels PX11, PX12, . . . , sampling TFTs 25 are sequentially set to the on-state, transfer gates 22 connected to this common image data line 7 are sequentially set to the on-state, and in accordance with image data D transmitted on image data line 7, writing operations are sequentially carried out on pixels PX11, PX21, . . . , in accordance with horizontal scanning signals (column selection signals) H1, H2, . . . .

Left enable signal LE and right enable signal RE are driven to the logical H level in accordance with selected (vertical) scanning lines. Therefore, when scanning line selection signals (row selection signal) V2 on an even row are set to the logical H level, right enable signal RE is set to the logical H level, and in accordance with horizontal signals H1, H2, . . . , in switching circuits ST1, ST2, . . . , transfer gates 24 are rendered conductive in accordance with the output signals of AND circuit 23, so that image data D transmitted through common image data line 7 is transmitted to internal data signal lines DR1, DR2 . . . on the right side. In this state, pixels PX 21, PX 22 . . . incorporate image data through sampling TFTs 25 and voltage holding capacitance element 26 holds the voltage thus incorporated.

In this normal operation mode, refresh instruction signal SELF is set to the logical L level, and isolation gates IG1, IG2, . . . , shown in FIG. 2, are all set in the non-conductive state. Since no refreshing operation is carried out, this refresh circuit 6 is in the inactive state. In this case, precharge/equalizing circuit PEQ may be configured to be kept in the activated state to maintain complementary signal lines CL and CR respectively at the intermediate voltage VM. However, by setting this precharge/equalizing circuit-PEQ also to the non-conductive state, no circuit portions that consume intermediate voltage VM exist, thereby making it possible to reduce the current consumption. Although signal lines CL and CR are maintained in a floating state, no adverse effects are exerted to the writing operation of pixel data signals to pixels PX in display pixel matrix 1, since isolation gates IG1, IG2 are all set to the non-conductive state. Alternatively, complementary signal lines CL and CR may be maintained at ground voltage level during normal operation mode.

Figure 8:
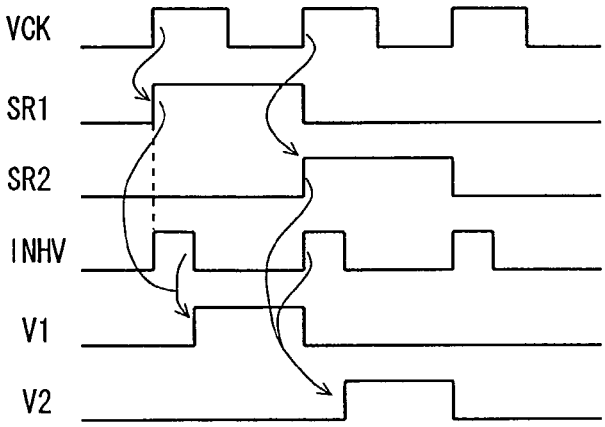
FIG. 8 is a timing chart representing the operation of the vertical scanning circuit shown in FIG. 6.

FIG. 8 is a diagram that shows the timing relationship between output signal SR of vertical shift register 50 and the output signal (vertical scanning signal) V1 . . . Vm of buffer circuit 51 in vertical scanning circuit 2 shown in FIG. 6. As illustrated in FIG. 8, vertical shift register 50 carries out a shifting operation in accordance with vertical scanning clock signal VCK. Therefore, output signals SR1, SR2 of vertical shift register 50 are maintained at the logical H level during 1 clock cycle period of vertical scanning clock signal VCK.

In response to a rise of vertical scanning clock signal VCK, inhibition signal INHV is set to the logical H level for a predetermined period, and during this period, all the output signals of buffer circuit 51 are maintained in the logical L level. Therefore, during the period of the logical H level of this inhibition signal INHV, all the vertical scanning signals V1, V2 . . . are set to the logical L level. When inhibition signal INHV falls to the logical L level, buffer circuit 51 drives vertical scanning signals V1, V2 . . . to the logical H level in accordance with the output signals of vertical shift register 50. Therefore, when this vertical scanning signal VCK rises and responsively, vertical shift register 50 carries out a shifting operation, even if there is a period in which both of output signals SR1 and SR2 of vertical shift register 50 are at the logical H level, inhibition signal INHV is in the logical H level during this time, and therefore, it becomes possible to reliably write image data in pixels on a selected row (scanning line) because of no multi-selection in vertical scanning signals V1 . . . Vm from buffer circuit 51.

Here, in the construction shown in FIG. 2, in accordance with horizontal scanning signals H1, H2 . . . , image data is sequentially written in pixels connected to a selected row in a point-sequential system. However, when not this point-sequential system, but a data writing system in which image data signals are simultaneously written in pixels on a selected row is employed, a writing timing signal is applied in place of horizontal scanning signals H1, H2 . . . , and in connection control circuit 4, all the switching circuits SGs (SG1, SG2 . . . ) are simultaneously set to the conductive state. In this case also, right enable signal RE and left enable signal LE are activated depending on whether the selected vertical scanning line is an odd-numbered row or an even-numbered row.

Figure 9:
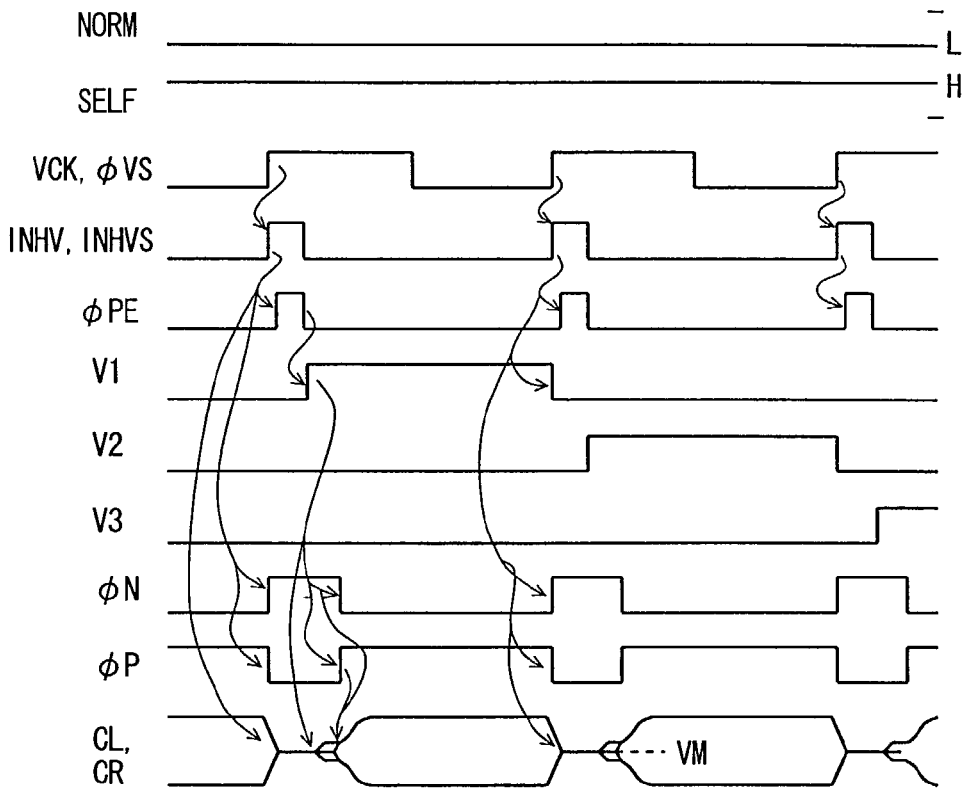
FIG. 9 is a timing chart representing the operation in a refresh mode of the display device in accordance with the fist embodiment of the present invention.

Next, referring to FIG. 9, a description will be given of the operation in the refresh mode. In the refresh mode, no rewriting operation on display image is carried out. Simply, in display pixel matrix 1, the holding voltage of each pixel PX is restored, that is, a refreshing operation is carried out. In this refresh mode, refresh instruction signal SELF is set to the logical H level, and normal operation mode instruction signal NORM is set to the logical L level. Therefore, in connection control circuit 4 in FIG. 1, all the switching circuits SG1, SG2 are set to the non-conductive state so that image data line 7 is isolated from display pixel matrix 1. In accordance with refresh instruction signal SELF, isolation gates IGs (IG1, IG2 . . . ) shown in FIG. 2 are set to the conductive state so that complementary signal lines CL and CR are connected to the corresponding internal data signal lines DL and DR (DL1, DR1 . . . ). As illustrated in FIG. 6, shift clock switching circuit 8 generates vertical scanning signal VCK, vertical scanning start signal STV and inhibition signal INHV, in accordance with refresh scanning signal ϕVS, refresh scanning start signal STVS and refresh inhibition signal INHVS that are internally generated.

In this refresh mode, in accordance with inhibition signal INHV, first, precharge instruction signal ϕPE is driven to the logical H level in a one-shot pulse form. Accordingly, TFTs 34–36 are rendered conductive in precharge/equalizing circuit PEQ shown in FIG. 2 so that the corresponding signal lines CL and CR are precharged and equalized to the intermediate voltage VM level. In accordance with this inhibition signal INHV, sense amplifier driving signals ϕP and ϕN are also driven to the logical L level and the logical H level, respectively, thereby making sense amplifier SA inactive. Thus, internal data signal lines DL and DR are precharged and equalized to the intermediate VM level through complementary signal lines CL and CR.

Then, after completion of this precharging operation, vertical scanning signal V(V1) from vertical scanning circuit 2 is driven to the selected state, and in accordance with this vertical scanning signal V1, sampling TFTs 25 of pixels PX (PX11, PX12 . . . ) in one row are rendered conductive so that a voltage held in voltage holding capacitance element 26 in each pixel PX is transmitted to the corresponding data signal line DL. Accordingly, the voltage level of signal line CL is varied from the precharge voltage VM level in response to the holding voltage level of the voltage stored in the corresponding voltage holding capacitance element. Here, there are two cases in which the voltage level stored in voltage holding capacitance element 26 is at the logical H level and at the logical L level, and the respective cases are shown in FIG. 9.

In the case when a pixel data signal of the logical H level is written in the voltage holding capacitance element 26, the voltage level of signal line CL becomes higher than the precharge voltage VM. In contrast, in the case when a pixel data signal of the logical L level is written in the voltage holding capacitance element 26, the voltage level of signal line CL lowers from the precharge voltage VM level. With respect to signal line CR, since no pixel is connected thereto, signal line CR is maintained at the precharge voltage VM level. When the voltage difference between signal lines CL and CR is sufficiently developed, sense amplifier driving signals ϕN and ϕP are respectively driven to the logical L level and the logical H level. Responsively, sense amplifier SA is activated to differentially amplify and latch the voltage difference of signal lines CL and CR.

The voltages of complementary signal lines CL and CR are transmitted to the corresponding internal data signals DL and DR (DL1, DR1, DL2, DR2 . . . ), and then again transmitted to voltage holding capacitance element 26 through each respective sampling TFT. Therefore, even if a pixel data signal of the logical H level is written and the voltage level thereof is lowered, the sensing operation of sense amplifier SA2 makes it possible to recover the original voltage level of the logical H level data for re-writing. During this refresh operation, since a restoring operation of the stored pixel data signal is simultaneously carried out on each pixel in one row, it is not necessary to sequentially drive horizontal scanning signals H1, H2, . . . . Shift clock (vertical scanning clock) signal VCK is generated at a predetermined appropriate refreshing period.

Next, when vertical scanning clock signal VCK is again set to the logical H level, inhibition signal INHV again rises to the logical H level, and accordingly sense amplifier driving signals ϕN and ϕP are again driven to the inactive state, a precharge operation is executed for a predetermined time, and signal lines CL and CR are precharged and equalized to the intermediate voltage VM level. Since isolation gates IGs (IG1, IG2 . . . ) are in the conductive state, internal data signal lines DLs (DL1, DL2) and DRs (DR1, DR2) are also precharged to the intermediate voltage VM level.

Next, when inhibition signal INHV attains the inactive state and precharge instruction signal ϕPE also attains the inactive state, the next row selection signal V2 attains the logical H level in accordance with the vertical scanning signal from the buffer circuit, and in accordance with this vertical scanning signal V2, a refresh operation is carried out on the holding voltage of pixels PX (PX 21, PX 22 . . . ) arranged corresponding to the selected row. In this case, sampling TFTs 25 of pixels PX 21, PX 22 are connected to internal data signal lines DR (DR1, DR2 . . . ) so that the holding voltages of the corresponding pixels are transmitted to internal data signal lines DR and signal lines CR. At this time, signal lines CL and data signal lines DL are held at the precharge voltage VM level so that by activating sense amplifier SA, the original written pixel data is recovered and re-written into pixels PS21, PS22 . . . .

As described above, in the refreshing operation, complementary signal lines CL and CR are connected to internal data signal lines DL and DR, and a differential amplifying operation is carried out by sense amplifier SA. Since the holding voltage of a display pixel is transmitted to only one of complementary signal lines CL and CR, the differential amplifying operation of sense amplifier SA makes it possible to accurately restore the original written voltage level for re-writing.

Here, in the refresh operation, since it is not necessary to select any column, right enable signal RE and left enable signal LE may be maintained at the logical L level.

Figure 10:
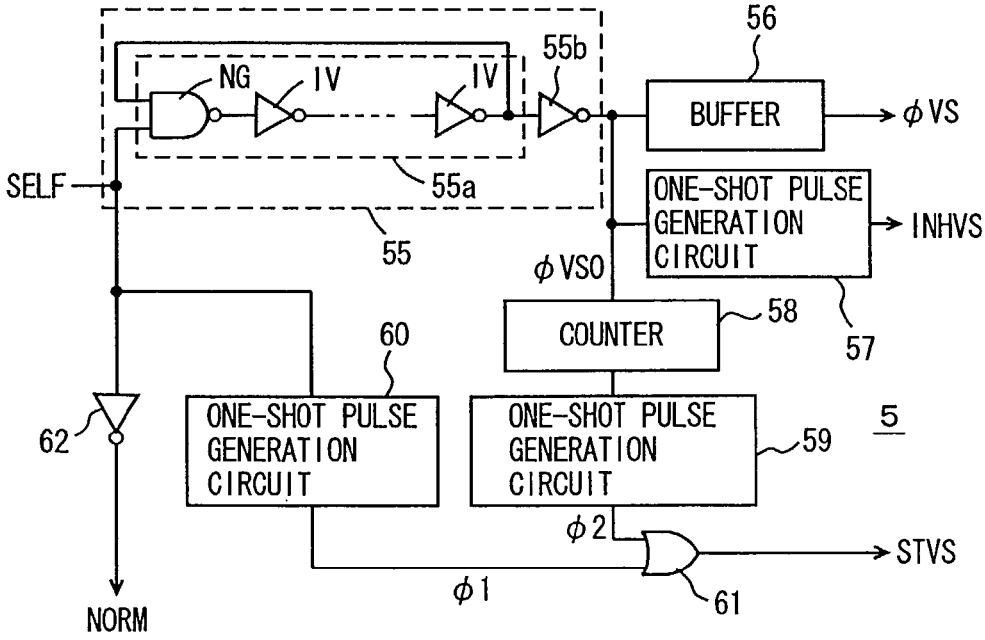
FIG. 10 is a diagram showing an example of a construction of a refresh control circuit shown in FIG. 1.

FIG. 10 is a diagram that schematically shows a construction of a part related to a vertical scanning operation in refresh control circuit 5 shown in FIG. 1. In FIG. 10, refresh control circuit 5 includes: an oscillation circuit 55 for carrying out an oscillating operation upon activation of refresh instruction signal SELF; a buffer 56 for buffering an output signal ϕVS0 of oscillation circuit 55 to generate refresh vertical scanning signal ϕVS; a one-shot pulse generation circuit 57 for generating a one-shot pulse signal in response to the rise of output signal ϕVS0 of oscillation circuit 55 to generate refresh inhibition signal INHVS; a counter 58 for counting, for example, rises of output signal ϕVS0 of oscillation circuit 55; a one-shot pulse generation circuit 59 for generating a one-shot pulse signal in response to a count-up signal of counter 58; a one-shot pulse generation circuit 60 for generating a one-shot pulse signal in response to the rise of refresh instruction signal SELF; an OR circuit 61 receiving output pulse signals of one-shot pulse generation circuits 59 and 60 and generating vertical scanning start signal STVS; and an inverter 62 for inverting refresh instruction signal SELF to generate normal operation mode instruction signal NORM.

Oscillation circuit 55 includes a ring oscillator 55*a* for carrying out an oscillating operation upon activation of refresh instruction signal SELF and an inverter 55*b* for inverting and buffering the output signal of ring oscillator 55*a* to generate output signal ϕVS0. Ring oscillator 55*a* includes a NAND circuit NG receiving refresh instruction signal SELF at a first input and cascaded inverters IV of an even number of stages. The output signal at the last stage of the inverter IV of the even number of stages is applied to a second input of NAND circuit NG.

Figure 11:
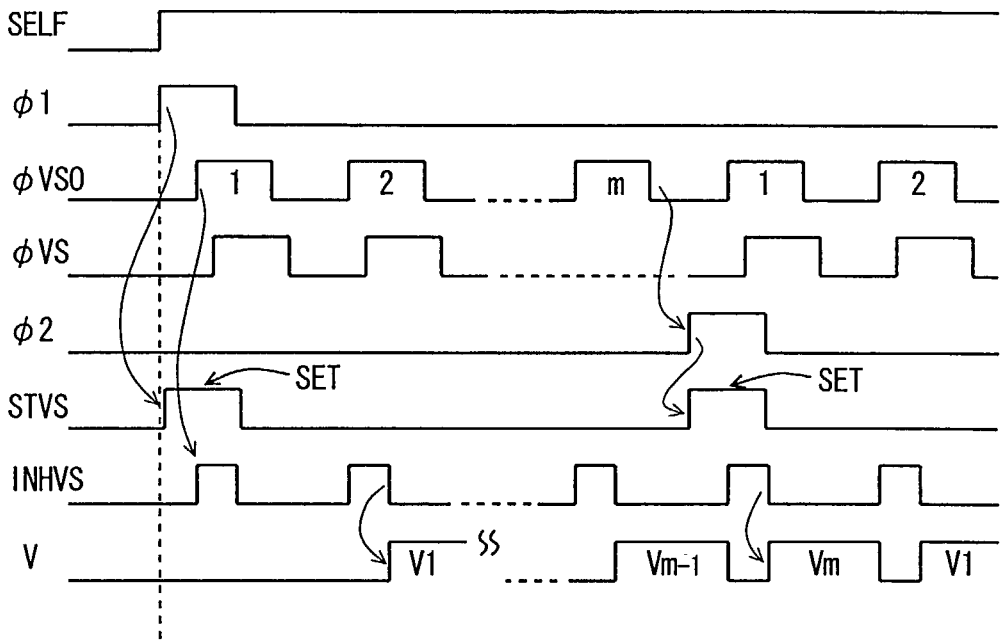
FIG. 11 is a timing chart representing the operation of the refresh control circuit shown in FIG. 10.
Figure 12:
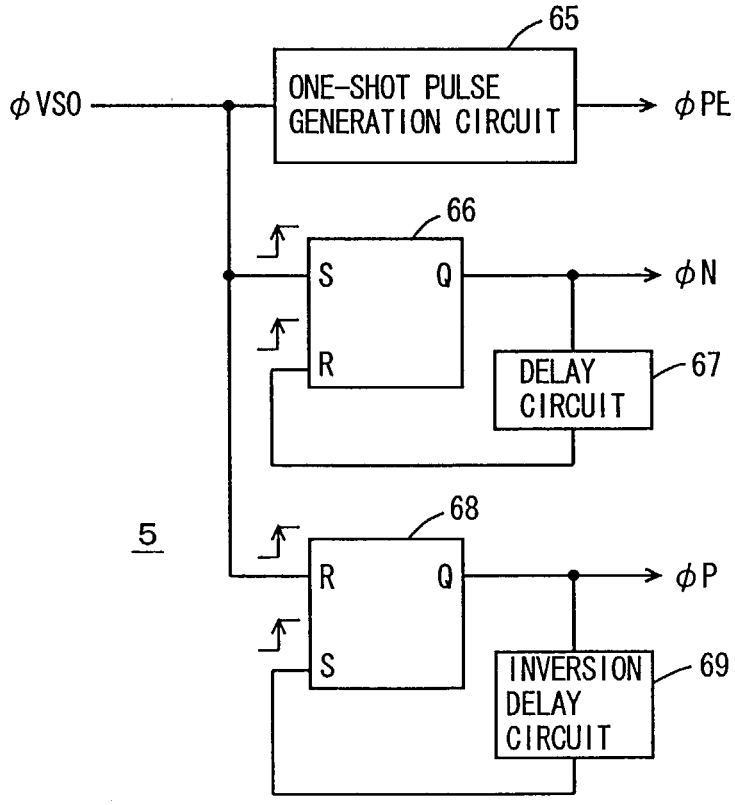
FIG. 12 is a diagram showing an example of a construction of a part for controlling a refresh circuit of the refresh control circuit shown in FIG. 1.

FIG. 11 is a timing chart representing the operation of a refresh control circuit shown in FIG. 12. Referring to FIG. 11, the description will be briefly given of the operation of refresh control circuit 5 shown in FIG. 10.

When refresh instruction signal SELF is at the logical L level, oscillation circuit 55 is in the inactive state, and has its output signal ϕVS0 set to the logical L level. Therefore, in this refresh control circuit 5, output signals ϕVS, INHVS and STVS are all maintained in the logical L level.

Moreover, the inverter 62 sets normal operation mode instruction signal NORM to the logical H level so that a writing operation of pixel data signal is carried out on pixels of display pixel matrix.

In the case when only a holding of image data is carried out, refresh instruction signal SELF is driven to the logical H level. When refresh instruction signal SELF is set to the logical H level, NAND circuit NG is operated as an inverter in ring oscillator 55*a*, and ring oscillator 55*a* starts an oscillating operation so that output signal ϕVS0 from oscillation circuit 55 varies at a predetermined cycle determined by ring oscillator 55*a*. In response to the rise of this refresh instruction signal SELF, one-shot pulse generation circuit 60 generates a one-shot pulse signal ϕ1 so that refresh vertical scanning start instruction signal STVS turns logical H level for a predetermined period. When this vertical scanning start instruction signal STVS attains the logical H level and refresh vertical scanning clock signal ϕVS from the buffer 56 then attains the logical H level, vertical scanning start signal STVS is set in vertical shift register 50 (see FIG. 6). In this state, only the initial setting (initialization) is simply performed in vertical shift register 50, and all the output signals of vertical shift register 50 are at the logical L level.

When refresh vertical scanning clock signal ϕVS from buffer 56 is again rises to the logical H level, vertical scanning register 50, shown in FIG. 6, carries out a shifting operation, and raises the output of the first stage to the logical H level. Here, one-shot pulse generation circuit 57 generates refresh inhibition signal INHVS which is set to the logical H level for a predetermined period in response to the rise of output signal ϕVS0 from oscillation circuit 55. When this refresh inhibition signal INHVS goes to the logical L level, vertical scanning signal (row selection signal) V1 from the vertical scanning circuit is driven to the logical H level.

When counter 58, which carries out a counting operation, has counted the number of vertical scanning lines, that is, m times of rises of signals ϕVS0 for m vertical scanning lines, it outputs a count-up signal. In response to the count-up signal from this counter 158, one-shot pulse generation circuit 59 generates one-shot pulse signal ϕ2, and responsively, vertical scanning start signal STVS again rises to the logical H level. Next, when the output signal ϕVS0 of oscillation circuit 55 rises to the logical H level, this refresh vertical scanning start signal STVS is set in the vertical scanning register. In this state, in the vertical scanning register, vertical scanning signal Vm for the last scanning line of one frame is driven to the logical H level.

Then, when output signal ϕVS0 of oscillation circuit 55 is again set to the logical H level, vertical scanning signal V1 for the first scanning line is again rises to the logical H level in accordance with this refresh vertical scanning start signal that has been taken in the vertical scanning register.

Therefore, one-shot pulse signal ϕ2 is generated each time counter 58 has counted output signal ϕVS0 of oscillation circuit 55 m times, so that vertical scanning start signal STVS can be generated after all the vertical scanning lines are scanned in the display pixel matrix.

Therefore, with the construction as shown in FIG. 10, it is possible to internally generate a signal related to vertical scanning in accordance with refresh instruction signal SELF.

Here, a horizontal scanning operation is not necessary in this refresh operation, and no signal related to horizontal scanning is generated in refresh control circuit 5. In this state, all signals HCK, STH and INHH related to horizontal scanning externally applied are simply fixed to the logical L level so that the operation of the horizontal scanning circuitry is stopped, thereby making it possible to reduce the power consumption.

FIG. 12 is a diagram that schematically shows the construction of a part for controlling a refresh circuit in refresh control circuit 5. In FIG. 12, refresh control circuit 5 includes: a one-shot pulse generation circuit 65 for generating a precharge instruction signal ϕPE in the form of a one-shot pulse signal of a predetermined time width in response to the rise of output signal ϕVS0 of oscillation circuit 55 (FIG. 10); an edge trigger type set/reset flip-flop 66 that is set, in response to the rise of oscillation signal ϕVS0, to generate sense amplifier driving signal ϕN at an output thereof Q; a delay circuit 67 that delays sense amplifier driving signal ϕN by a predetermined time to apply its output signal to a reset input R of edge trigger type set/reset flip-flop 66; an edge trigger type set/reset flip-flop 68 that is set, in response to the rise of oscillation signal ϕVS0, to generate sense amplifier driving signal ϕP at an output thereof Q; and an inversion delay circuit 69 that inverts and delays by a predetermined time sense amplifier driving signal ϕP for outputting. The output signal of inversion delay circuit 69 is supplied to a set input S of edge trigger type set/reset flip-flop 68.

Figure 13:
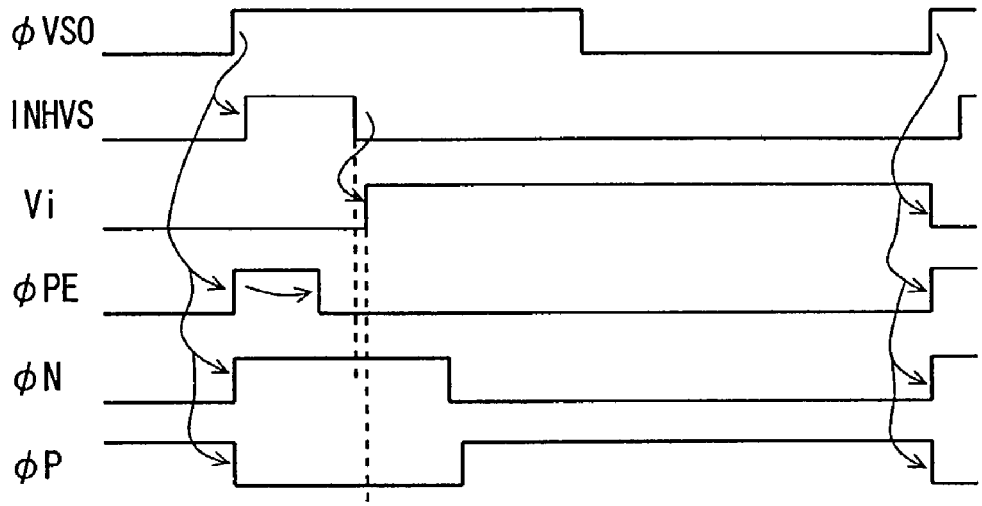
FIG. 13 is a timing chart representing the operation of the refresh control circuit shown in FIG. 12.

FIG. 13 is a timing chart that represents the operation of a refresh control circuit shown in FIG. 12. Referring to the timing chart of FIG. 13, the description will be briefly given of the operation of the refresh control circuit shown in FIG. 12 in the following.

When oscillation signal ϕVS0 rises to the logical H level, one-shot pulse generation circuit 65 generates a one-shot pulse signal so that precharge/equalize instruction signal ϕPE is set to the logical H level for a predetermined time. The time width of activation of this precharge/equalize instruction signal ϕPE is made shorter than the time width of activation of refresh inhibition signal INHVS. In other words, after completion of precharge/equalizing operation on the complementary signal lines and internal data signal lines, vertical scanning signal (row selection signal) Vi is driven to the selected state.

In response to the rise of oscillation signal ϕVS0, set/reset flip-flop 66 is set, and sense amplifier driving signal ϕN from its output Q is set to the logical H level. Moreover, edge trigger type set/reset flip-flop 68 is reset so that sense amplifier driving signal ϕP from its output Q is set to the logical L level. Thus, sense amplifiers SA shown in FIG. 2 are commonly set to the inactive state.

Normally, these sense amplifier driving signals ϕN and ϕP are maintained in the inactive state for a predetermined time after vertical scanning signal (row selection signal) Vi is driven to the active state. The inactive periods of the sense amplifier driving signals ϕN and ϕP are determined by delay circuits 67 and 69, respectively. After a lapse of the delay time of delay circuit 67, edge trigger type set/reset flip-flop 66 is reset and sense amplifier driving signal ϕN from its output Q is set to the logical L level. Responsively, N channel TFTs in sense amplifier SA are activated and the lower voltage signal lines of pairs of complementary signal lines (internal data lines) are discharged to the ground voltage level.

Moreover, after a lapse of the delay time of inversion delay circuit 69, set/reset flip-flop 68 is set, in response to the rise of the output signal of inversion delay circuit 69, to drive sense amplifier driving signal ϕP from output Q thereof to the logical H level. Thus, a P sense amplifier constituted by P channel TFTs of sense amplifiers SA shown in FIG. 2 is activated so that the higher potential signal line of each pair of complementary signal lines is driven to the logical H level (for example, to the power supply voltage level).

This operation is repeatedly executed in response to the rise of oscillation signal ϕVS0.

[Modification]

Figure 14:
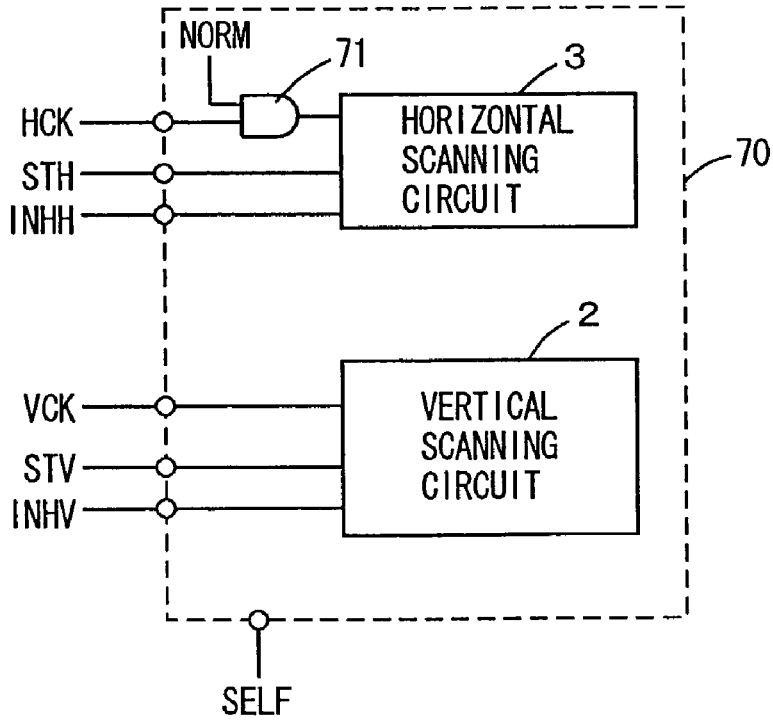
FIG. 14 is a diagram showing a modification of the first embodiment of the present invention.

FIG. 14 is a diagram that schematically shows the construction of a modification of the first embodiment in accordance with the present invention. In FIG. 14, a display device 70 includes a horizontal scanning circuit 3 and a vertical scanning circuit 2. This vertical scanning circuit 2 is supplied with a vertical scanning clock signal VCK, a vertical scanning start signal STV and an inhibition signal INHV from an external controller or processor, regardless of normal operation mode and refresh mode. Similarly, horizontal scanning circuit 3 is supplied with a horizontal scanning clock signal HCK, a horizontal scanning start signal STHH and an inhibition signal INHH from the external controller or processor.

In the refresh mode, since horizontal scanning circuit 3 need not to select horizontal scanning lines, the shifting operation of the horizontal shift registers included therein is stopped. Consequently, in horizontal scanning circuit 3, an AND circuit 71 for receiving horizontal scanning clock signal HCK and normal operation mode instruction signal NORM is provided. The output signal of this AND circuit 71 is supplied as a shift clock to the horizontal shift register.

In the external logic or processor, the vertical scanning signal and the horizontal scanning signal are correlated using a counter such that in either of the normal mode and the refresh mode, when vertical scanning clock signal VCK is generated, the next vertical scanning clock signal VCK is generated after the final pixel on the selected row is scanned. Therefore, even in the refresh mode, when vertical scanning signal VCK is generated by using an external controller or processor, signals HCK, ST1 and INHH related to horizontal scanning are also generated. In horizontal scanning circuit 3, the provision of this AND circuit 71 makes it possible to stop the shifting operation of horizontal shift registers in horizontal scanning circuit 3, and consequently to reduce the current consumption in the refreshing mode.

Since vertical scanning signal VCK, vertical scanning start signal SAV and vertical inhibition signal INHV are externally supplied to vertical scanning circuit 2, it is not necessary to arrange shift clock switching circuit 8 shown in FIG. 1. Thus, it becomes possible to reduce the area occupied by the circuitry. Moreover, in the refresh control circuit as well, it is not necessary to generate a control signal used for vertical scanning for the refreshing, and it becomes possible to eliminate the circuit construction shown in FIG. 10. In this case, it is only necessary to generate normal operation mode instruction signal NORM in accordance with refresh instruction signal SELF externally applied.

[Second Modification]

Figure 15:
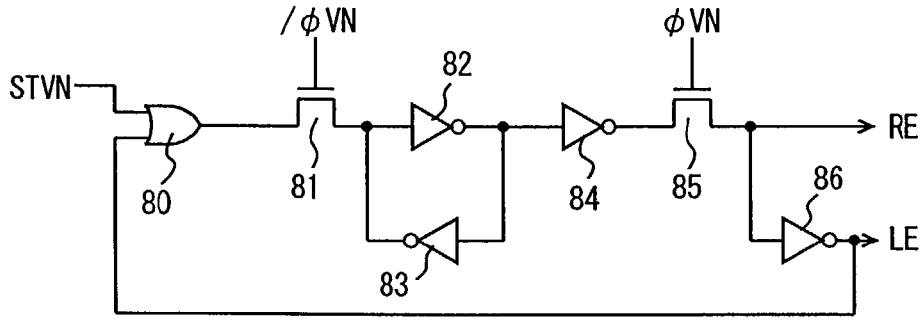
FIG. 15 is a diagram showing an example of a construction of a part for generating a right/left enable signal shown in FIG. 14.
Figure 16:
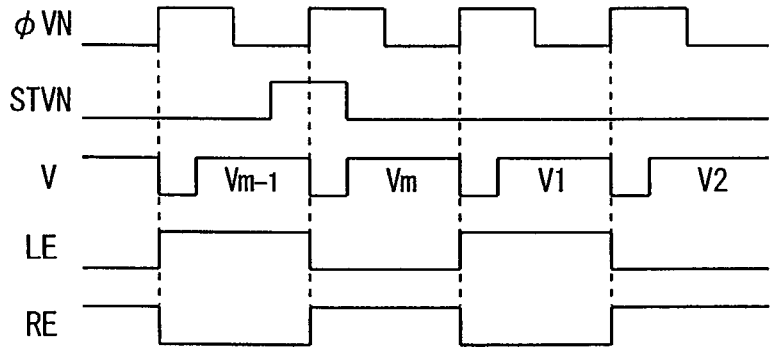
FIG. 16 is a timing chart representing the operation of a right/left enable signal generation section shown in FIG. 15.

FIG. 15 is a diagram that shows the construction of an example of a part for controlling a connection control circuit according to a second example modification of the first embodiment in accordance with the present invention. In FIG. 15, a connection control section includes: an OR circuit 80 that receives a normal vertical scanning start signal STVN and a left enable signal LE externally applied; a transfer gate 81 that is selectively rendered conductive, in accordance with an externally applied complementary normal vertical scanning clock signal/ϕVN, to transmit an output signal of OR circuit 80; an inverter 82 for inverting a signal received through the transfer gate 81; an inverter 83 for inverting and transferring an output signal of inverter 82 to an input of inverter 82; an inverter 84 for inverting the output signal of inverter 82; a transfer gate 85 that is rendered, conductive in accordance with an externally applied complementary normal vertical scanning clock signal/ϕVN, to transmit an output signal of inverter 84, for generating a right enable signal RE; and an inverter 86 for inverting the signal received from transfer gate 85 to generate left enable signal LE. Now, referring to a timing chart shown in FIG. 16, a description will be given of the operation of a connection control unit shown in FIG. 15.

Now it is supposed that scanning line Vm−1 is an odd-numbered line, a corresponding pixel element is connected to internal data signal line DL on the left side, and that right enable signal RE is set to the logical L level and left enable signal LE is set to the logical H level. When normal vertical scanning clock signal ϕVN is at the logical L level, transfer gate 85 is in the non-conductive state, while transfer gate 81 is in the conductive state. In this state, when normal scanning start signal STVN rises to the logical H level, a signal at the logical H level, transferred from OR circuit 80 through transfer gate 81, is transmitted to and latched by inverters 82 and 83.

Next, when normal vertical scanning clock signal ϕVN rises to the logical H level, transfer gate 85 is rendered conductive so that the signal at the logical H level from inverter 84 is outputted as right enable signal RE. In contrast, left enable signal LE is set to the logical L level by inverter 86. Therefore, since the last scanning line Vm is assumed to be an even-numbered scanning line, right enable signal RE is activated and image data is written in pixel elements connected to internal data signal lines DR on the right side.

When normal vertical scanning clock signal ϕVN attains the logical L level, transfer gate 81 is rendered conductive to transfer a signal at the logical L level from OR circuit 80 to inverter 82. In this state, transfer gate 85 is in the non-conductive state, causing no changes in its output signals RE and LE.

Subsequently, when normal vertical scanning clock signal ϕVN again attains the logical H level, transfer gate 85 is rendered conductive. Accordingly, a signal at the logical L level from inverter 84 is outputted as right enable signal RE, while left enable signal LE is driven to the logical H level by inverter 86. In this state, complementary vertical scanning clock signal/ϕVN is at the logical L level, and transfer gate 81 is kept in the non-conductive state. Therefore, when the first vertical scanning line V1 is selected, left enable signal LE is in the logical H level with right enable signal RE being set in logical L level. Thus, internal data signal lines can be connected to selected pixels in accordance with selected rows.

Here, in the construction shown in FIG. 15, in the case when a vertical scanning clock signal is externally applied even during the refresh mode, it is configured that the output signal of an AND circuit receiving normal operation mode instruction signal NORM and externally applied vertical scanning clock signal VCK is supplied to transfer gate 85 as in the construction shown in the foregoing FIG. 14, while the output signal of another AND circuit for receiving normal operation mode instruction signal NORM and complementary vertical scanning clock signal/VCK is supplied to transfer gate 81.

Additionally, right enable signal RE and left enable signal LE may also be supplied externally from an external processor or controller during the normal operation mode. In this case, it is possible to eliminate the circuit shown in FIG. 15.

Figure 17:
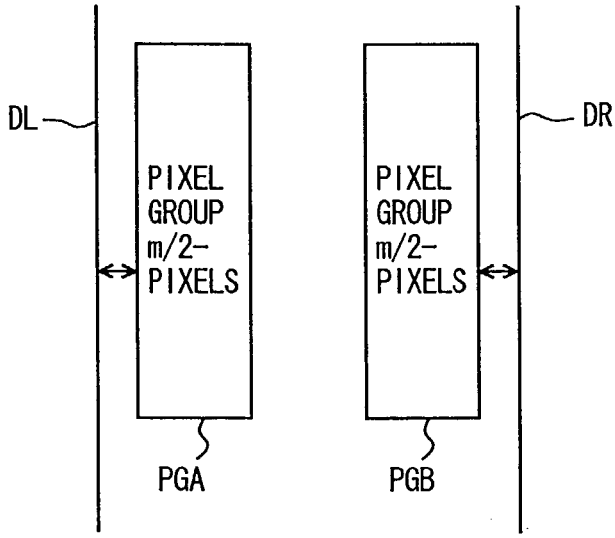
FIG. 17 is a diagram showing the construction of a division of pixel groups on one column in accordance with the first embodiment of the present invention.

Here, in the construction shown in FIG. 2, paired internal data signal lines are arranged corresponding to the respective pixel columns, and display pixel elements are connected to different data signal lines of these paired internal data signal lines on alternate rows. However, any arrangement may be used as long as substantially the same number of pixels are connected to paired data signal lines DL and DR as shown in FIG. 17. For example, upper half pixels may be connected to data signal lines DL as a pixel group PGA while lower half pixels may be connected to internal data signal lines DR as a pixel group PGB. Therefore, not limited to the construction in which pixels are alternately connected to different data signal lines on alternate rows, any arrangement in which substantially the same number of pixels are connected to the respective data signal lines of the paired data signal lines. Therefore, an arrangement in which pixels are connected to the internal data signal lines on every two rows may be employed.

As described above, in accordance with the first embodiment of the present invention, paired complementary signal lines are arranged corresponding to the respective pixel columns, and data of the respective pixels are read out on one of the paired data signal lines, and differentially amplified by sense amplifiers and then the amplified data are rewritten into the original pixels. Therefore, it is not necessary to externally re-write all pixel data signals, thereby making it possible to reduce the system scale as well as the current consumption.

With respect to pixel driving voltage Vcnt of the counter electrode in refreshing, since it is not necessary to change the display image, it is not particularly necessary to change the voltage polarity thereof.

[Second Embodiment]

Figure 18:
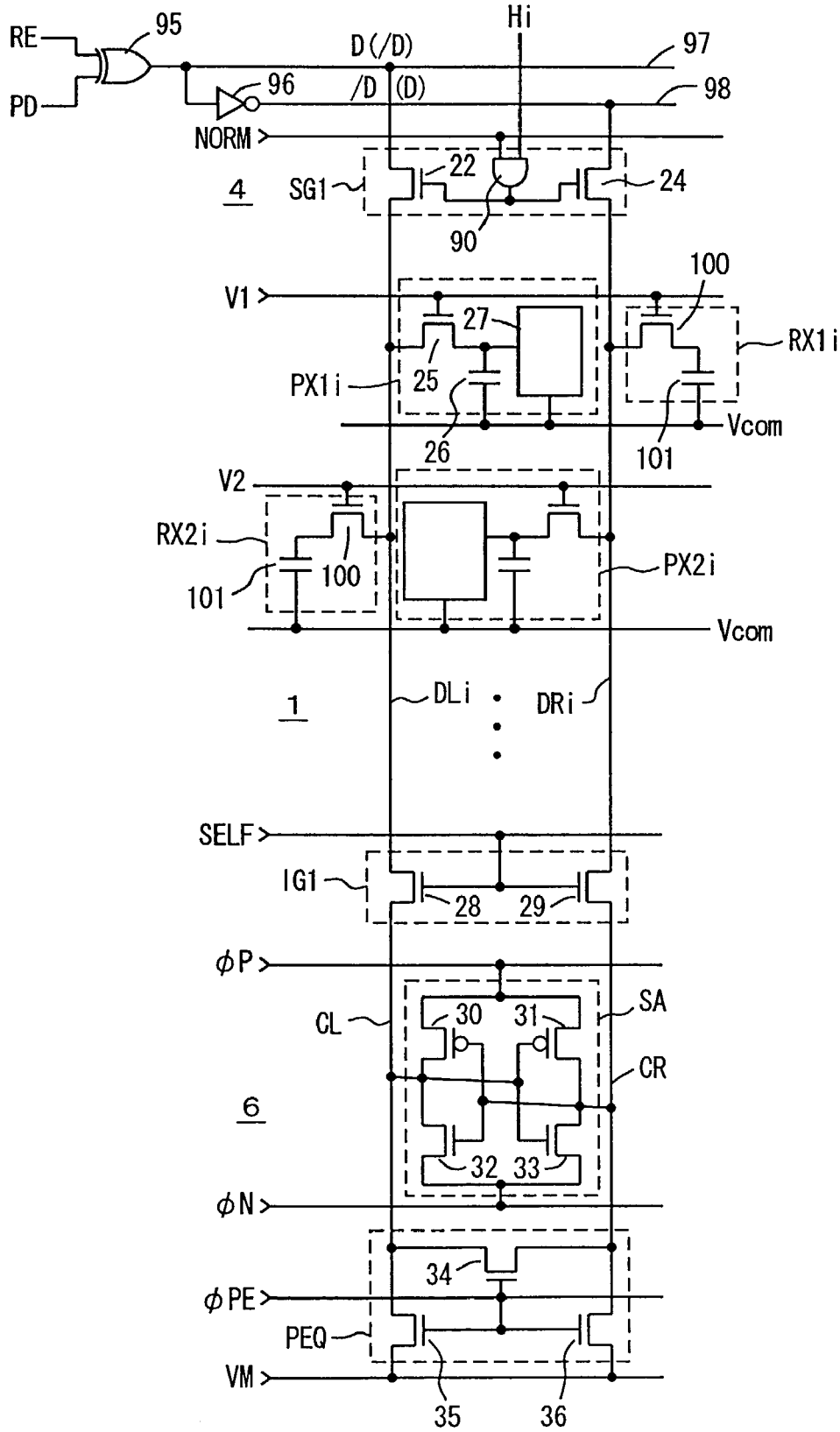
FIG. 18 is a diagram showing a construction of a main part of a display device in accordance with a second embodiment of the present invention.

FIG. 18 is a diagram that schematically shows the construction of a main part of a display device in accordance with a second embodiment of the present invention. FIG. 18 representatively shows the construction of a portion corresponding to pixels in one row. Complementary internal data signal lines DLi and DRi are arranged corresponding to pixel columns. To these complementary internal data signal lines DLi and DRi, pixels PX1*i* and PX2*i* are alternately connected on alternate rows. However, with respect to these internal data signal lines DLi and DRi, any arrangement can be used as long as the same number of pixels are connected complementary internal data lines in a pair, and it is not necessary to alternately connect pixels to data signal lines DLi and DRi on alternate rows.

A common image data bus includes complementary image data lines 97 and 98 for transferring complementary image data D and /D.

In connection control circuit 4, a switching circuit SG1 includes an AND circuit 90 receiving normal operation mode instruction signal NORM and horizontal scanning signal Hi. In accordance with the output signal of this AND circuit 90, transfer gates 22 and 24 are rendered conductive to connect internal data signal lines DLi and DRi respectively to complementary image data lines 97 and 98. The connection of internal data signal lines DLi and DRi and complementary image data lines 97 and 98 is made in the same manner with respect to the other pixel rows, and is uniquely determined.

In order to generate complementary image data signals D and /D on complementary image data lines 97 and 98, an EXOR circuit 95 for receiving right enable signal RE and pixel data signal PD and an inverter 96 for inverting an output signal from the EXOR circuit 95 are provided. EXOR circuit 95 drives image data line 97, and inverter 96 drives image data line 98.

In display pixel matrix 1, a reference cell RX is provided corresponding to each pixel PX. These reference cells RX each are connected to an internal data line arranged in a pair with an internal data line to which the corresponding pixels is connected. In FIG. 18, on the same row, reference cell RX1*i* is arranged adjacent to pixel PX1*i*, and reference cell RX2*i* is arranged adjacent to pixel PX2*i*. These reference cells RXs (RX1*i*, RX2*i*) store complementary voltage signals to holding voltages (written pixel data signals) of the corresponding pixels PX (PX1*i*, PX2*i*).

Each reference cell RX (RX1*i*, RX2*i*) includes a reference transistor 100 that is rendered conductive in response to the corresponding vertical scanning signal (row selection signal) V(V1, V2) and a reference capacitance element 101 that holds a voltage supplied through this reference transistor (TFT) 100. The other electrode node of reference capacitance element 101 is connected to the common electrode and receives a common electrode voltage Vcom.

Reference cell RX is arranged forming a pair with each respective pixel, and data of pixel PX and reference cell RX are read out on internal data signal lines DLi and DRi in a pair. Complementary pixel data signals are stored in these pixel PX and reference cell RX. Therefore, as compared to the case in which only the holding voltage of pixel PX is read out upon refreshing, it is possible to make the signal voltage difference appearing on internal data signal lines greater, and consequently to prolong the refresh cycle.

In the construction shown in FIG. 18, the other constructions are the same as those shown in FIG. 2, and therefore, the corresponding parts are indicated by the same reference numerals, and the detailed description thereof is omitted.

In the normal operation mode, normal operation mode instruction signal NORM is set to the logical H level, and switching circuit SG1 is rendered conductive, in response to horizontal scanning signal (column selection signal) Hi, to connect internal data signal lines DLi and DRi to common image data lines 97, respectively.

Now it is supposed that vertical scanning signal (row selection signal) V1 is driven to the selection state. In this case, right enable signal RE is set to the logical L level, and EXOR circuit 95 is operated as a buffer circuit, and generates internal pixel data signal D in accordance with externally applied image data signal PD. Inverter 96 inverts internal pixel data signal D and generates complementary image data signal /D. Here, since vertical scanning signal V1 is in the selected state, data signal D is supplied to pixel PX1*i* through switching circuit SG1, while complementary data signal /D is supplied to reference cell RX1*i*. Thus, complementary voltage signals are transmitted to and stored in these capacitance elements 26 and 101.

Here, when vertical scanning signal V2 is driven to the selected state, right enable signal RE is set to the logical H level so that EXOR circuit 95 serves as an inverter. Therefore, in this case, with respect to pixel data signal PD, complementary pixel data signal /D is supplied to common pixel data signal line 97, and internal pixel data signal D corresponding to the original image data signal PD is supplied to common image data line 98.

In this state, when horizontal scanning signal Hi is driven to the selected state, pixel data signals /D and D are transmitted to internal data signal lines DLi and DRi. In pixel PX2*i*, an image data signal corresponding to the original image data PD is written to the internal voltage holding capacitance element 26 through sampling TFT 25, while complementary image data signal /D is transmitted reference cell RX2*i* and stored therein.

Therefore, by changing the logic level of the original pixel data signal PD in response to the position of the selected row, pixel data signal D corresponding to the original pixel data signal PD can be always written in pixel PX (PX1*i*, PX2*i*) to set each pixel into a state corresponding to the pixel data signal.

In the refresh mode, normal operation mode instruction signal NORM is set in the logical L level and the output signal of AND circuit 90 is set to the logical L level. Thus, switching circuit SG1 is set to the non-conductive state to isolate internal data signal lines DLi and DRi from common image data lines 97 and 98. In this state, in the same manner as the first embodiment, a refreshing operation is carried out by refresh circuit 6.

Figure 19:
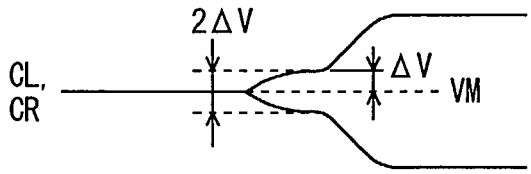
FIG. 19 is a diagram showing a data line read-out voltage at the time of refreshing in a display pixel matrix shown in FIG. 18.

Capacitance elements 26 and 101 of pixel PX and reference cell RX have the same capacitance value, and writing data are binary data of the logical H level and the logical L level. Therefore, upon refreshing, to signal lines CL and CR precharged to the intermediate voltage VM level, read-out voltages of the same value $\Delta V$ are transmitted. Simply, the signs of these read-out voltages $\Delta V$ are different. Therefore, as illustrated in FIG. 19, the voltage difference between signal lines CL and CR is $2 \cdot \Delta V$, and as compared to the construction in which pixels are connected to only complementary signal lines CL or CR through the internal data signal lines, it is possible to increase the read-out voltage equivalently, to widen the sensing margin of sense amplifier SA.

In other words, with this construction, it is possible to carry out a stable sensing operation until the voltage difference between the signal lines CL and CR attains $\Delta V$ even when the refresh interval is made longer. Even when the holding voltage level of pixel PX lowers, the voltage difference between complementary signal lines CL and R is not less than the sensing margin, sense amplifier SA carries out a stable sensing operation. Therefore, when the refresh operation is carried out within a period in which the holding voltage at the logical H level of a pixel is not less than the threshold voltage of the pixel driving TFT of liquid crystal driving section 27, the holding voltage is reliably restored without causing any flickers or the like. Therefore, it is possible to make the refresh interval sufficiently long, to reduce the number of times of refreshing per unit time, and consequently to reduce the current consumption required for refreshing to a great degree.

Here, it is shown in FIG. 18 the arrangement of a point sequential system in which pixels on a selected row are sequentially selected in accordance with the horizontal scanning signal and pixel data signals are written in the selected pixels. However, another arrangement may be used in which pixel data signals are written in pixels in one row simultaneously at one time with respect to the selected row. With such arrangement, the same effects can be provided.

[Modification]

Figure 20:
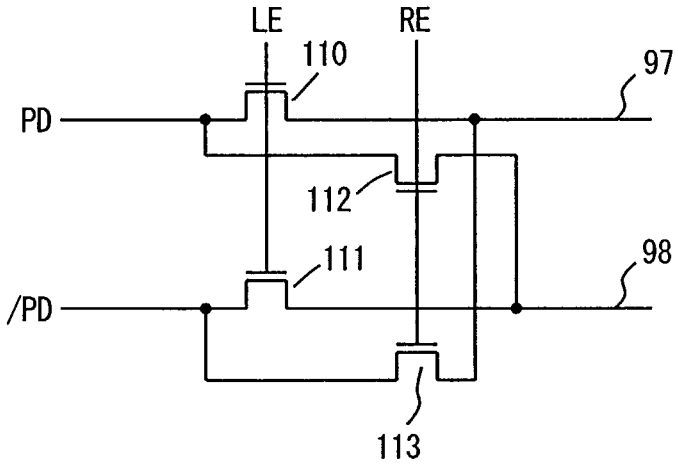
FIG. 20 is a diagram that shows a modification of the second embodiment of the present invention.

FIG. 20 is a diagram that shows a modification of the second embodiment in accordance with the present invention. FIG. 20 shows a construction of a signal switching section for transmitting internal pixel data signals PD and /PD to common image data lines 97 and 98. In FIG. 20, the switching section includes transfer gates 110 and 111 that are rendered conductive, upon activation of left enable signal LE, to respectively transmit image data signals PD and /PD to common image data lines 97 and 98, and transfer gates 112 and 113 that are rendered conductive upon activation of right enable signal RE and respectively transmit pixel data signals PD and /PD to common image data lines 98 and 97 when made conductive.

In the construction shown in FIG. 20, when right enable signal RE is set to the activated state, pixel data signal PD is transmitted to image data line 98, and complementary pixel data signal /PD is transmitted to image data line 97. Therefore, when an even row is selected, image data line 98 is connected to data signal line DR on the right side so that pixel data signal PD is transmitted to each pixel connected to the selected even row.

In contrast, when an odd row is selected, left enable signal LE turns activated state, and pixel data signals PD and /PD are transmitted to image data lines 97 and 98, respectively. During activation of this left enable signal LE, image data line 97 is connected to data signal line DL on the left side so that the pixel data signal can be transmitted to each respective pixel.

Therefore, even with the arrangement in which path switching is carried out in response to the position of a selected row, it is possible to accurately write pixel data signal PD in each pixel and to write complementary pixel data /PD in each reference cell RX.

As described above, in accordance with the second embodiment of the present invention, a reference cell for storing complementary image data signal is provided forming a pair with each pixel, and complementary pixel data signals are transmitted to the paired respective data signal lines. Thus, it is possible to make the voltage difference read out on signal lines upon refreshing sufficiently greater, and consequently to prolong the refresh interval and accordingly the refresh cycle.

[Third Embodiment]

Figure 21:
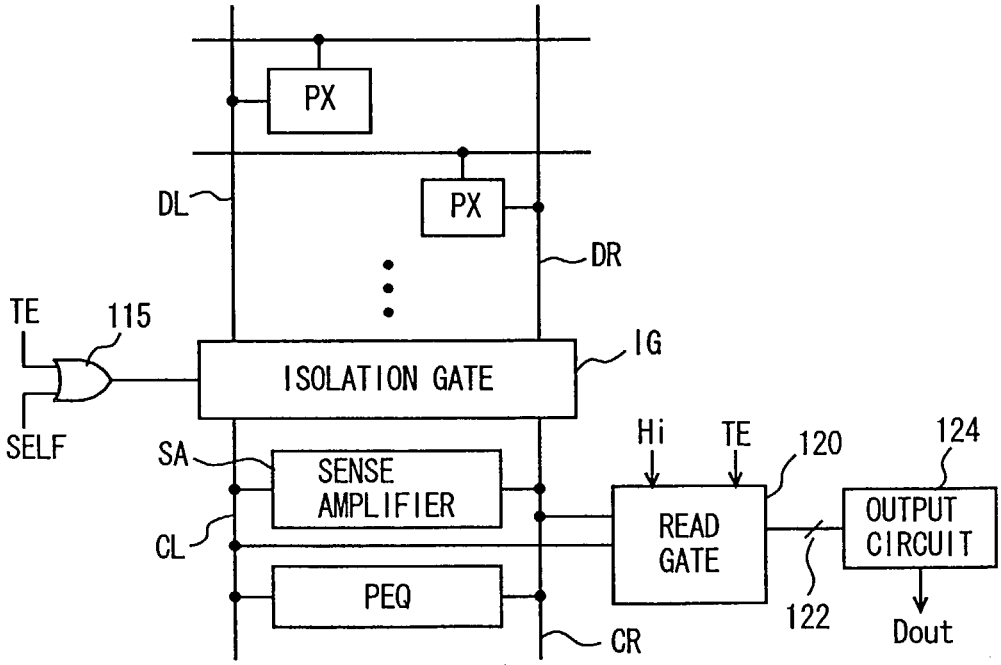
FIG. 21 is a diagram schematically showing a construction of a main part of a display device in accordance with a third embodiment of the present invention.

FIG. 21 is a diagram that schematically shows the construction of a main part of a display device in accordance with a third embodiment of the present invention. FIG. 21 representatively shows the construction of a portion corresponding to pixels in one row. In the construction shown in FIG. 21, the output signal of an OR circuit 115 receiving a test enable signal TE and refresh instruction signal SELF is applied to an isolation gate IG. In other words, this isolation gate IG is rendered conductive in the refresh mode and the test mode to couple internal data signal lines DL and DR respectively to complementary signal lines CL and CR. Sense amplifier SA and precharge/equalize circuit PEQ are provided for each pair of signal lines CL and CR.

In the third embodiment, signal lines CL and CR are further provided with a read gate 120, which is selectively activated in accordance with horizontal scanning signal Hi and test enable signal TE, and reads out, when activated, data from complementary signal lines CL and CR for transmission to a common data bus 122. Signals, transmitted from this read gate 120 through common data bus 122, are externally outputted through an output circuit 124.

Specifically, in accordance with signals of complementary signal lines CL and CR amplified by sense amplifier SA, read gate 120 is driven to read out data on pixel is internally read out on common bus 122. Data on the common bus 122 are buffered by output circuit 124 and are converted into a signal of, for example, the CMOS level, and the resultant signal is outputted as external pixel data Dout. Therefore, even when the holding voltage in pixel PX is small, for example, signal Dout in the CMOS level is externally outputted through output circuit 124. With this arrangement, it is possible to easily determine the normal/abnormal state of the operation of display pixel by using a general LSI tester.

Figure 22:
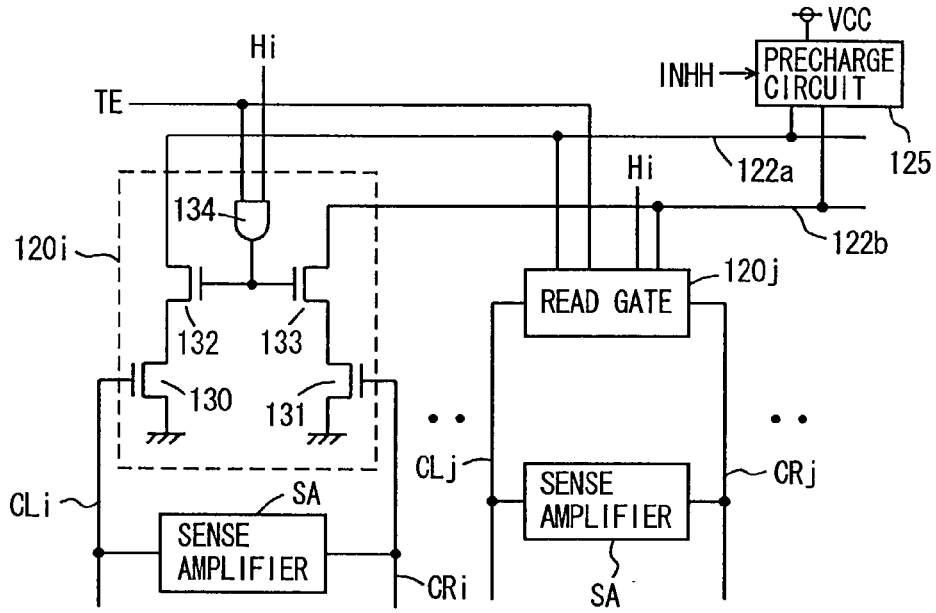
FIG. 22 is a diagram showing in detail the construction of the main part of the display device in accordance with the third embodiment of the present invention.

FIG. 22 is a diagram that shows an example of a specific construction of the read gate. Read gate 120 is provided corresponding to each pair of complementary signal lines CL and CR, and activated in accordance with horizontal scanning signal or column selection signal H during the test mode. FIG. 22 specifically shows components of read gate 120*i* arranged to complementary signal lines CLi and CRi. With respect to each pixel column, a read gate having the same construction as this read gate 120*i* is provided. FIG. 22 shows a read gate 120*j* that is arranged corresponding to signal lines CLj and CRi as a representative of read gates arranged for other columns.

In FIG. 22, read gate 120*i* includes N channel TFTs 130 and 131 having their respective gates connected to signal lines CLi and CRi, an AND circuit 134 for receiving test enable signal TE and horizontal scanning signal Hi, and N channel TFTs 132 and 133 rendered conductive, when the output signal of AND circuit 134 is at the logical H level, to connect TFTs 130 and 131 to internal common data lines 122*a* and 122*b*, respectively.

A precharge circuit 125 is arranged to a pair of common data lines 122*a* and 122*b*. This precharge circuit 125 is activated, when inhibition signal INHH is at the logical H level, to precharge common data lines 122*a* and 122*b* to power-supply voltage VCC level.

In read gate 120*i*, TFTs 130 and 131 constitute a differential gate and drive one of common data lines 122*a* and 122*b* to the logical L level (ground voltage level) in response to the voltage level of signal line CLi and CRi. In signal lines CLi and CRi, complementary signals of the amplitude of the power supply voltage level are generated by sense amplifier SA, so that the voltage level of common data lines 122*a* and 122*b* can be sufficiently changed. One of common data lines 122*a* and 122*b* precharged to the power supply VCC level by precharge circuit 125 is driven to the logical L level. Consequently, the internal pixel data is read out and the pixel signal thus read out is buffered by output circuit 124 to be converted into an external output signal of for example, the CMOS level.

When the proper or improper operation of the liquid crystal element is determined by visually observing the displaying state of liquid crystal, variation occur in the determination precision and the determining process takes a long time since the determining process is carried out by human being. In the case when a minute voltage accumulated in pixel PX is directly read out, the minute voltage needs to be read by externally providing a data reading circuit with a low capacitance, resulting in an increase in testing costs. When a holding voltage of a pixel is read out by using an external circuit having a large capacitance, the minute voltage is further reduced due to a charge transportation, making it impossible to read out the holding voltage accurately.

As illustrated in FIG. 22, data in the complementary data signal lines is read out onto common data bus 122 through read gate 120, and amplified by output circuit 124 to be externally outputted. Thus, an output signal Dout at the normal logical level can be externally outputted so that the pass/failure of display pixel can be easily determined by using a general LSI tester or the like.

Figure 23:
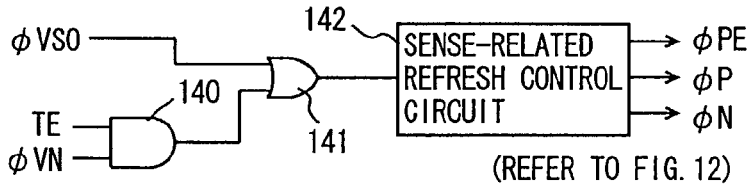
FIG. 23 is a diagram showing an example of a construction of a refresh control section in the display device in accordance with the third embodiment of the present invention.

FIG. 23 is a diagram that schematically shows a construction of a test control section. In FIG. 23, the test control section includes an AND circuit 140 receiving test enable signal TE and externally applied normal vertical scanning clock signal ϕVN, an OR circuit 141 receiving an oscillation signal ϕVS0 internally generated in a refresh control section and an output signal of AND circuit 140, and a sense-related refresh control circuit 142 for generating refresh control signals ϕPE, ϕP and ϕN in accordance with the output signal of OR circuit 141. This sense-related refresh control circuit 142, which corresponds to the construction shown in FIG. 12, generates a precharge/equalize instruction signal ϕPE and sense amplifier driving signals ϕP and ϕN.

In the test operation, the pixel selection is carried out in accordance with externally applied vertical scanning clock signal and horizontal scanning clock signal. When the pixel selection is internally carried out by using a refresh control circuit, the position of a selected pixel cannot be specified. Therefore, in order to specify the position of a selected pixel, vertical scanning clock signal ϕVN and horizontal scanning clock signal ϕHN are applied by using an external tester or the like, and the selection of a pixel is performed.

Sense-related refresh control circuit 142 uses an output signal of OR circuit 141 in place of oscillation signal ϕVS0 shown in FIG. 12 to generate precharge/equalize signal ϕPE, sense amplifier driving signal ϕP and sense amplifier driving signal ϕN at predetermined timings.

After sense amplifier driving signal ϕP and ϕN are set to the active state, the horizontal scanning signals are sequentially activated in accordance to a horizontal clock signal by using an external tester or the like, and the pixel data is then read out.

Figure 24:
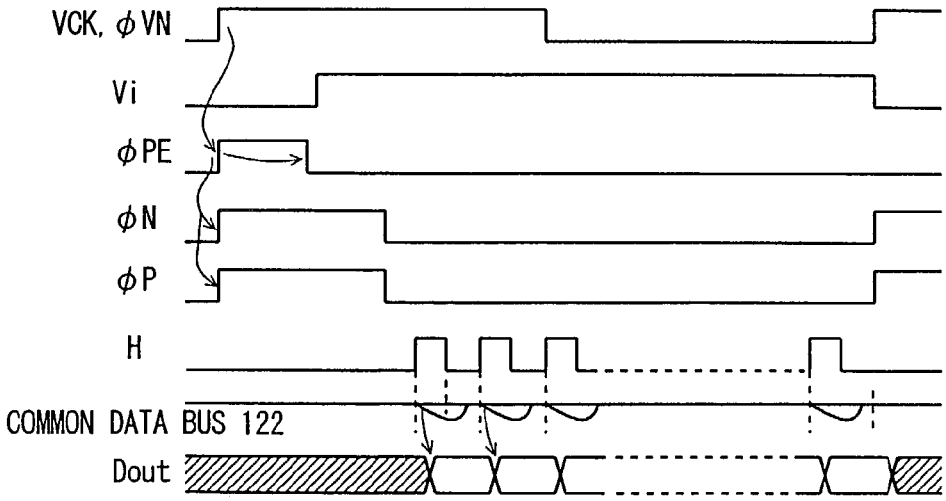
FIG. 24 is a timing chart representing operations of circuits shown in FIG. 22 and FIG. 23.

FIG. 24 is a timing chart representing the operation upon pixel data reading in the test operation. Referring to FIG. 24, the description will be given of the operation of the circuits shown in FIGS. 21 and 22.

During the test mode, isolation gate IG, shown in FIG. 21, is rendered conductive so that internal data signal lines DL and DR are connected to complementary signal lines CL and CR. The output signal of AND circuit 140, shown in FIG. 23, changes in accordance with externally applied vertical clock signal ϕVN, and sense-related refresh control circuit 142 activates/inactivates precharge/equalize instruction signal ϕPE and sense amplifier driving signals ϕP and ϕN at predetermined timings. In accordance with sense amplifier driving signals ϕP and ϕN, sense amplifier SA, shown in FIGS. 21 and 22, carry out a sensing operation to latch signal voltages of signal lines CL and CR. Then, a horizontal scanning clock signal is applied, and in accordance with horizontal scanning signal H (Hi, Hj), a column (horizontal scanning line) selection operation is carried out. When horizontal scanning signal H is driven to the non-selected state, precharge circuit 125 precharges common data bus 122 to the power supply voltage level in accordance with inhibition signal INHH.

Pixel data of one row latched by sense amplifiers SA are sequentially read out on common data bus through read gates 120 (120*i*, 120*j*) in accordance with horizontal scanning signals H (Hi, Hj). Then, internal read-out data on common data bus 122 are externally outputted through output circuit 124. Here, during this test operation, the connection control circuit, connected to the common image data line, is maintained in the nonconductive state. Horizontal scanning signals Hi, Hj are outputted from horizontal scanning circuit 3 shown in FIG. 1 and others.

Moreover, in place of precharge circuit 125, a pull-up circuit for respectively pulling up common data lines 122*a* and 122*b* to the power supply voltage VCC level may be used.

[First Modification]

Figure 25:
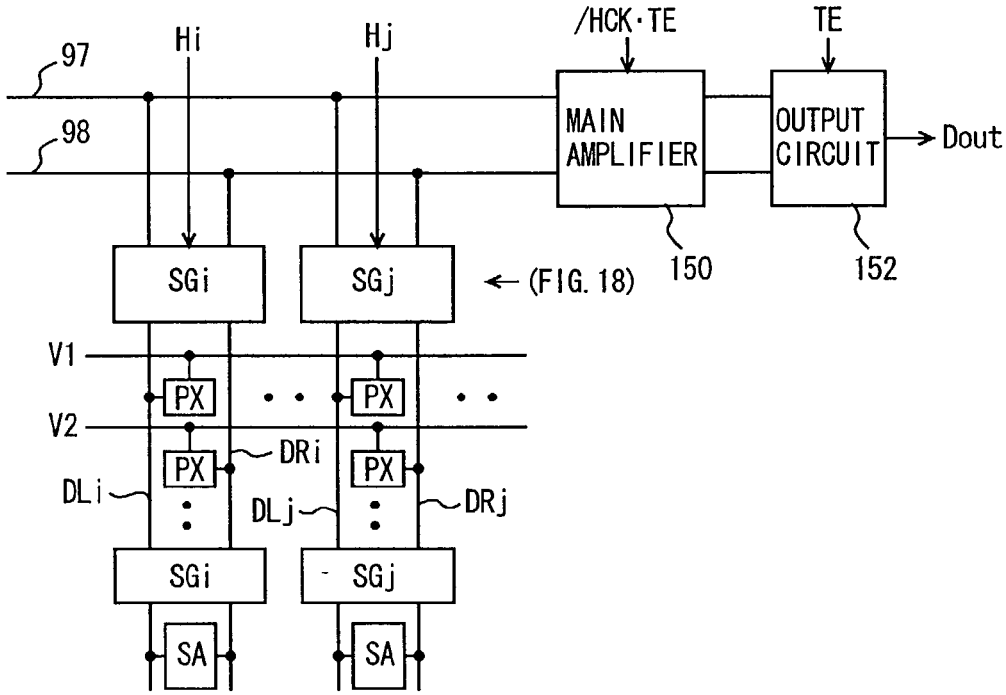
FIG. 25 is a diagram showing a modification of the third embodiment of the present invention.

FIG. 25 is a diagram that schematically shows a construction of a first modification of the third embodiment of the present invention. In FIG. 25, internal image data lines 97 and 98 for transmitting complementary data to internal data signal lines DL and DR are arranged. Switching circuits SGi and SGj have the same construction as the switching circuits shown in FIG. 18. These internal image data lines 97 and 98 are provided with a main amplifier 150 that is activated, in response to a logical product of horizontal scanning clock signal /HCK and test enable signal TE, to differentially amplify voltages of these internal image data lines 97 and 98, and an output circuit 152 that carries out a buffering on internal read-out data of main amplifier 150 for external output. The other constructions are the same as those shown in FIG. 18 except that isolation gates IGi and IGj are rendered conductive in response to test enable signal TE.

In the construction shown in FIG. 25, switching circuits SGi and SGj are made conductive in response to horizontal scanning signals Hi and Hj in the test mode, and data amplified by sense amplifier SA are read out onto common image data lines 97 and 98. During the test mode, main amplifier 150 is activated, when horizontal scanning clock signal /HCK attains the logical L level, to amplify and supply data read out onto these internal image data lines 97 and 98 to output circuit 152.

Sense amplifier SA has a comparatively large driving capability, and therefore can generate a comparatively large voltage difference between internal image data lines 97 and 98. By amplifying this voltage difference caused on these internal image data lines 97 and 98 using main amplifier 150, it becomes possible to externally read out the holding voltage of each pixel PX without providing a read gate separately.

In this construction shown in FIG. 25, as a construction for operating the refresh circuit in the test mode, a construction shown in FIG. 23 can be utilized. If normal operation mode instruction signal NORM is set into the active state of the logical H level upon activation of test enable signal TE, it is possible to select rows and columns (vertical scanning lines and horizontal scanning lines).

[Second Modification]

Figure 26:
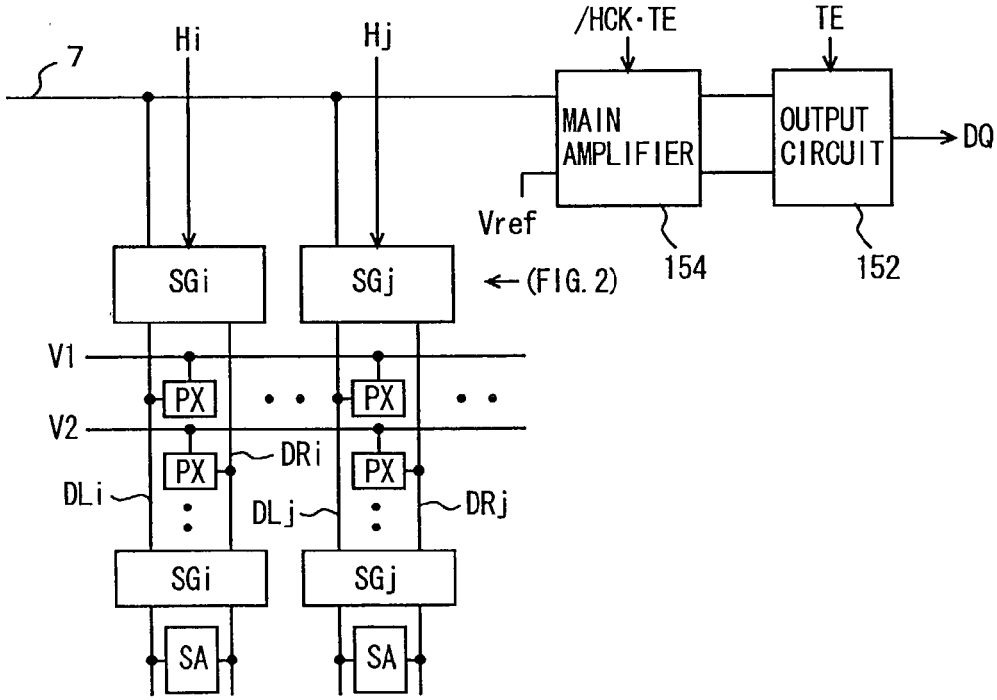
FIG. 26 is a diagram showing a construction of a second modification of the third embodiment of the present invention.

FIG. 26 is a diagram that schematically shows a construction of a second modification in accordance with the third embodiment of the present invention. In FIG. 26, switching circuits SGi and SGj have the same constructions as those shown in FIG. 2. During the test mode, normal mode instruction signal NORM is maintained at the active state or the logical H level, and one of data signal lines DL and DR is connected to internal image data line 7 in accordance with right enable signal RE and left enable signal LE. When sense amplifier SA is driven into the active state, these internal data signal lines DL and DR are driven to the power supply voltage and the ground voltage level complementarily. Therefore, during the test mode, by utilizing these switching circuits SGi and SGj, the corresponding sense amplifier SA can be coupled to internal image data line 7 in accordance with horizontal scanning signals Hi and Hj, to cause a relatively large voltage change on internal data line 7.

Main amplifier 154 compares the signal on internal image data line 7 with reference voltage Vref, generates internal data onto output circuit 152 in accordance with the result of comparison. In the case where internal image data line 7 is precharged to the power supply voltage VCC level in the test mode, a voltage slightly lower than power supply voltage VCC is used as reference voltage Vref. When latch data at the logical H level or the logical L level of sense amplifier is transferred to internal image data line 7, internal image data line 7 attain a voltage level higher than reference voltage Vref or lower than reference voltage Vref in accordance with the transferred data.

It is only necessary to set reference voltage Vref at a voltage level depending on an amount of voltage change caused on common image data line 7 when sense amplifier SA is connected to common image data line 7, that is, at a voltage level between the logical H level and the logical L level of common image data line 7.

In the construction shown in FIG. 26, the other construction is the same as that shown in FIG. 2. In the test mode as well, the refresh circuit also carries out a refresh operation.

As described above, in accordance with the third embodiment of the present invention, the internal read-out data is generated by utilizing the signals latched by the sense amplifier of the complementary data signal lines, and in accordance with the internal read-out data, the output circuit is driven to read out data externally. Thus, it is possible to amplify a minute holding voltage of pixel PX to be externally transmitted, and consequently to identify the holding voltage of each pixel by utilizing a general LSI tester.

[Fourth Embodiment]

Figure 27:
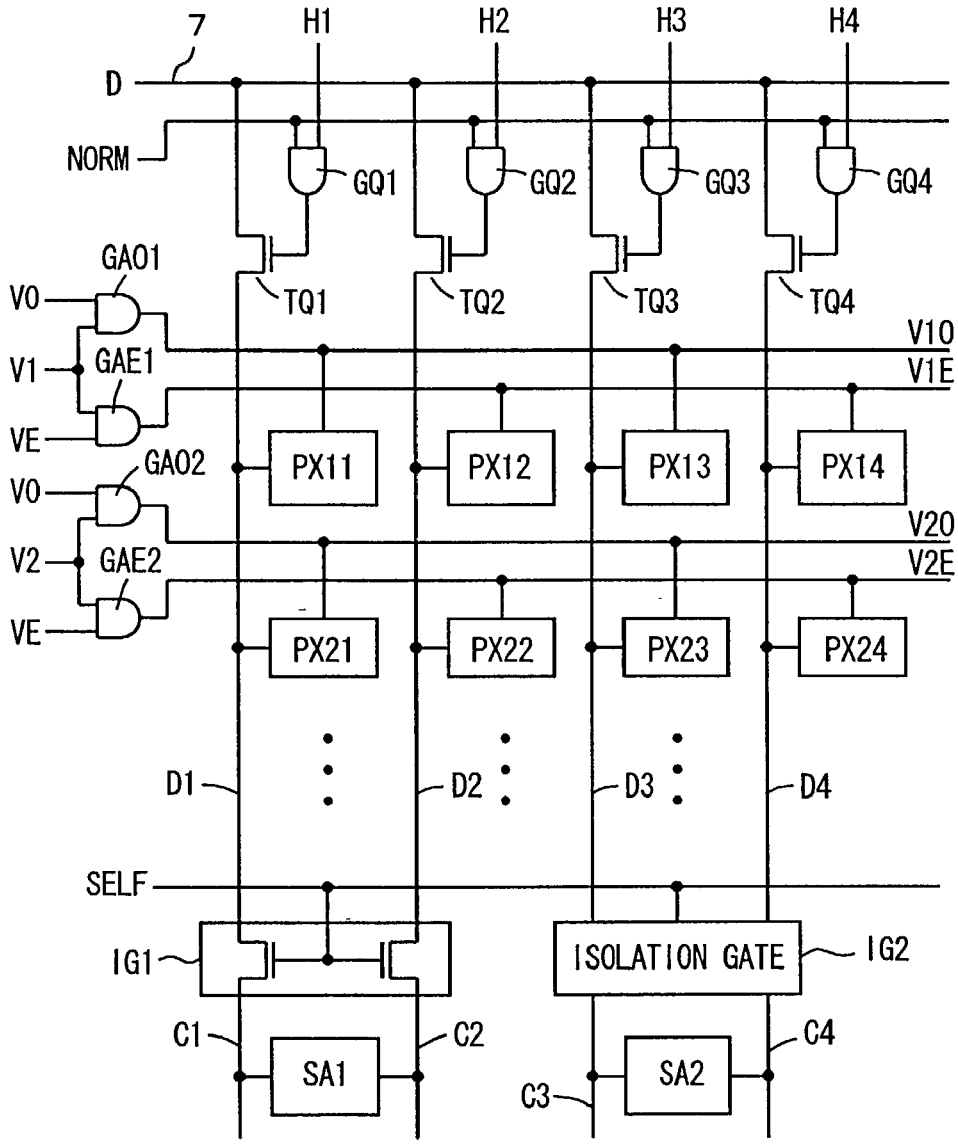
FIG. 27 is a diagram showing a construction of a main part of a display device in accordance with a fourth embodiment of the present invention.

FIG. 27 is a diagram that schematically shows a construction of a main part of a display device in accordance with a fourth embodiment of the present invention. FIG. 27 representatively shows pixels arranged in 2 rows and 4 columns. Internal data signal lines D1, D2, D3 and D4 are arranged corresponding to the respective pixel rows. Selection gates TQ1 to TQ4 are provided corresponding to these respective data signal lines D1 to D4. AND circuits GQ1 to GQ4 for receiving respective horizontal scanning selection signals H1 to H4 and a normal operation mode instruction signal NORM are provided corresponding to these respective selection gates TQ1 to TQ4. Selection gates TQ1 to QT4 are rendered conductive when the output signals of the corresponding AND circuits GQ to GQ4 are set to the logical H level, and couple the corresponding internal data signal lines D1 to D4 to common image data lines 7 when made conductive.

An isolation gate ID1 is provided corresponding to internal data signal lines D1 and D2, and an isolation gate ID2 is provided corresponding to internal data signal lines D3 and D4. These internal data signal lines D1 and D2 are connected to complementary signal lines C1 and C2 through isolation gate ID1, and internal data signal lines D3 and D4 are connected to complementary signal lines C3 and C4 through isolation gates IG2. A sense amplifier SA1 is provided corresponding to these complementary signal lines C1 and C2, and a sense amplifier SA2 is provided corresponding to complementary signal lines C3 and C4.

Corresponding to pixels PX11 to PX14 that are aligned on a first row, an AND circuit GAO1 for receiving an odd vertical scanning line instruction signal VO and a vertical scanning signal V1 and an AND circuit GAE1 for receiving an even vertical scanning line instruction signal VE and vertical scanning signal V1 are provided. A vertical scanning signal V1O is outputted from AND circuit GAO1 and a vertical scanning signal V1E is outputted from AND circuit GAE1.

Vertical scanning signal V1O is supplied to pixels PX11, PX13 on an odd column, and vertical scanning signal V1E is supplied to pixels PX12, PX14 on an even column.

With respect to pixels PX21 to PX24 that are aligned on a second row, an AND circuit GAO2 for receiving a vertical scanning signal V2 and odd vertical scanning instruction signal VO and an AND circuit GAE2 for receiving an odd vertical scanning instruction signal VE and vertical scanning signal V2 are arranged. A vertical scanning signal V2O is outputted from AND circuit GAO2, and a vertical scanning signal V2E is outputted from AND circuit GAE2. Vertical scanning signal V2O is supplied to pixels PX21 and PX23 on an odd column, and vertical scanning signal V2E is supplied to pixels PX22 and PX24 on an even column.

In these pixels PX11 to PX14 and PX21 to PX24, internally provided sampling TFTs receive corresponding vertical scanning signals.

During normal operation mode, normal operation mode instruction signal NORM is set to the logical H level and AND circuits GQ1 to GQ4 are enabled so that a signal at the logical H level is successively outputted in accordance with horizontal scanning signals H1 to H4 (in the case of the point sequential scanning system). Selection gates TQ1 to TQ4 are rendered conductive when the output signals of the corresponding AND circuits GQ1 to GQ4 attain the logical H level, thereby connecting the corresponding data signal lines D1 to D4 to internal common image data line 7. Isolation gate IG is maintained in the non-conductive state.

Here, vertical scanning instruction signals VO and VE are commonly set to the logical H level during the normal operation mode. Therefore, when vertical scanning signal V1 rises to the logical H level, both of vertical scanning signal V1O and V1E are set to the logical H level so that sampling TFTs in pixels PX11 to PX14 that are aligned on the first row are all rendered conductive and in accordance with horizontal scanning signal H1 to H4, a writing operation of pixel data signal is carried out on respective pixels.

During the refresh mode, normal operation mode instruction signal NORM is set to theological L level, and the output signal from AND circuit GQ1 to GQ4 is in the logical L level and selection gates TQ1 to TQ4 are maintained in the non-conductive state. On the other hand, isolation gates IG1, IG2 are rendered conductive so that internal data signal lines D1 and D2 are coupled to complementary signal lines C1 and C2 and internal data signal lines D3 and D4 are coupled to complementary signal lines C3 and C4.

During the refresh mode, vertical scanning instruction signals VO and VE are driven to the logical H level alternatively. Therefore, for example, when vertical scanning signal V1 is driven to the logical H level, if vertical scanning instruction signal VO is in the logical H level, vertical scanning signal V1O rises to the logical H level. Even vertical scanning instruction signal VE is maintained in the logical L level since vertical scanning signal V1E is set in the logical L level. Therefore, in this state, sampling TFTs of pixels PX11 and PX13 on the odd, first row are rendered conductive so that internal voltage holding capacitance elements are connected to internal data signal lines D1 and D3, while sampling TFTs of pixels PX12 and PX14 are in the con-conductive state. Therefore, in this state, pixel data signals are transmitted to complementary signal lines C1 and C3 and sense amplifiers SA1 and SA2 carry out sensing operations. Thus, pixel data signals thus sensed and amplified are re-written in the corresponding pixels PX11 and PX13.

When even scanning instruction signal VE rises to the logical H level, odd scanning instruction signal VO is set to the logical L level, vertical scanning signal V1E is set to the logical L level, and vertical scanning signal V1O is set to the logical L level. In this state, stored voltage signals of pixels PX12 and PX14 are transmitted to internal data signal lines D2 and D4, while internal holding voltages of pixels PX11 and PX13 are not transmitted to internal data signal lines D1 and D3 and internal data signal lines D1 and D3 are maintained in the precharge voltage level. By activating sense amplifiers SA1 and SA2, holding voltages of pixels PX12 and PX14 are recovered, and can be again re-written in the original pixels PX12 and PX14.

Therefore, in the case of the construction shown in FIG. 27, since only one internal data signal line is provided corresponding to a pixel column, there is no need of placing paired internal data signal lines corresponding to each pixel column. Thus, it becomes possible to reduce the area required for interconnection layout, and consequently to reduce the area occupied by the display pixel matrix.

Figure 28:
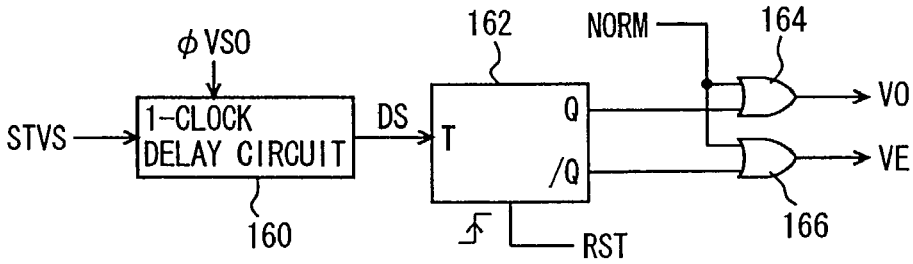
FIG. 28 is a diagram showing an example of a construction of a part for generating an even/odd vertical scanning instruction signal shown in FIG. 27.

FIG. 28 is a diagram that shows an example of the construction of a part for generating vertical scanning instruction signals VO and VE. In FIG. 28, a vertical scanning instruction signal generation section includes: a 1-clock delay circuit 160 that delays refresh vertical scanning start signal STVS by one clock cycle of oscillation signal ϕVSO from the oscillation circuit shown in FIG. 10; a T flip-flop 162 for changing the state of its output in accordance with the output signal of 1-clock delay circuit 160; an OR circuit 164 receiving the signal of output Q of T flip-flop 162 and normal operation mode instruction signal NORM and outputting odd vertical scanning instruction signal VO; and an OR circuit 165 receiving the signal from output /Q of T flip-flop 162 and normal operation mode instruction signal NORM and generating even vertical scanning instruction signal VE.

T flip-flop 162 is initialized in response to the rise of reset signal RST. This reset signal RST is a reset signal that is generated upon power up or system resetting, and also a reset signal that is generated in the form of a one-shot pulse in response to the rise of refresh instruction signal SELF.

Figure 29:
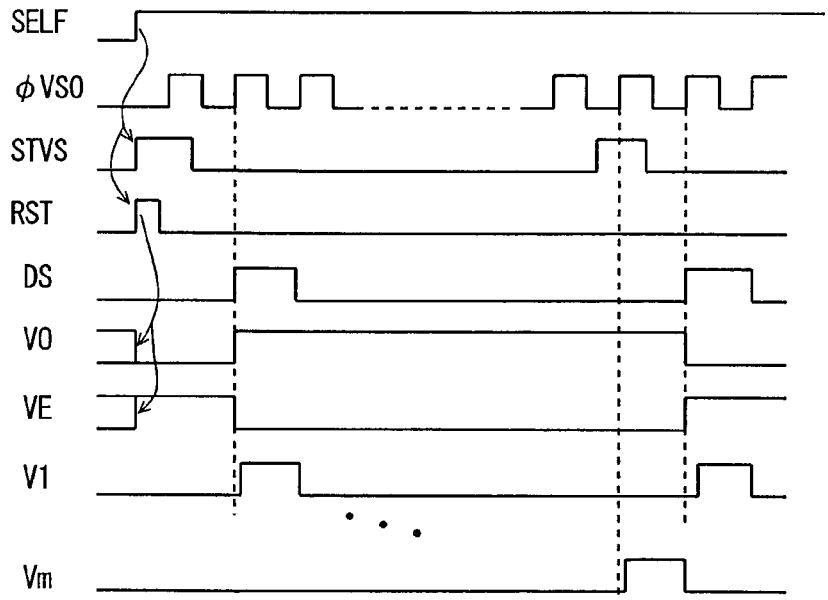
FIG. 29 is a timing chart representing the operation of the display device shown in FIG. 27.

FIG. 29 is a timing chart that represents the operation of a circuit shown in FIG. 28. Referring to FIG. 29, a brief description will be given of the operation of the circuit shown in FIG. 28 in the following.

When refresh instruction signal SELF rises to the logical H level, refresh vertical scanning start signal STVS rises to the logical H level in accordance with the refresh control circuit shown in FIG. 10, and the vertical scanning register is set. Reset signal RST rises to the logical H level, T flip-flop 162 is reset, and its output Q is set to the logical L level and its output /Q is set to the logical H level.

Then, when delay output signal DS of 1-clock delay circuit 160 attains the logical H level with a delay of 1-clock cycle from this vertical scanning start signal STVS, the output state of T flip-flop 162 is changed so that output Q is set to the logical H level and output /Q is set to the logical L level. Normal operation mode instruction signal NORM is in the logical L level during the refresh mode. Therefore, odd vertical scanning instruction signal VO attains the logical H level, and even vertical scanning instruction signal VE attains the logical L level. When vertical scanning signal V1 rises to the logical H level, vertical scanning signal V1O attains the logical H level in accordance with odd vertical scanning instruction signal VO.

Then, a counting operation is carried out internally, and this signal VO is maintained in the logical H level until the scanning operations are completed on the respective vertical scanning lines, while signal VE is maintained in the logical L level. Upon completion of the scanning of the last scanning line Vm, output delayed signal DS of 1-clock delay circuit 160 again attains the logical H level in accordance with vertical scanning start signal STVS. Thus, the state of T flip-flop 162 is changed responsively so that odd vertical scanning instruction signal VO turns logical L level while even vertical scanning instruction signal VE turns logical H level. Therefore, at this time, in accordance with vertical scanning signal V1, vertical scanning signal V1E shown in FIG. 17 attains the logical H level.

Therefore, in each clock cycle, a refreshing operation is carried out on a first half of the pixels among the pixels aligned in one row, and upon completion of the scanning of vertical scanning lines of one frame, the refreshing operation is carried out on the second half of the pixels in the next frame period. Although the refresh interval becomes shorter as compared with a construction in which entire pixels on one row are simultaneously refreshed, the number of sense amplifiers to be operated simultaneously is halved (one sense amplifier with respect to pixels on two rows). Therefore, it is possible to reduce the peak current upon refreshing, and consequently to reduce the current consumption.

[First Modification]

Figure 30:
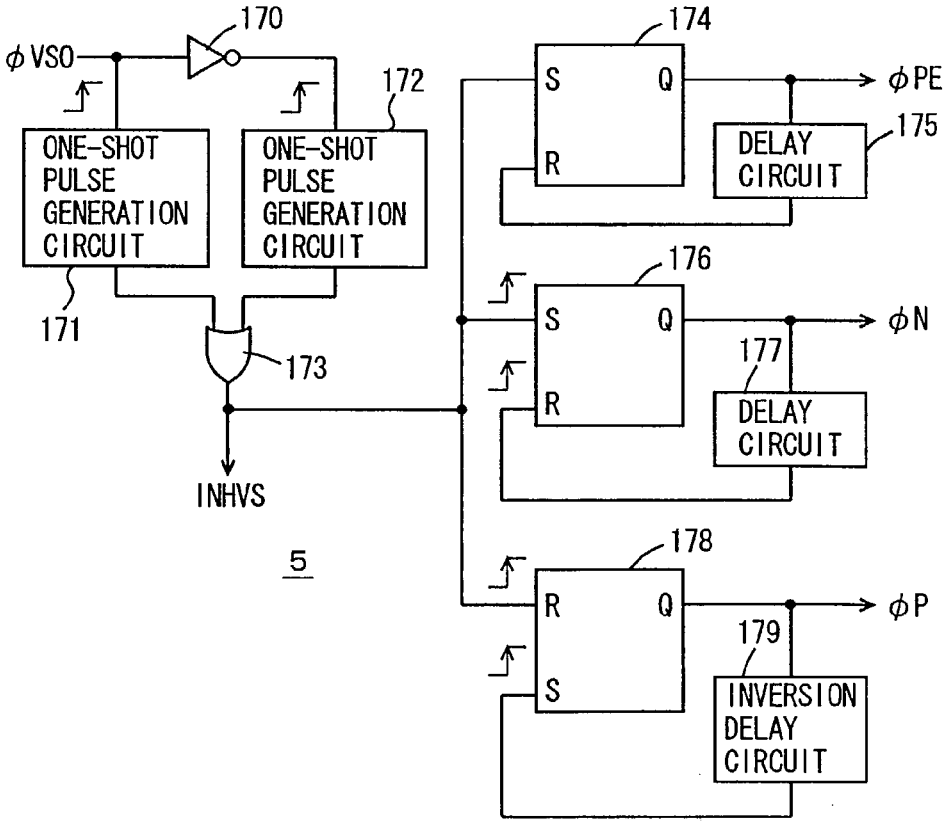
FIG. 30 is a diagram schematically showing a construction of a refresh control section in the display device in accordance with the fourth embodiment of the present invention.

FIG. 30 is a diagram that schematically shows a modification of the refresh control circuit in accordance with the fourth embodiment of the present invention. In FIG. 30, the refresh control circuit includes: an inverter 170 for inverting oscillation signal ϕVS0; a one-shot pulse generation circuit 171 for generating a one-shot pulse signal in response to the rise of oscillation signal ϕVS0; a one-shot pulse generation circuit 172 for generating a one-shot pulse signal in response to the rise of an output signal of inverter 170; an OR circuit 173 receiving output signals of one-shot pulse generation circuits 171 and 172, for generating refresh inhibition signal INHVS; a set/reset flip-flop 174, set in response to the rise of an output signal from OR circuit 173, to output precharge/equalize signal ϕPE from its output Q; a delay circuit 175 delaying precharge/equalize signal ϕPE by a predetermined time for resetting set/reset flip-flop 174; a set/reset flip-flop 176, set in response to the rise of refresh inhibition signal INHVS, to generate sense amplifier driving signal ϕN from its output Q; a delay circuit 177 for delaying sense amplifier driving signal ϕN by a predetermined time, for resetting set/reset flip-flop 176; a set/reset flip-flop 178, reset in response to the rise of refresh inhibition signal INHVS, to output sense amplifier driving signal ϕP from its output Q; and an inversion delay circuit 179 delaying by a predetermined time and inverting sense amplifier driving signal ϕP for application to set set/reset flip-flop 178. Set/reset flip-flop 178 is set in response to the rise of the output signal of inversion delay circuit 179.

In the construction of the refresh control circuit shown in FIG. 30, refresh inhibition signal INHVS is activated for a predetermined time in response to the rise and fall of oscillation signal ϕVS0. Accordingly, precharge/equalize instruction signal ϕPE is activated for a predetermined time and sense amplifier driving signals ϕN and ϕP are set in the non-activated state for a predetermined time. Therefore, within one cycle period of oscillation signal ϕVS0, the sensing operation is carried out twice.

Figure 31:
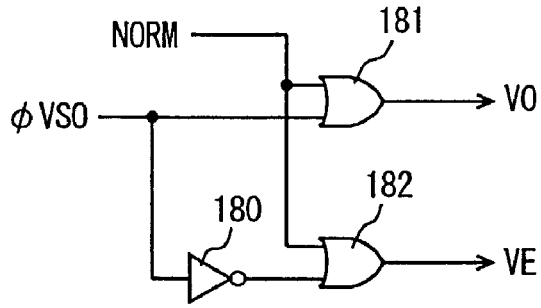
FIG. 31 is a diagram showing a modification of the fourth embodiment of the present invention.

FIG. 31 is a diagram that shows the construction of a part for generating odd and even vertical scanning instruction signals VO and VE. In FIG. 31, the vertical scanning instruction signal generation unit includes: an inverter 180 receiving oscillation signal ϕVS0; an OR circuit 181 receiving oscillation signal ϕVS0 and normal operation mode instruction signal NORM and outputting even scanning indication signal VE; and an OR circuit 182 receiving the output signal of inverter 180 and normal operation mode instruction signal NORM and outputting even scanning indication signal VE. During the refresh mode, odd scanning instruction signal VO is set to the logical H level while oscillation signal ϕVS0 is in the logical H level, and even scanning instruction signal VE is set to the logical H level while oscillation signal ϕVS0 is in the logical L level.

Figure 32:
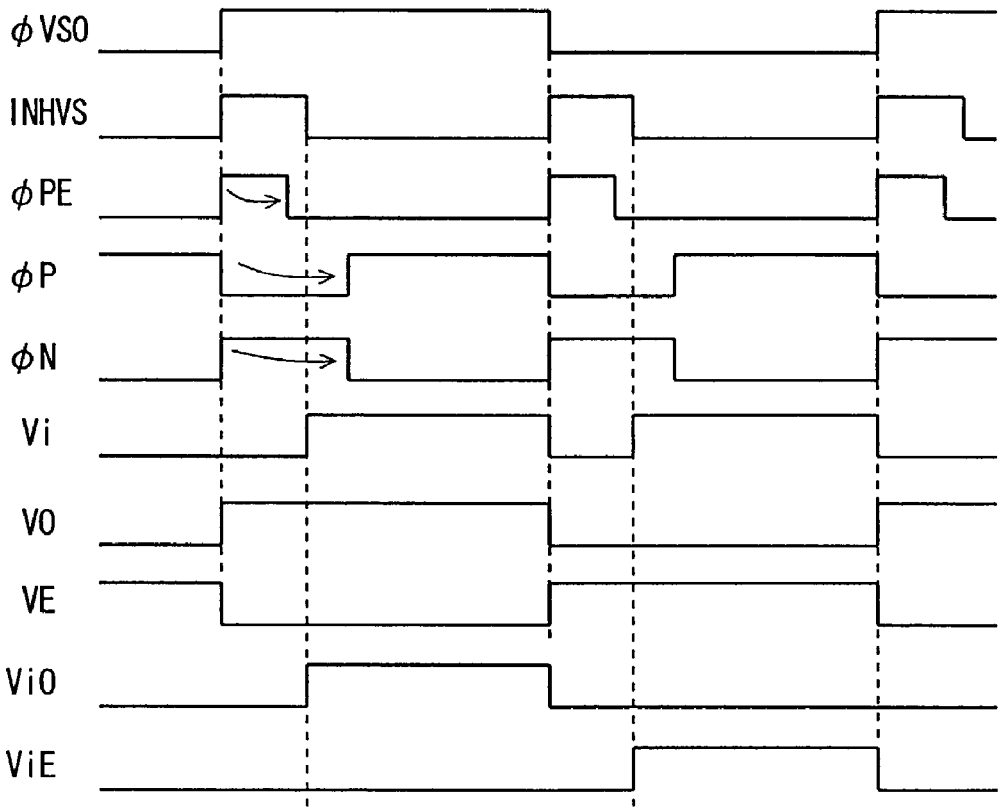
FIG. 32 is a timing chart representing the operations of circuits shown in FIG. 30 and FIG. 31.

Now, referring to a timing chart of FIG. 32, a description will be given of the operation of a circuit shown in FIGS. 30 and 31.

When oscillation signal ϕVS0 rises to the logical H level, one-shot pulse generation circuit 171 generates a one-shot pulse signal so that refresh inhibition signal INHVS from OR circuit 173 attains the logical H level. In response to the rise of this refresh inhibition signal INHVS, set/reset flip-flop 174 is set so that precharge/equalize instruction signal ϕPE is set to the logical H level for a predetermined period. Moreover, set/reset flip-flop 176 is set so that sense amplifier driving signal ϕN is set to the inactive state, and set/reset flip-flop 178 is reset so that sense amplifier driving signal ϕP is set to the logical L level or in the inactive state. In response to the rise of this refresh inhibition signal INVHS, vertical scanning signal Vi of a selected row is once driven to the non-selected state.

When refresh inhibition signal INHVS attains the logical L level, vertical scanning signal Vi outputted by the vertical scanning circuit attains the logical H level. Odd scanning instruction signal VO has been set to the logical H level and even scanning instruction signal VE has been set to the logical L level in accordance with oscillation signal ϕVS0, and thus, in response to the rise of vertical scanning signal Vi, odd vertical scanning signal ViO attains the logical H level. Then, the sense amplifier driving signal ϕP is set to the logical H level and sense amplifier driving signal ϕN is set to the logical L level so that the sense amplifier is activated and a refreshing operation of a holding voltage of pixels is executed on an odd column.

When oscillation signal ϕVS0 attains the logical L level, refresh inhibition signal INHVS again attains the logical H level, and sense amplifier driving signals ϕN and ϕP are each set to the inactive state, while precharge/equalize signal ϕPE is activated. Consequently, the internal data signal lines, on which pixel data of odd columns have been read, return to the precharge state. In response to the fall of oscillation signal ϕVS0, odd scanning instruction signal VO attains the logical L level, and even scanning line instruction signal VE turns logical H level.

At this time, the vertical scanning period is equal to the cycle period of oscillation signal ϕVS0, and shifting operation is not carried out in the vertical scanning circuit.

Therefore, vertical scanning signal Vi again attains the logical H level in response to the fall of refresh inhibition signal INHVS so that even vertical scanning signal ViE rises to the logical H level. Therefore, data of pixels, on even columns, connected to a vertical scanning line to which this vertical scanning signal Vi is transmitted is read out on the corresponding internal data signal lines, and sense amplifier driving signals ϕP and ϕN are sequentially activated so that recovering and re-writing operations of the holding voltage of pixels are carried out on even columns.

Therefore, in the case of the construction shown in FIGS. 30 and 31, the refreshing operation of pixels in one row is carried out within one cycle of oscillation signal ϕVS0. In the case of this construction, the vertical shift register is simply driven in accordance with oscillation signal ϕVS0, shift clock signal ϕVS is supplied to the vertical shift register from buffer 56 shown in FIG. 10, and vertical scanning start signal STVS is outputted from OR circuit 61 shown in FIG. 10.

Here, in the construction shown in FIG. 28 and FIG. 30, in place of the construction in which this refresh control signal is generated in the refresh control circuit, the vertical shift clock signal and inhibition signal may be externally applied. In this case, in place of oscillation signal ϕVS0, a clock signal VSN is externally applied, and an externally applied inhibition signal INHV is activated in response to the rise and fall of this vertical shift clock signal VSN. Here, even in the case where a shift clock signal is externally applied during the refresh period, the construction shown in FIG. 30 may be utilized for generating refresh inhibition signal INHVS internally during the refresh mode.

[Second Modification]

Figure 33:
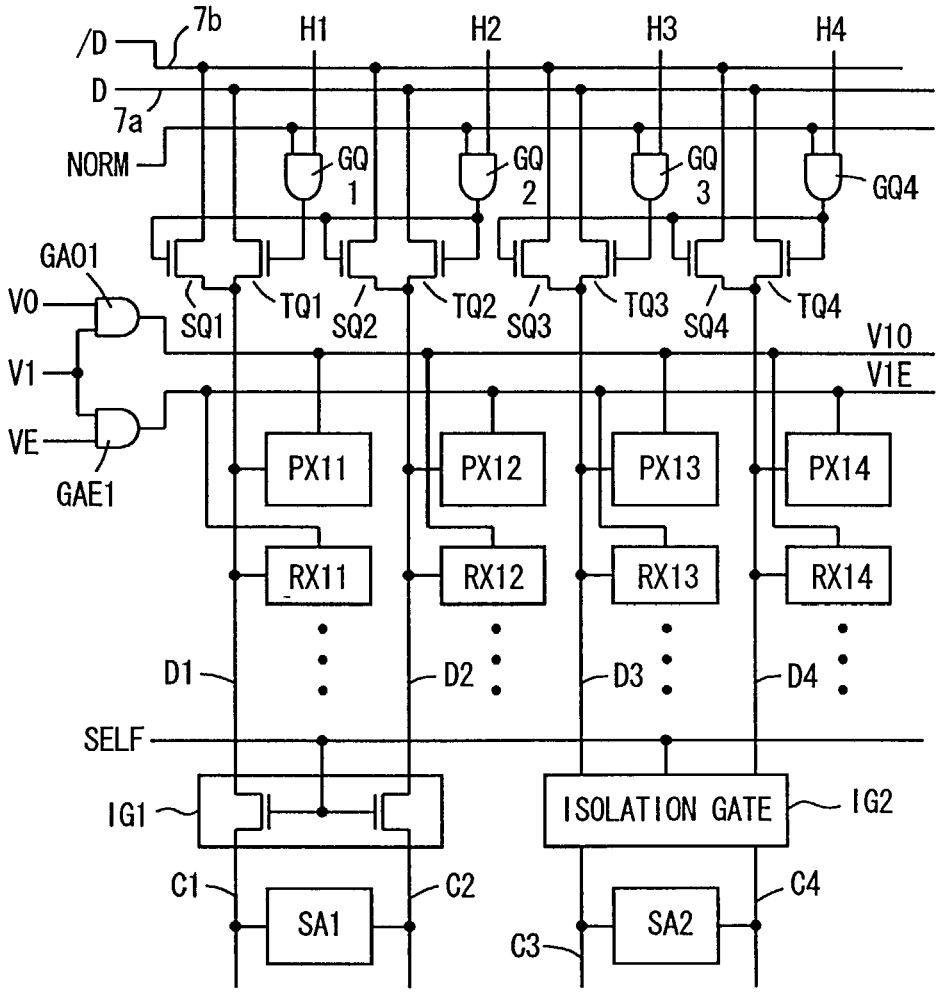
FIG. 33 is a diagram schematically showing a construction of a main part of the second example modification of the display device in accordance with the fourth embodiment of the present invention.

FIG. 33 is a diagram that shows a modification of the fourth embodiment of the present invention. In FIG. 33, reference cells RX11, RX12, RX13 and RX14 are provided corresponding to pixels PX11–PX14 in display pixel matrix. Similarly to the construction shown in FIG. 18, these reference cells RX11–RX14 contain reference capacitance elements having the same capacitance value as the voltage holding capacitance elements contained in the pixels PX11–PX14.

Selection gates SQ1–SQ4 for connecting data signal lines D1–D4 to complementary common image data lines 7*b* when made conductive are provided corresponding to internal data signal lines D1–D4. The selection gates TQ1–TQ4 connect data signal lines DL1–DL4 to common data line 7*a* when made conductive.

Selection gate SQ1 is rendered conductive upon activation of the output signal of AND circuit GQ2, selection gate SQ2 is rendered conductive when the output signal of AND circuit GQ1 is in the logical H level. Selection gate SQ3 is rendered conductive when the output signal of AND circuit GQ4 is in the logical H level, selection gate SQ4 is rendered conductive when the output signal of AND circuit GQ3 is in the logical H level. In other words, in the adjacent data signal lines, when selection gate TQ is rendered conductive, the paired selection gate SQ is rendered conductive, and pixel data D is transmitted to pixel PX while complementary image data signal /D is transmitted to reference cell RX.

Reference cells RX11 and RX13 store complementary pixel data signals on the corresponding data signal lines D1 and D3 in the respective reference capacitance elements when sampling TFTs therein are rendered conductive in response to even scanning signal V1E from AND circuit GAE1. Reference cells RX12 and RX14 store complementary pixel data signals on the corresponding data signal lines D2 and D4 in the respective reference capacitance elements when sampling TFTs therein are rendered conductive in response to odd scanning signal V1O from AND circuit GAO1. The other construction shown in FIG. 33 is the same as that shown in FIG. 18, and the corresponding parts are indicated by the same reference numerals, and the description thereof is omitted.

In the construction shown in FIG. 33, in the normal operation mode as well, signals VO and VE indicating odd and even vertical scanning lines are activated. Therefore, in each row, half the pixels are simultaneously selected so that a data writing operation is carried out on selected pixels.

For example, it is supposed that odd vertical scanning signal V1O is in the selected state and horizontal scanning signal H1 is in the logical H level. In this state, the output signal of gate circuit GQ1 is in the logical H level, and selection gates TQ1 and SQ2 are rendered conductive. Since sampling TFTs of pixel PX11 and reference cell RX12 are in the conductive state, pixel data signals D and /D are stored in pixel PX11 and reference cell RX12, respectively, in accordance with horizontal scanning signal H1. With respect to pixel PX12, since the even vertical scanning signal V1E is in the logical L level and the internal sampling TFT is in the non-conductive state, no data writing operation is carried out on pixel PX12. Odd horizontal scanning lines are sequentially driven to the selected state so that pixel data signals are written in pixels PX11 and PX13 on odd columns, while complementary image data signals /D are written in the corresponding reference cells RX12 and RX14.

Next, upon completion of the writing operation of pixel data for pixels on odd columns over one row, the even vertical scanning instruction signal VE attains the logical H level so that even vertical scanning signal V1E attains the logical H level. In this state, pixels PX12 and PX14 are selected, and reference cells RX11 and RX13 are selected. Horizontal scanning signals H2, H4 for even columns are sequentially driven to the selected state so that pixel data signals D are written in pixels PX12 and PX14, while complementary pixel data signals /D are stored in the corresponding reference cells RX11 and RX13.

Accordingly, it is possible to store complementary image data signals in pixels and reference cells in one row without increasing the number of internal signal lines.

During the refresh operation, selection gates SQ1–SQ4 and TQ1–TQ4 are all set in the non-conductive state since normal operation mode instruction signal NORM is set in the logical L level. In this state, in the same manner as that in the construction shown in FIG. 18, odd vertical scanning signal V1O and even vertical scanning signal V1E are selectively activated so that complementary data signals from pixels and reference cells on the paired data lines are read out. The sensing and restoring operations are carried out on the read out data, and the refreshing operation is then completed. In this case also, the refreshing operation is carried out by using complementary data signals without the number of increasing signal lines.

Figure 34:
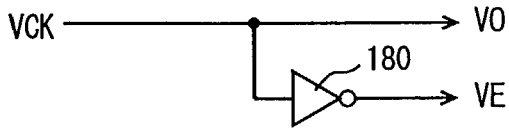
FIG. 34 is a diagram showing an example of a construction of an even/odd vertical scanning selection signal generation section shown in FIG. 33.

FIG. 34 is a diagram that shows an example of the construction of a part for generating vertical scanning instruction signals VO and VE. Odd and even vertical scanning instruction signals VO and VE are generated in both the normal operation mode and the refresh mode. In the construction as shown in FIG. 34, odd scanning instruction signal VO is generated in accordance with vertical scanning clock signal VCK, while even vertical scanning instruction signal VE is generated by inverter 180 that receives vertical scanning clock signal VCK.

Therefore, in the normal operation mode, within one cycle of this vertical scanning clock signal VCK, a data writing is carried out on pixels in one row. During the refresh operation, in the same manner as that in the construction shown FIG. 30, refresh inhibition signal 1NVHS is generated in response to the rise and fall of vertical clock signal VCK. With respect to the construction of the refresh control circuit, it is possible to utilize the construction as shown in FIG. 30.

Figure 35:
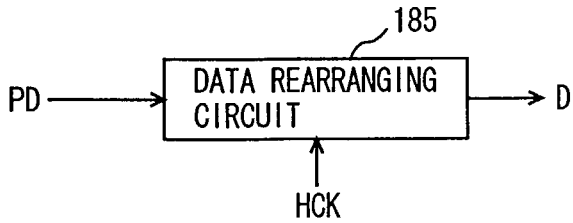
FIG. 35 is a diagram showing schematically an example of a construction of a data writing section in accordance with the fourth embodiment of the present invention.

FIG. 35 is a diagram that schematically shows the construction of a part for altering the writing sequence of odd columns and even columns. In FIG. 35, pixel data signals PD, externally applied in a raster scan sequence, are rearranged in a group of pixels in even columns and a group of odd columns by a data rearranging circuit 185. Specifically, in pixel rearranging circuit 185, after storing pixel data over one row, pixel data D of odd columns are outputted, and pixel data D of even columns are then outputted. This data rearranging circuit 185 is implemented by, for example, a shift register for storing data of pixels over one row.

Figure 36:
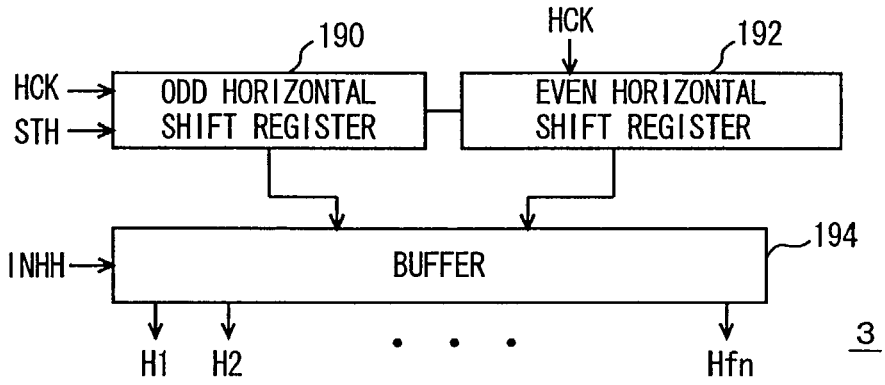
FIG. 36 is a diagram schematically showing an example of a construction of a horizontal scanning circuit of the second example modification in accordance with the fourth embodiment of the present invention.

FIG. 36 is a diagram that shows an example of the construction of a horizontal scanning circuit 3 for this modification. In FIG. 36, horizontal scanning circuit 3 includes: an odd horizontal shift register 190 for carrying out a shifting operation in accordance with horizontal scanning clock signal HCK and horizontal scanning start instruction signal STH; an even horizontal shift register 192 receiving an output signal of odd horizontal shift register 190, and successively carrying out a shifting operation in accordance with horizontal clock signal HCK; and a buffer 194 receiving output signals of odd horizontal shift register 190 and even horizontal shift register 192 and inhibition signal INHH, and outputting horizontal scanning signals H1, . . . , Hfn. Here, horizontal scanning signal Hfi represents a horizontal scanning signal to be applied to the final column in the horizontal scanning operation. Buffer 194 includes a buffer circuit receiving an output signal of odd horizontal shift register 190 and outputting horizontal scanning signals H1, H3, . . . to be applied to odd columns, and a buffer circuit receiving an output signal of even horizontal shift register 192 and outputting horizontal scanning signals H2, H4, . . . to be applied to even columns.

Therefore, with the construction shown in FIG. 36, it is possible to carry out a data writing operation on pixels in even columns after completion of a data writing on pixels in odd columns by utilizing data rearranging circuit 185 as shown in FIG. 35.

Here, in place of this point sequential scanning system, in the case where data are simultaneously written on pixels in one row, such simultaneous writing is easily achieved by alternately carrying out a writing operation on pixels of even columns and of odd columns on a selected row in accordance with vertical scanning instruction signals VO and VE.

As described above, in accordance with the fourth embodiment of the present invention, internal data signal lines of adjacent columns are coupled so as to form a complementary signal line pair, for performing a refreshing of pixel data. Thus, it is possible to reduce the area occupied by interconnection lines, and consequently to reduce the area occupied by the display pixel matrix. Moreover, it is only necessary to provide one sense amplifier per two columns of pixels, and thus, it becomes possible to reduce the area occupied by the sense amplifiers, and also to reduce the current consumption in the sensing operation.

[Fifth Embodiment]

Figure 37:
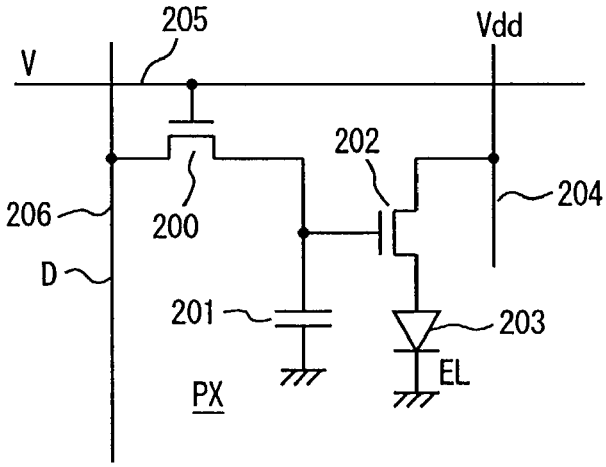
FIG. 37 is a diagram showing a construction of a pixel in accordance with a fifth embodiment of the present invention.

FIG. 37 is a diagram that shows an example of an arrangement of pixels in accordance with a fifth embodiment of the present invention. In FIG. 37, pixel PX includes: an N channel MOS transistor (TFT) 200 that is rendered conductive in response to a signal on a scanning line 205 and take in a data signal D on an internal data signal line 206 when made conductive; a voltage holding capacitance element 201 that holds a voltage applied through MOS transistor (TFT) 200; an N channel MOS transistor 202 that is rendered conductive, in accordance with a charged voltage of voltage holding capacitance element 201, to transfer voltage Vdd on a power supply line 204; and an organic electro-luminescence element (EL) 203 that emits light in accordance with a current supplied through this MOS transistor 202.

The power supply voltage Vdd is for example 10 V, and the electrode node of voltage holding capacitance element 201 is held at the ground voltage or the power supply voltage Vdd level. FIG. 37 shows a case in which the main electrode of voltage holding capacitance element 201 is connected to the ground node.

Pixel PX shown in FIG. 37 is formed utilizing the organic EL element, and a supply current to organic EL element 203 is formed in accordance with a charged voltage on voltage holding capacitance element 201. In accordance with the supply current, light emission/no light emission of organic EL element 203 is determined. Therefore, the constructions described in the first to fourth embodiments can also be employed to the construction for driving organic EL element 203 in accordance with a charged voltage by voltage holding capacitance element 201.

Here, in the construction as shown in FIG. 37, MOS transistor 202 for driving organic EL element and organic EL element 203 may be replaced with each other.

As described above, in accordance with the fifth embodiment of the present invention, pixels PX are constituted by organic EL elements so that it becomes possible to achieve a display device with high efficiency. Moreover, by carrying out a refreshing operation, it becomes possible to stably maintain the charged voltage in voltage holding capacitance element 201 over a long time, and also to reduce power consumption required for holding this charged voltage.

[Sixth Embodiment]

Figure 38:
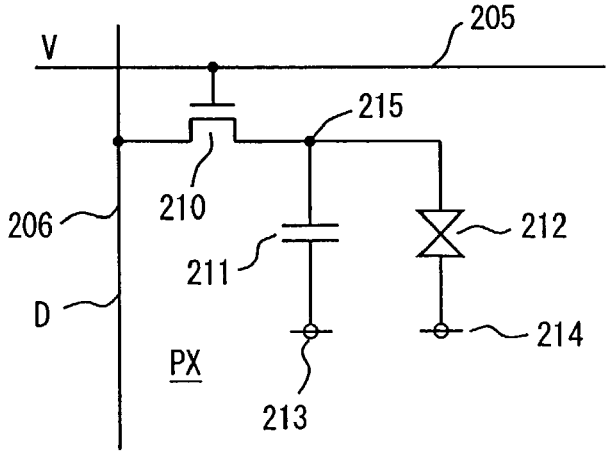
FIG. 38 is a diagram showing a construction of a pixel in accordance with a sixth embodiment of the present invention.

FIG. 38 is a diagram that schematically shows the construction of a sixth embodiment in accordance with the present invention. Referring to FIG. 38, pixel PX includes: a sampling TFT 210 that is rendered conductive, in response to vertical scanning signal V on scanning line 205, to sample pixel data signal D on data signal line 206; a voltage holding capacitance element 211 for holding a voltage signal supplied through sampling TFT 210; and a liquid crystal element 212 that is driven in accordance with a voltage difference between voltages of one electrode node (voltage holding node) 215 of this voltage holding capacitance element 211 and counter electrode 214. The other electrode node of voltage holding capacitance element 215 is connected to a common electrode node 213.

As shown in FIG. 38, even when liquid crystal element 212 is used as the display pixel element, it is possible to drive liquid crystal element 212 in accordance with a voltage held by voltage holding capacitance element 211. This liquid crystal element 212 is applied of a pixel driving voltage according to a voltage difference between counter electrode 214 and voltage holding node pixel element) of voltage holding capacitance element 211 so that the oriented state of the liquid crystal is determined in accordance with this pixel driving voltage.

When a display image is held without any change in the display image, it is not necessary to particularly AC-wise drive (ac-drive) liquid crystal. When it is only required to refresh the holding voltage, the refreshing operation of the holding voltage can be carried out with the constructions of the above-mentioned first to fourth embodiments. However, when the holding image data is re-written by using an external memory, the liquid crystal element is ac-driven in the same manner as the normal operation mode. Therefore, also when the holding voltage for driving liquid crystal element is refreshed internally, in order to maintain the same quality as that in the case utilizing the external memory, it is required to ac-drive the liquid crystal element. In the following, description is given of a construction in which the liquid crystal element is directly driven in accordance with a sampled holding voltage, and the operation thereof.

Figure 39:
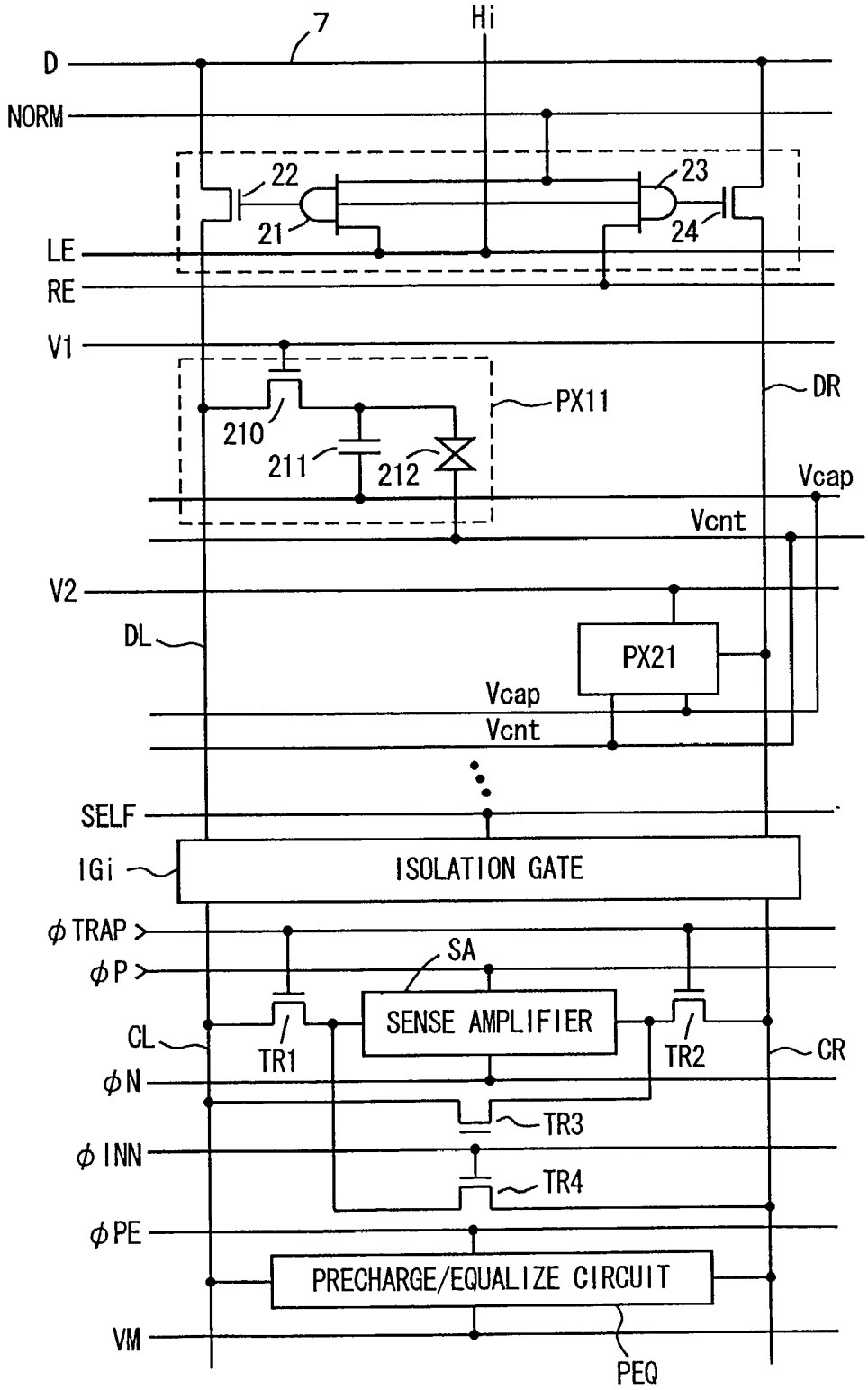
FIG. 39 is a diagram schematically showing a construction of a main part of a display device in accordance with the sixth embodiment of the present invention.

FIG. 39 is a diagram that schematically shows the construction of a main part of a display device in accordance with the sixth embodiment of the present invention. FIG. 39 shows an arrangement related to pixels PX arranged in one column Since pixels PX11 and PX21 have the same construction, in FIG. 39, only the pixel PX11 has the reference numerals attached to its components. Similarly to the construction shown in FIG. 38, pixel PX11 includes sampling TFT210, voltage holding capacitance element 211 and liquid crystal element 212.

A capacitor common voltage Vcap is applied to the main electrode of voltage holding capacitance element 211 through the common electrode line. Liquid crystal element 212 receives a voltage of voltage holding node of voltage holding capacitance element 211 on its pixel electrode, and also receives a voltage Vcnt on the counter electrode line as a pixel driving voltage.

Complementary internal data lines DL and DR are provided corresponding to pixel columns, and these complementary internal data signal lines DL and DR are connected to common image data line 7 through switching circuit SGi. Similarly to the first embodiment, switching circuit SGi includes: an AND circuit 21 receiving a horizontal scanning signal Hi, a normal operation mode instruction signal NORM and left enable signal LE; an AND circuit 23 receiving a horizontal scanning signal Hi, a normal operation mode instruction signal NORM and right enable signal RE; a transfer gate 22 that is rendered conductive in response to the output signal of AND circuit 21 and connects internal data signal line DL to common image data line 7 when made conductive; and a transfer gate 24 that is rendered conductive in response to the output signal of AND circuit 23 and connects internal data signal line DR to common image data line 7 when made conductive.

Pixels PX are alternately connected to internal data lines DL and DR on alternate rows. However, with respect to the arrangement of pixels PX, similarly to the first embodiment, it is only necessary to connect the same number of pixels to internal data lines DR and DL, respectively.

In refresh circuit, complementary signal lines CL. and CR are connected to sense amplifier SA through transfer gates TR1 and TR2 that are selectively made conductive in response to a trapping instruction signal TRAP. Moreover, transfer gates TR3 and TR4 are provided which are rendered selectively conductive in response to a restore instruction signal ϕINV, and invert sense/latch signals of sense amplifier SA and transmit the resulting signals to complementary signal lines CL and CR.

In the same manner as the first embodiment, complementary signal lines CL and CR are provided with isolation gate IGi for connecting internal data signal lines DL and DR to complementary signal lines CL and CR in response to refresh instruction signal SELF, and precharge/equalize circuit PEQ for precharging and equalizing complementary signal lines CL and CR to precharge voltage VM of the intermediate voltage level in response to precharge instruction signal ϕPE.

In the construction as shown in FIG. 39, with respect to the arrangement of pixels PX, the same arrangements as any of the first, second and fourth embodiments can be used. Specifically, internal data signal lines may be provided corresponding to respective columns of pixels PX so that paired internal data signal lines are connected to paired complementary signals, or reference cells may be arranged corresponding to pixels in each pixel column. With any of the arrangements, the same effects can be provided.

The operation in normal operation mode is the same as that in the first embodiment, and in accordance with vertical scanning signal Vi, a row of pixels PX is selected, and in accordance with horizontal scanning signal Hi, a column of pixels is selected, pixel data signal is written in the pixel on the selected column through sampling TFT, and the written pixel data signals are held by voltage holding capacitance elements. Liquid crystal element 212 receives the voltage held by corresponding voltage holding capacitance element 211 on the pixel electrode, and is driven in accordance with voltage Vcnt of the counter electrode.

Figure 40A:
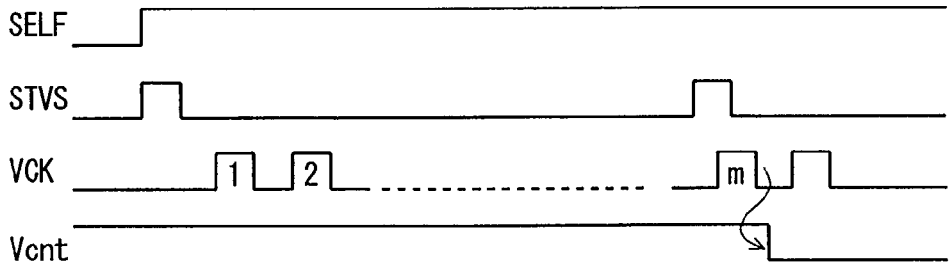
FIG. 40A is a diagram schematically representing the operation in refreshing in the display device shown in FIG. 39.

Now, referring to a timing chart shown in FIG. 40A, a description will be given of the operation in refreshing. When the refresh mode is specified, refresh instruction signal SELF is activated, and isolation gate IG is made conductive to connect the corresponding internal data lines DL and DR to complementary signal lines CL and CR. When refresh vertical scanning start signal STVS is generated, the vertical scanning signal V1 in the leading row is driven to the selected state in accordance with a subsequent vertical scanning clock signal VCK, and a refreshing is carried out on the holding voltages of pixels PX on this selected row. Through this refreshing, in each pixel PX, the polarity of holding voltage is inverted. Specifically, a pixel storing pixel data of the logical H level have its holding voltage changed to the voltage level corresponding to the pixel data of the logical L level from the voltage level corresponding to the logical H level.

Upon completion of the refreshing on one frame (in FIG. 40A, vertical scanning signal for the last row is indicated by Vm), the polarity of voltage Vcnt of the counter electrode is inverted. FIG. 40A shows, by way of example, a state in which counter electrode voltage Vcnt is inverted from the logical H level to the logical L level. At the time of refreshing, the pixel data held by each pixel has its voltage polarity inverted. Therefore, by inverting the polarity of counter electrode voltage Vcnt, in pixel PX, although the magnitude of a voltage applied between the pixel electrode and the counter electrode is the same, the polarity of a voltage applied to liquid crystal element 212 is inverted. Therefore, upon completion of refreshing on pixels in one frame, the respective liquid crystal elements are ac-driven. Here, pixel data are binary data of the logical H level and the logical L level.

During the refreshing operation on pixels in one frame, until the voltage level of counter electrode voltage Vcnt is inverted, the logical level of data held by each pixel is all maintained in the inverted state equivalently. The response time of liquid crystal elements is, for example, approximately 30 ms, and the refresh cycle is, for example, approximately 16 ms. Therefore, even when the logical level of holding voltage is changed, no adverse effects are exerted to the display image since the response time of the liquid crystal elements is sufficiently longer than the refresh cycle, thereby causing no degradation in the image quality.

Consequently, it becomes possible to ac-drive liquid crystal elements of the respective pixels for refreshing the holding voltage.

Figure 40B:
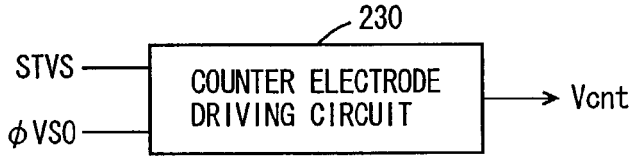
FIG. 40B is a diagram schematically showing a construction of a part for driving a counter electrode shown in FIG. 39.

FIG. 40B is a diagram that schematically shows an example of a construction of a counter electrode driving unit. In FIG. 40B, a counter electrode driving circuit 230 receives vertical scanning start signal STVS and oscillation signal ϕVS0, and generates counter electrode voltage Vcnt. Oscillation signal ϕVS0 is outputted from oscillation circuit 55 shown in FIG. 10, and is utilized as a vertical scanning clock signal. In the refreshing mode, counter electrode driving circuit 230, when vertical scanning start signal STVS is generated, alters the voltage polarity of counter electrode when the refreshing of pixels on the last row is completed in a subsequent cycle, and when refresh inhibition signal is activated. Thus, upon completion of refreshing on pixels in one frame, the polarity of counter electrode voltage is altered so that during the refreshing operation, the respective liquid crystal element can be ac-driven.

Here, in the normal operation mode, this counter electrode driving circuit 230 switches the voltage polarity of voltage Vcnt of counter electrode for each vertical scanning. Therefore, this counter electrode driving circuit 230 receives normal operation mode instruction signal NORM, vertical scanning clock signal VCK and vertical scanning start signal STV so that the switching cycle of the voltage polarity of the counter electrode is altered depending on the operation modes.

Figure 41A:
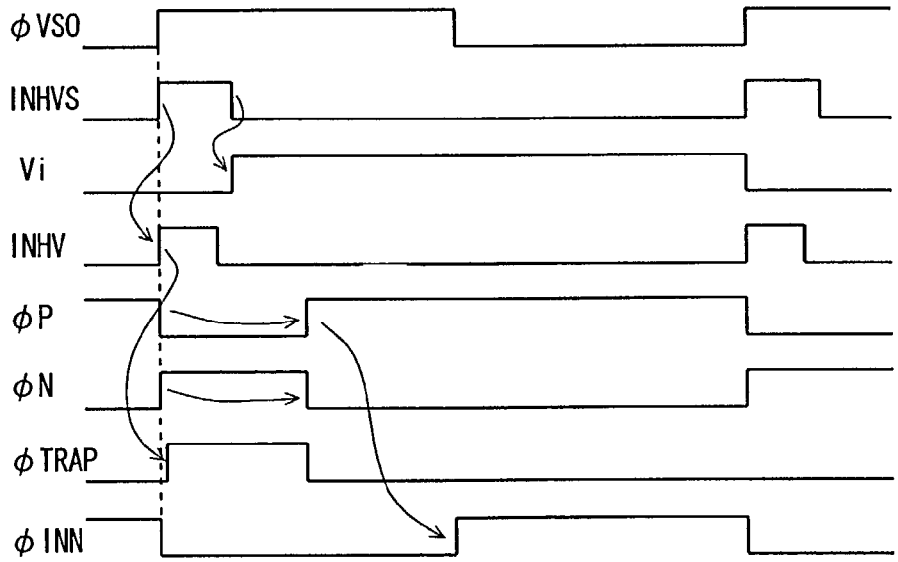
FIG. 41A is a signal waveform diagram representing the internal operations in refreshing in the display device shown in FIG. 39.

FIG. 41A is a signal waveform diagram that represents the operation in refreshing in the sixth embodiment of the present invention. Referring to FIG. 41A, the description will be given of the operation of a refresh circuit shown in FIG. 39.

During the refresh mode, oscillation signal ϕVS0 oscillates at predetermined periods. In accordance with this oscillation signal ϕVS0, the vertical scanning period is determined. When oscillation signal ϕVS0 rises, inhibition signal INHV is set to the logical H level for a predetermined time in accordance with refresh inhibition signal INHVS, not shown, so that a selected row is driven to the non-selected state. In response to the activation of this inhibition signal INVH, precharge instruction signal ϕPE is activated so that complementary signal lines CL and CR are precharged to the predetermined voltage VM. Moreover, the corresponding internal data signal lines DL and DR are connected to complementary signal lines CL and CR through isolation gate IGi so that these internal data signal lines DL and DR are also precharged to the precharge voltage VM level. Sense amplifier driving signals ϕP and ϕN are also set to the inactive state in response to activation of inhibition signal INHV, and responsively, sense amplifier SA is set in the inactive state.

When inhibition signal INVH attains the inactive state, vertical scanning signal Vi for the next vertical scanning line is activated in accordance with the output signal of the vertical shift register. Trapping instruction signal ϕTRAP is in the logical H level in accordance with activation of inhibition signal INVH, transfer gates TR1 and TR2 are in conductive state, and sense amplifier SA is connected to complementary signal lines CL and CR. In this state, restore instruction signal ϕINN is in the inactive state and responsively, transfer gates TR3 and TR4 are in the non-conductive state. Thus, it is possible to prevent complementary signal lines CL and CR from being electrically short-circuited through these transfer gates TR1–TR4.

After a lapse of a predetermined time since row selection signal Vi is driven to the selected state, trap instruction signal ϕTRAP is activated, transfer gates TR1 and TR2 are set to the non-conductive state, and sense amplifier SA is isolated from complementary signal lines CL and CR. In this state, a voltage read from the selected pixel is transferred to sense amplifier SA through internal data line DL or DR. Transfer gates TR1 and TR2 are set to the non-conductive state, to isolate sense amplifier SA from complementary signal lines CL and CR. The voltage signal (charge) transferred from the selected pixel is trapped in the sense nodes of sense amplifier, and the load of sense nodes of sense amplifier SA is reduced to allow the sensing operation at high speed.

When sense amplifier SA completes the sensing operation and enters a latching state, restore instruction signal ϕINN is activated, transfer gates TR3 and TR4 are rendered conductive, sense amplifier SA is connected to complementary signal lines CL and CR with the sense nodes being replaced. Therefore, the data signals inverted in logic level to the original pixel data is transmitted to complementary data signal lines DL and DR. The data signals transferred to these internal data signal line DR or DL are written to the original pixel that is in the selected state. In this state, with respect to the selected pixel, pixel data signal having the inverted logic level is stored. For example, the pixel that has first stored a pixel data signal of power supply voltage level stores a pixel data signal of ground voltage level upon completion of the refreshing operation.

When oscillation signal ϕVS0 again rises, the refreshing operation on the holding voltage on pixels on this selected row completes. Specifically, internal data signal lines DL and DR and complementary signal lines CL and CR are recovered to the precharged state, sense amplifier SA is set to the inactive state, and precharge/equalize circuit PEQ is activated. Transfer gates TR3 and TR4 are set to the non-conductive state, and transfer gates TR1 and TR2 are rendered conductive in response to activation of inhibition signal INVH so that the sense nodes of sense amplifier SA is connected to complementary signal lines CL and CR. Thus, the sense nodes of sense amplifier SA are precharged to precharge voltage VM.

Consequently, in one refreshing cycle in which a refreshing operation is carried out on all the pixels, it is possible to carry out the rewiring operation on all the pixels with the logical levels of data signals being inverted.

Figure 41B:
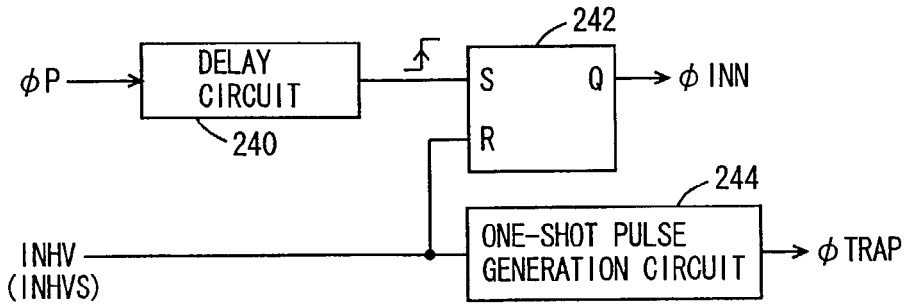
FIG. 41B is a diagram showing an example of a construction of a part for generating a restore instruction signal and a confinement instruction signal shown in FIG. 39.

FIG. 41B is a diagram that shows an example of the construction of a part for generating a pixel data transfer control signal. In FIG. 41B, restore instruction signal ϕINN is outputted from a set/reset flip-flop 242 that is set in response to the rise of a delayed sense amplifier driving signal from delay circuit 240 receiving sense amplifier driving signal ϕP, and reset in response to activation of inhibition signal INHV. A delay time of delay circuit 240 is set to a period of time not less than time required for the time in which the sensing operation completes and the voltage of the sense nodes are stabilized. Sense amplifier driving signal ϕN may be supplied to delay circuit 240. Moreover, after a lapse of a predetermined time since inhibition signal INHV is set to the inactive state, this restore instruction signal ϕINN may be activated.

Trap instruction signal ϕTRAP is outputted from a one-shot pulse generation circuit 244 for generating a one-shot pulse signal with a predetermined time width in response to the activation of inhibition signal INHV. The pulse width of the pulse signal generated from this one-shot pulse generation circuit 244 is set to the time required for sense amplifier driving signals ϕN and ϕP to be activated or so. Trap instruction signal ϕTRAP may be set to the inactive state prior to activation of sense amplifier SA, or trap instruction signal ϕTRAP may be set to the inactive state after the activation of sense amplifier SA. If the load on the sense nodes of sense amplifier SA changes during sensing operation, there might be caused a failure in sensing operation. Therefore, it is preferable to set trap instruction signal ϕTRAP to the inactive state prior to the sensing operation.

Trap instruction signal ϕTRAP may be generated from output Q of set/reset flip-flop that is set in response to the rise of inhibition signal INHV and reset in response to the rise of sense amplifier driving signal ϕP.

Here, the counter electrode is provided commonly to the all pixels. However, the counter electrode may be configured to be divided for each of vertical scanning lines, to have the voltage polarity thereof inverted upon completion of each refreshing operation on a vertical scanning line basis.

As described above, in accordance with the sixth embodiment of the present invention, in the structure where the liquid crystal element is directly driven by holding voltage, the polarity of holding voltage of pixels is inverted at the time of refreshing, and the polarity of the voltage of the counter electrode is also inverted upon completion of refreshing. Thus, it is possible to carry out the refreshing operation on holding voltage stably with a low current consumption without causing any degradation in the display image.

[Seventh Embodiment]

Figure 42:
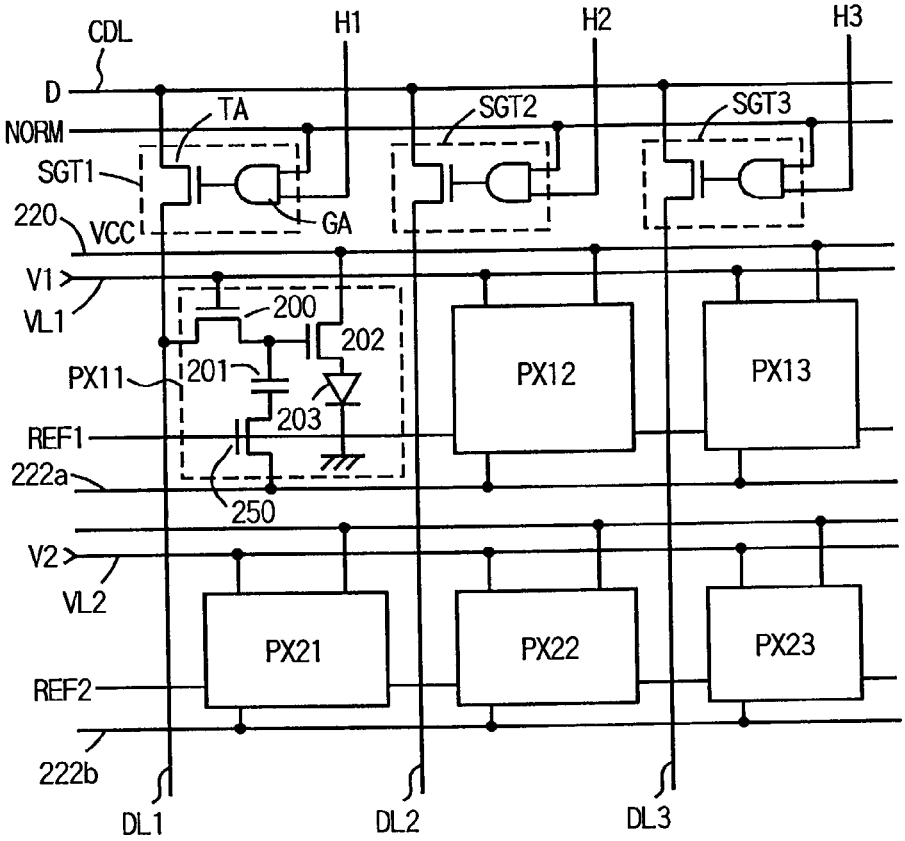
FIG. 42 is a diagram showing a construction of a main part of a display device in accordance with a seventh embodiment of the present embodiment.

FIG. 42 is a diagram that schematically shows the construction of a main part of a display device in accordance with a seventh embodiment of the present invention. FIG. 42 representatively shows pixels PX11–PX13 and PX21–PX23 arranged in two rows and three columns. Internal data signal lines DL1–DL3 are each provided to pixels aligned in the column direction, and vertical scanning lines VL1 and VL2 are each arranged corresponding to pixels aligned in the row direction.

Column selection gates SGT1–SGT3 are provided corresponding to respective internal data signal lines DL1–DL3. Each of the column selection gates SGT1–SGT3 includes an AND circuit GA receiving a corresponding horizontal scanning signal H (H1–H3) and normal operation mode instruction signal NORM, and a transfer gate TA that is rendered conductive when the output signal of AND circuit GA rises to the logical H level and connects internal data signal lines DL (DL1–DL3) to common image data line CDL when made conductive.

Each of pixels PX11–PX13 and PX21–PX23 has the same construction, and therefore, FIG. 42 representatively shows the construction of pixel PX11. Pixel PX11 includes: a sampling TFT 200 that is rendered conductive, in response to vertical scanning signal V1 on vertical scanning line VL1, to take in data signal on internal data signal DL1; a voltage holding capacitance element 201 that holds the voltage sampled by sampling TFT 200; an N channel MOS transistor (TFT) 250 that is connected between the voltage holding capacitance element and a capacitor common electrode line 222*a* and received refresh instruction signal REF1 on its gate, an MOS transistor 202 that supplies a current from a power supply line 220 in response to the charging voltage of voltage holding capacitance element 201; and an EL element 203 that emits light in response to a current supplied from MOS transistor 202. The other electrode node of this EL element 203 is connected to the ground node.

In FIG. 42, power supply line 220 is shown being provided corresponding to respective rows. However, power supply line 220 is commonly coupled to all the pixels. Moreover, capacitor electrode lines 222*a* and 222*b* are shown being provided to each row separately. However, these capacitor electrode lines 222*a* and 222*b* may be commonly coupled to all the pixels. The voltage of capacitor electrode lines 222*a* and 222*b* can be set to the ground voltage level, the power supply voltage VCC level or the intermediate voltage level.

During the normal operation mode, normal operation mode instruction signal NORM is set to the logical H level, and refresh instruction signals RF1–RF2 are all set to the logical H level. Therefore, in pixels PX11–PX13 and PX21–PX23, MOS transistors 230 are all set to the conductive state, and the electrode node of the capacitance elements 201 are connected to capacitor electrode lines 222*a* and 222*b*, respectively. With vertical scanning line VL (VL1 or VL2) being selected, horizontal scanning signals H1–H3 are sequentially driven to the activated state, and pixel data signals are written in pixels PX11–PX13 and PX21–PX23.

Figure 43A:
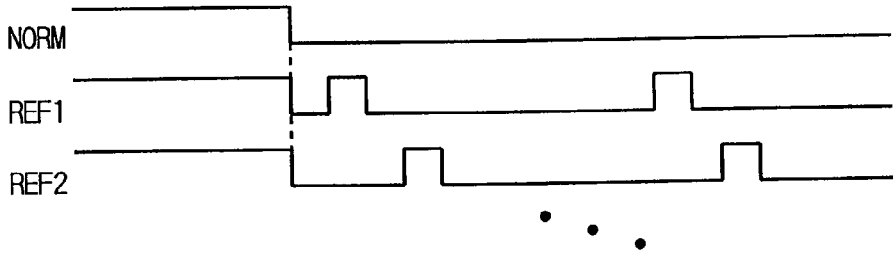
FIG. 43A is a signal waveform diagram representing the operation upon refreshing in the display device shown in FIG. 42.
Figure 43B:
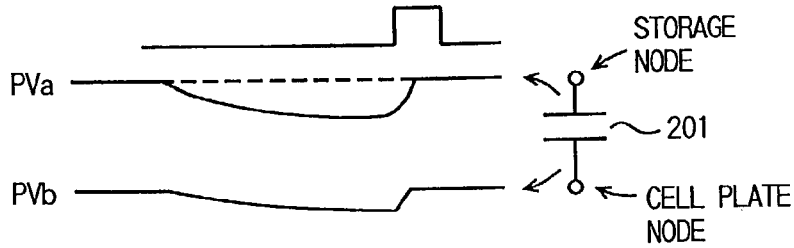
FIG. 43B is a diagram illustrating a change in electrode voltage of a voltage holding capacitance element at the time of refreshing.
Figure 44:
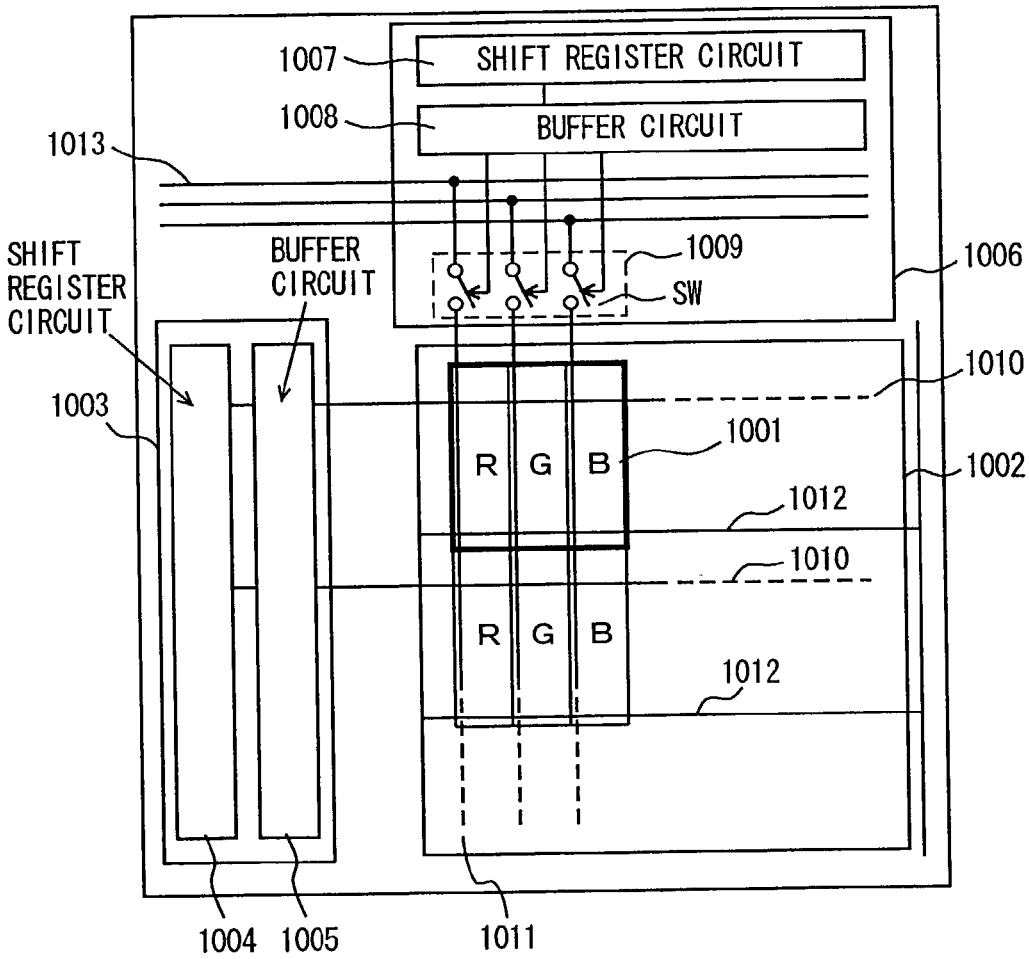
FIG. 44 PRIOR ART
FIG. 44 is a diagram schematically showing the entire construction of a conventional display device.
Figure 45:
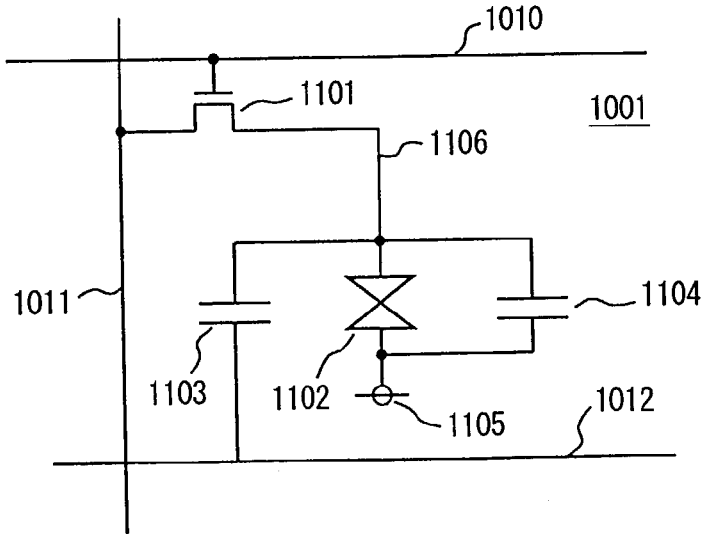
FIG. 45 PRIOR ART
FIG. 45 is a diagram showing an example of a construction of a pixel in the conventional display device.
Figure 46:
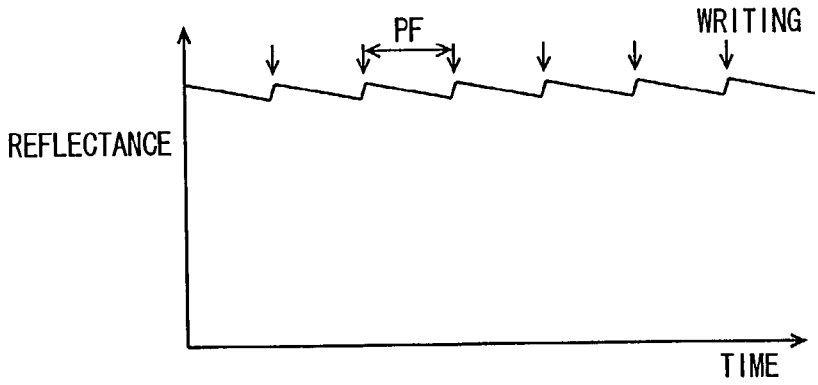
FIG. 46 PRIOR ART
FIG. 46 is a diagram illustrating a change in holding voltage in the conventional display device.
Figure 47:
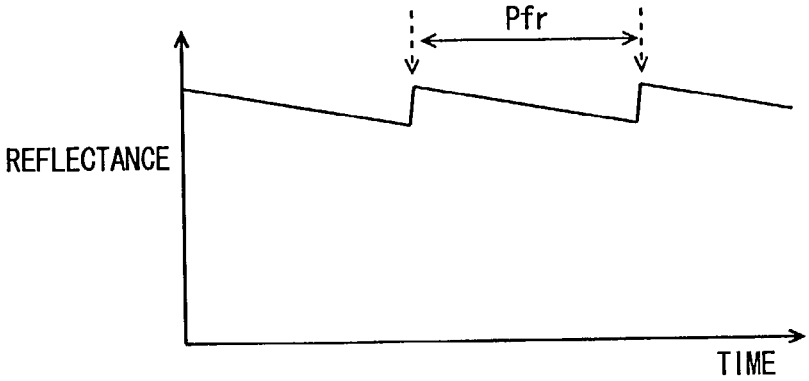
FIG. 47 PRIOR ART
FIG. 47 is a diagram showing another example of a change in driving voltage in the conventional display device.
Figure 48:
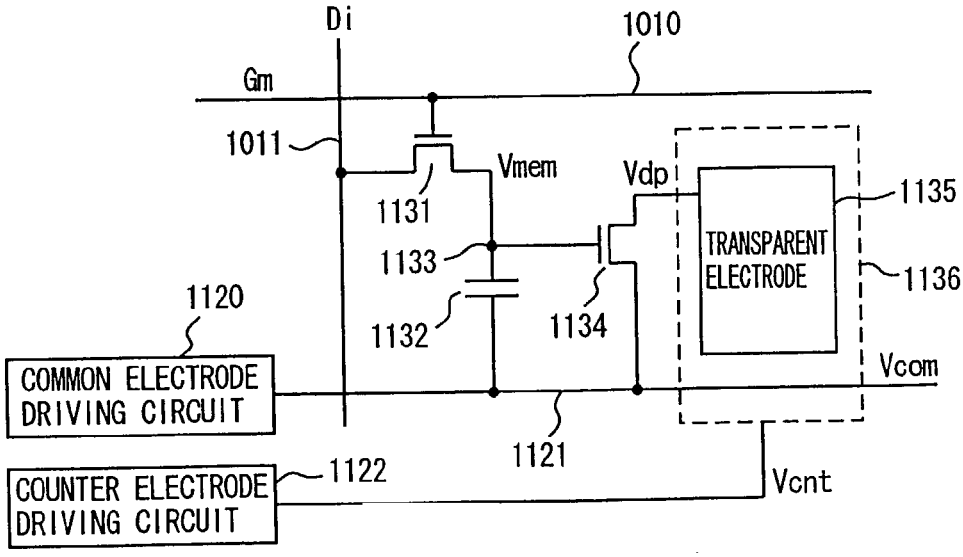
FIG. 48 PRIOR ART
FIG. 48 is a diagram schematically showing a construction of a main part of the conventional display device.
Figure 49:
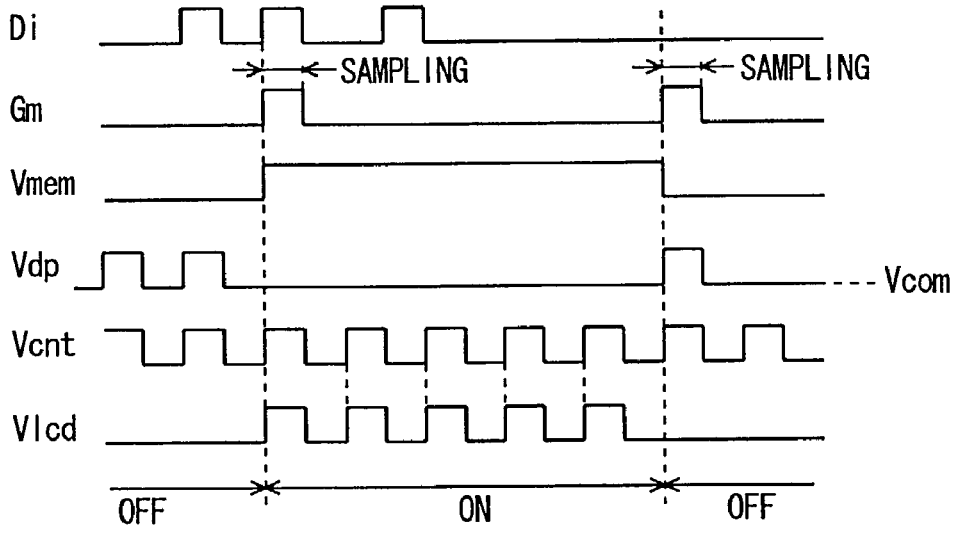
FIG. 49 PRIOR ART
FIG. 49 is a timing chart representing the operation of the display device shown in FIG. 48.
Figure 50:
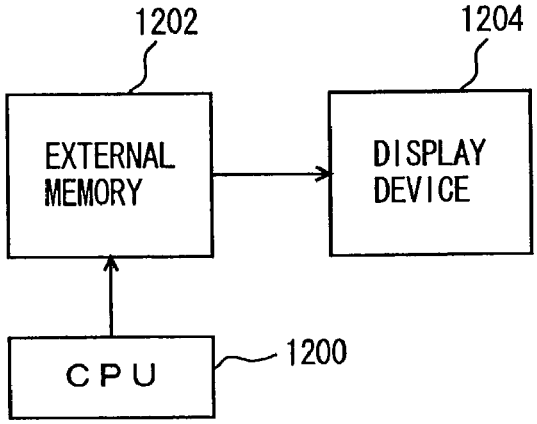
FIG. 50 PRIOR ART
FIG. 50 is a diagram schematically showing an example of the construction of the conventional display system.

As illustrated in FIG. 43, during the refresh mode for holding the pixel data signals, normal operation mode instruction signal NORM is set to the logical L level so that column selection gates SGT1–SGT3 are all set to the non-conductive state to isolate internal data signal lines DL1–DL3 from common image data lines CDL. In this state, as illustrated in FIG. 43B, after all refresh instruction signals RF are once set to the logical L level, these are sequentially raised to the logical H level for a predetermined time at predetermined intervals. When a refresh instruction signal RF (RF1, RF2) is set to the logical L level, MOS transistor 230 is set in the non-conductive state in pixels PX (PX11–PX13 and PX21–PX23) and the main electrode node of voltage capacitance element 201 enters a floating state. In this state, when the voltage of the pixel data holding node (storage node) of voltage holding capacitance element 201 is varied in accordance with a leak current, the voltage level of the main electrode node (referred to as cell plate node) of the capacitor is lowered by capacitive coupling.

In this state, as illustrated in FIG. 43, if voltage PVa of the storage node of voltage holding capacitance element 201 lowers due to the leak current, since the cell plate node of this voltage holding capacitance element 201 is in the floating state, the voltage level also varies through the capacitive coupling. MOS transistor 250 is rendered conductive by setting refresh instruction signal RF1 to the logical H level for connecting the cell plate node to capacitor electrode lines 222 (222*a*, 222*b*). Thus, the voltage PVb of the cell plate node is restored to the original precharge voltage level. In response to the voltage restoration of this cell plate node, a charge is injected to the storage node so that the voltage PVa of the storage node is restored to the original voltage level (a charge is injected by a charge pump operation, with sampling TFT 200 being in the off-state). Therefore, by rendering this MOS transistor 250 conductive in accordance with refresh instruction signal RF, the quantity of charges that is equal to the quantity of a flowing-out charges from the storage node is allowed to flow in again through the charging pump. Thus, the holding voltage of voltage holding capacitance element can be reliably restored to the original voltage level. Thus, even when EL element 203 is a gradation display element having different luminance depending on its current supply and when the voltage of the storage node of voltage holding capacitance element 201 is set in an intermediate voltage level, it is possible to restore it to the original voltage level accurately.

During the refresh mode, by oscillating the oscillation circuit using the same shift register as the vertical scanning circuit and causing the shift register to carry out a shifting operation in according to the oscillation signal, refresh instruction signals RF1, RF2 can be easily generated. The same construction as the vertical shift register is satisfactory utilized.

Therefore, in the case of the construction as shown in FIG. 42, it is possible to eliminate the sense amplifier, and to restore the original voltage level through a simple charge pump operation of the capacitor. Thus, it becomes possible to reliably refresh the holding voltage even when gradation display is done using organic EL elements.

Here, in the above-mentioned arrangement, refresh instruction signals REF are sequentially activated on a row basis. However, the refresh instruction signals may be simultaneously activated for all the pixels.

Moreover, even when liquid crystal elements are used in place of these organic EL elements, the same construction can be utilized so as to restore the original voltage level. In the case of an ac-driving operation on liquid crystal elements, the polarity of the counter electrode voltage is changed.

As described above, in accordance with the seventh embodiment of the present invention, the capacitance element for holding the driving voltage of the organic EL elements is configured to perform a charge pumping operation. Thus, it is possible to restore the voltage corresponding to an intermediate voltage level, and consequently to carry out a refresh operation on gradation display pixel data with low power consumption.

As described above, in accordance with the present invention, the voltage for driving display pixels is configured to be internally refreshed. Therefore, it is not necessary to read pixel data signals for the refreshing from an external SRAM or video memory, and therefore, it is possible to refresh display image data with low current consumption.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A display device comprising:

a plurality of pixel elements arranged in rows and columns;

a plurality of scanning lines, each scanning line corresponding to a respective row and transmitting a selection signal to pixel elements in the corresponding row;

a plurality of data lines, each data line corresponding to a respective column, each data line transmitting a data signal to pixel elements in a corresponding column;

a plurality of selection transistors, each selection transistor corresponding to a respective pixel element and transmitting a data signal on a corresponding data line to the corresponding pixel element, in response to a selection signal on the corresponding scanning line;

a plurality of holding capacitance elements, each holding capacitance element corresponding to a respective selection transistor and holding a voltage applied to the corresponding pixel element;

refresh circuitry for reading out holding voltages of the holding capacitance elements in response to a refresh instruction, and refreshing and restoring the holding voltages of the holding capacitance elements in accordance with the holding voltage signals read out; and, a row selection circuit for driving the scanning lines to a selected state, in a predetermined order, in response to the refresh instruction and coupling the holding capacitance elements on a selected row to corresponding data lines, wherein the data lines are arranged in pairs, and the refresh circuitry comprises, for each column, a data line control circuit for connecting the pairs of data lines to respective pairs of complementary signal lines, in response to the refresh instruction;

a voltage setting circuit selectively activated in response to the refresh instruction, for setting the pairs of complementary signal lines to a predetermined voltage level, when activated.

a differential amplification circuit, corresponding to each pair of complementary signal lines and selectively activated in response to the refresh instruction, for differentially amplifying the voltages of the corresponding pair of complementary signal lines, when activated.

2. The display device according to claim 1, wherein complementary signal lines in a pair of the complementary signals transmit complementary signals, said voltage setting circuit comprises a plurality of voltage initial setting circuits, each voltage initial setting circuit corresponding to a pair of the complementary signals lines for setting the corresponding pair of complementary signal lines to the predetermined voltage level, and the refresh circuitry further comprises:

a refresh request circuit for generating a refresh request in response to the refresh instruction at predetermined intervals;

a line selection circuit, responsive to the refresh request signal, for selecting the plurality of scanning lines in a predetermined order and connecting the holding capacitance elements in a selected row to corresponding data lines; and a refresh control circuit responsive to the refresh request signal, for selectively activating the voltage initial setting circuits and the differential amplification circuit.

3. The display device according to claim 1, wherein the data lines comprise a first internal data line and a second internal data line, corresponding to each column of pixel elements and respectively transmitting complementary signals, and the pixel elements are arranged in correspondence with intersections of each of the scanning lines and one of the first and second internal data lines, in each column.

4. The display device according to claim 1, wherein each of the pixel elements includes a driving transistor selectively rendered conductive in accordance with a holding voltage of a corresponding holding capacitance element, for coupling a common electrode to a corresponding pixel electrode, and a liquid crystal element located between a pixel electrode and a counter electrode.

5. The display device according to claim 1, wherein the refresh circuitry further comprises:

an inversion writing circuit for inverting a data signal amplified by the differential amplification circuit of a pair of complementary signal lines for writing into a corresponding voltage holding capacitance element; and a polarity inversion circuit for inverting polarity of a voltage applied to a counter electrode of the pixel element.

6. The display device according to claim 5, wherein the refresh circuitry inverts the polarity of the voltage applied to the counter electrode of the pixel element, upon completion of a refreshing of the holding voltage with respect to all of the pixel elements.

7. The display device according to claim 5, wherein the polarity inversion circuit inverts the polarity of the voltage to be applied to the counter electrode of the pixel element associated with the corresponding capacitance element.

8. The display device according to claim 7, wherein, when refreshing of the holding voltage is completed with respect to all of the pixel elements, the polarity inversion circuit inverts the voltage polarity of the counter electrode of the pixel element.

9. The display device according to claim 7, wherein the pixel element comprises a liquid crystal element receiving the holding voltage of a corresponding holding capacitance element on one electrode.

10. The display device according to claim 1, wherein the pixel element comprises an element supplied with a current in accordance with the holding voltage of a corresponding holding capacitance element for emitting light.

11. The display device according to claim 1, wherein in the plurality of data lines, adjacent data lines form a pair; and the refresh circuitry connects the holding capacitance element to one of the data lines of a corresponding pair of data lines, upon activation of the refresh instruction, for refreshing the holding voltage of the holding capacitance element connected to the one of the data lines, and connects the holding capacitance element to both of the data lines of the pair of data lines in a normal operation mode for storing data transmitted through the data lines in the holding capacitance elements.

12. The display device according to claim 11, further comprising a test output circuit for externally transmitting voltage signals of a pair of data lines.

13. The display device according to claim 12, further comprising an amplification circuit for amplifying a voltage signal read out from the voltage holding capacitance element on a data line of one of the pairs of data lines, wherein the test output circuit outputs the voltage signal amplified by the amplification circuit.

14. The display device according to claim 1, further comprising reference cells, corresponding to the respective holding capacitance elements, for storing complementary data, complementary to data of corresponding holding capacitance elements.

15. The display device according to claim 14, wherein the reference cells are aligned in a row direction with corresponding holding capacitance elements.

16. A display device comprising:

a plurality of pixel elements arranged in rows and columns;

a plurality of pairs of scanning lines, each pair of scanning lines corresponding to a respective one of the rows, each scanning line transmitting a selection signal to alternating pixel elements in the corresponding row;

a plurality of data lines, each data line corresponding to one of the columns, each data line transmitting a data signal to pixel elements in the corresponding column;

a plurality of selection transistors, each selection transistor corresponding to a respective pixel element, each selection transistor transmitting a data signal on a corresponding data line to the corresponding pixel element in response to a selection signal on a corresponding scanning line;

a plurality of holding capacitance elements, each holding capacitance element corresponding to a respective selection transistor and holding a voltage applied to the corresponding pixel element;

refresh circuitry for reading out holding voltages of the holding capacitance elements in response to a refresh instruction, and refreshing and restoring the holding voltages of the holding capacitance elements in accordance with the holding voltage signals read out; and a row selection circuit for driving the scanning lines to a selected state in a predetermined order in response to the refresh instruction and coupling the holding capacitance elements on a selected row to corresponding data lines, wherein the refresh circuitry comprises, for each column, a data line control circuit for connecting pairs of data lines to respective pairs of complementary signal lines, in response to the refresh instruction;

a voltage setting circuit selectively activated in response to the refresh instruction, for setting the pairs of complementary signal lines to a predetermined voltage level, when activated; and a differential amplification circuit, corresponding to each pair of complementary signal lines and selectively activated in response to the refresh instruction, for differentially amplifying the voltages of the corresponding pair of complementary signal lines, when activated, and upon activation of the refresh instruction, the row selection circuit selects one of the scanning lines in a selected row so that the holding capacitance element is connected to one of the data lines of the pair of data lines, and upon non-activation of the refresh instruction, the row selection circuit simultaneously selects the two scanning lines in the selected row.

17. The display device according to claim 16 further comprising a plurality of reference capacitance elements, each reference capacitance element corresponding to a respective one of the pixel elements and being connected to a scanning line different from the scanning line connected to the corresponding pixel element for, when selected, holding a voltage corresponding to data complementary to data held in the corresponding holding capacitance element.

18. A display device comprising:

a plurality of pixel elements arranged in rows and columns;

a plurality of pairs of scanning lines, each pair of scanning lines corresponding to a respective one of the rows, each scanning line transmitting a selection signal to alternating pixel elements in the corresponding row;

a plurality of data lines, each data line corresponding to one of the columns, each data line transmitting a data signal to pixel elements in the corresponding column;

a plurality of selection transistors, each selection transistor corresponding to a respective pixel element, each selection transistor transmitting a data signal on a corresponding data line to the corresponding pixel element in response to a selection signal on a corresponding scanning line;

a plurality of holding capacitance elements, each holding capacitance element corresponding to a respective selection transistor and holding a voltage applied to the corresponding pixel element; and refresh circuitry for reading out holding voltages of the holding capacitance elements in response to a refresh instruction, and refreshing and restoring the holding voltages of the holding capacitance elements in accordance with the holding voltage signals read out, wherein the refresh circuitry comprises a refresh request circuit for generating a refresh request in response to the refresh instruction at predetermined intervals;

a data line control circuit responsive to the refresh instruction, for selectively connecting the pairs of data lines to pairs of complementary signal lines, corresponding to the respective columns, complementary signal lines in a pair of complementary signal lines transmitting complementary signals;

a voltage initial setting circuit, corresponding to the pairs of complementary signal lines, for setting corresponding pairs of complementary signal lines to a predetermined voltage level, when activated;

a differential amplification circuit corresponding to each pair of the complementary signal lines, for differentially amplifying potentials of a corresponding pair of complementary signal lines, when activated;

a line selection circuit, responsive to the refresh request signal, for selecting the plurality of scanning lines in a predetermined order and connecting the holding capacitance elements in a selected row to corresponding data lines; and a refresh control circuit responsive to the refresh request signal, for selectively activating the voltage initial setting circuit and the differential amplification circuit, and upon activation of the refresh instruction, the line selection circuit selects one of the scanning lines in a selected row so that the holding capacitance element is connected to one of the pairs of data lines, and upon inactivation of the refresh instruction, the line selection circuit simultaneously selects the two scanning lines in the selected row.

19. The display device according to claim 18 further comprising a plurality of reference capacitance elements, each reference capacitance element corresponding to a respective one of the pixel elements and being connected to a scanning line different from the scanning line connected to the corresponding pixel element for, when selected, holding a voltage corresponding to data complementary to data held in the corresponding holding capacitance element.

* * * * *